US010030421B2

(12) United States Patent
Guidos

(10) Patent No.: US 10,030,421 B2
(45) Date of Patent: Jul. 24, 2018

(54) LATCH AND LOCK SYSTEM

(71) Applicant: KLS DOORS, LLC, Ontario, CA (US)

(72) Inventor: Michael John Guidos, Lake Arrowhead, CA (US)

( * ) Notice: Subject to any disclaimer, the term of this patent is extended or adjusted under 35 U.S.C. 154(b) by 480 days.

(21) Appl. No.: 14/619,541

(22) Filed: Feb. 11, 2015

(65) Prior Publication Data

US 2015/0225985 A1 Aug. 13, 2015

Related U.S. Application Data

(60) Provisional application No. 61/939,216, filed on Feb. 12, 2014.

(51) Int. Cl.

| | |
|---|---|
| ***E05C 3/04*** | (2006.01) |
| ***E05C 1/12*** | (2006.01) |
| ***E05B 65/08*** | (2006.01) |
| ***E05B 5/00*** | (2006.01) |
| *E05B 15/02* | (2006.01) |

(52) U.S. Cl.

CPC ..... *E05C 1/12* (2013.01); *E05B 5/006* (2013.01); *E05B 65/0876* (2013.01); *E05B 15/0245* (2013.01); *Y10T 292/1049* (2015.04); *Y10T 292/57* (2015.04)

(58) Field of Classification Search

CPC ..... Y10T 292/0972; Y10T 292/096; Y10T 292/0968; Y10T 292/1028; Y10T 292/0969; Y10T 292/0836; Y10T 292/0986; Y10T 292/104; Y10T 292/705; E05C 9/02; E05C 17/446; Y10S 292/37; Y10S 292/26

See application file for complete search history.

(56) References Cited

U.S. PATENT DOCUMENTS

| | | | | |
|---|---|---|---|---|
| 1,656,410 | A | 1/1928 | Baer et al. | |
| 1,731,005 | A * | 10/1929 | Goldsmith | E05B 85/22 292/167 |
| 1,781,692 | A | 11/1930 | Lewis | |
| 1,850,222 | A * | 3/1932 | Carlson | E05C 9/02 292/167 |
| 1,854,443 | A | 4/1932 | Barce | |
| 1,873,424 | A | 8/1932 | Kerr et al. | |
| 2,394,667 | A | 2/1946 | Dailey | |
| 2,610,367 | A | 9/1952 | Nordahl | |
| 2,677,268 | A | 5/1954 | Hobbs | |
| D175,684 | S | 9/1955 | Kellogg | |
| 2,761,150 | A | 9/1956 | Kellogg | |

(Continued)

FOREIGN PATENT DOCUMENTS

| | | |
|---|---|---|
| GB | 2182085 | 5/1987 |

OTHER PUBLICATIONS http://www.raumplusna.com/air ; Sliding door system-AIR product list and system description, including accessories ; 2013;.

(Continued)

*Primary Examiner* — Mark A Williams

(74) *Attorney, Agent, or Firm* — Patent Law Agency, LLC; Peter Ganjian

(57) ABSTRACT

The present invention discloses a lock mechanism, comprising a latch mechanism that includes a remote latch actuator that is positioned remotely from a remote latch assembly and a keeper assembly, with the latch mechanism housed and accommodated within an enclosure.

25 Claims, 77 Drawing Sheets

(56) References Cited

U.S. PATENT DOCUMENTS

| | | | | |
|---|---|---|---|---|
| 2,815,543 | A | 12/1957 | Gates | |
| 2,897,515 | A | 8/1959 | Collins | |
| 2,980,969 | A | 4/1961 | Tinfow | |
| 3,037,555 | A | 6/1962 | Kochanowski | |
| 3,102,581 | A | 9/1963 | Kochanowski | |
| 3,335,784 | A | 8/1967 | Risk et al. | |
| 3,418,666 | A | 12/1968 | Thomas | |
| 3,422,464 | A | 1/1969 | O'Brien | |
| 3,552,158 | A * | 1/1971 | Lengen | E05C 1/166 292/153 |
| 3,562,956 | A | 2/1971 | Johnson, Jr. | |
| 3,744,827 | A | 7/1973 | Cox | |
| 3,879,912 | A | 4/1975 | Cox | |
| 3,942,197 | A | 3/1976 | Sudmann et al. | |
| 4,014,377 | A | 3/1977 | Kochanowski | |
| 4,014,378 | A | 3/1977 | Kochanowski | |
| 4,060,267 | A | 11/1977 | Monfardini | |
| 4,089,135 | A | 5/1978 | Beny et al. | |
| 4,115,900 | A | 9/1978 | Mihalcheon | |
| 4,152,789 | A | 5/1979 | Heath | |
| 4,256,164 | A | 3/1981 | Agcaoili | |
| 4,316,295 | A | 2/1982 | Whitney et al. | |
| 4,458,449 | A | 7/1984 | Breuer | |
| 4,473,911 | A | 10/1984 | Germain | |
| 4,480,462 | A | 11/1984 | Fleming | |
| 4,484,411 | A | 11/1984 | Rystad | |
| 4,653,127 | A | 3/1987 | Baus | |
| 4,671,026 | A | 6/1987 | Wissinger | |
| 4,769,862 | A | 9/1988 | Skrzelowski | |
| 4,807,312 | A | 2/1989 | Baus | |
| 4,882,795 | A | 11/1989 | Baus | |
| 4,901,380 | A | 2/1990 | Smith | |
| 5,083,822 | A | 1/1992 | Mangin et al. | |
| 5,103,531 | A | 4/1992 | Perrotta | |
| 5,311,707 | A | 5/1994 | LaRoche et al. | |
| 5,473,843 | A | 12/1995 | LaRoche et al. | |
| 5,622,017 | A | 4/1997 | Lynn et al. | |
| 5,657,581 | A | 8/1997 | Husting | |
| D397,928 | S | 9/1998 | Wise | |
| 5,852,837 | A | 12/1998 | Husting | |
| 5,860,264 | A | 1/1999 | Gephart et al. | |
| 5,906,403 | A | 5/1999 | Bestlet et al. | |
| 5,908,064 | A | 6/1999 | Burce | |
| 6,006,375 | A | 12/1999 | Carr | |
| 6,023,889 | A | 2/2000 | Husting et al. | |
| 6,082,499 | A | 7/2000 | O'Donnell | |
| 6,082,795 | A | 7/2000 | O'Donnell | |
| 6,094,757 | A | 8/2000 | Torres | |
| 6,109,666 | A | 8/2000 | Collet | |
| 6,182,738 | B1 | 2/2001 | Chen | |
| 6,216,287 | B1 | 4/2001 | Wise | |
| 6,470,511 | B1 | 10/2002 | Smale | |
| 6,491,326 | B1 | 12/2002 | Massey et al. | |
| 6,691,339 | B1 | 2/2004 | Thomas | |
| 6,698,037 | B2 | 3/2004 | Lippe | |
| 6,817,144 | B1 | 11/2004 | Tavivian | |
| 6,851,133 | B1 | 2/2005 | Nehring | |
| 6,990,695 | B2 | 1/2006 | Grayson | |
| 7,028,349 | B2 | 4/2006 | Helmetsie et al. | |
| 7,174,977 | B2 | 2/2007 | Guidos et al. | |
| 7,225,480 | B2 | 6/2007 | Mascheron | |
| 7,273,084 | B2 | 9/2007 | Chen | |
| 7,377,076 | B2 | 5/2008 | Shedd | |
| 7,591,492 | B2 | 9/2009 | Nikkhah | |
| 7,634,823 | B2 | 12/2009 | Sisk | |
| 7,694,358 | B2 | 4/2010 | Stimpson | |
| 7,735,795 | B2 | 6/2010 | Wronski | |
| 7,761,935 | B1 | 7/2010 | Whitaker | |
| 7,849,531 | B2 | 12/2010 | Rooke et al. | |
| 7,856,771 | B2 | 12/2010 | Guidos et al. | |
| 8,037,556 | B2 | 10/2011 | Lock et al. | |
| 8,069,506 | B2 | 12/2011 | Hammond | |
| 8,151,385 | B2 | 4/2012 | Goskowski et al. | |
| 9,622,623 | B2 | 4/2017 | Kee et al. | |
| 2002/0157325 | A1 | 10/2002 | Domanico | |
| 2002/0163203 | A1 | 11/2002 | Donald | |
| 2003/0188379 | A1 | 10/2003 | Cowell et al. | |
| 2004/0003484 | A1 | 1/2004 | D'Assumcao | |
| 2005/0177936 | A1 | 8/2005 | Graells Pane | |
| 2008/0047057 | A1 | 2/2008 | Ho | |
| 2008/0202056 | A1 | 8/2008 | Jantzen | |
| 2008/0250558 | A1 | 10/2008 | Torres | |
| 2009/0038070 | A1 | 2/2009 | Belanger et al. | |
| 2009/0056077 | A1 | 3/2009 | Belanger et al. | |
| 2009/0211175 | A1 | 8/2009 | Guidos | |
| 2010/0147042 | A1 | 6/2010 | Chen | |
| 2010/0281612 | A1 | 11/2010 | Cook | |
| 2010/0293708 | A1 | 11/2010 | Hildebrandt | |
| 2011/0005140 | A1 | 1/2011 | Guidos et al. | |
| 2011/0083393 | A1 | 4/2011 | Guidos et al. | |
| 2011/0094686 | A1 | 4/2011 | Kee et al. | |
| 2011/0203046 | A1 | 8/2011 | Donnelly et al. | |
| 2011/0283624 | A1 | 11/2011 | Baer | |
| 2011/0291848 | A1 | 12/2011 | Burdenko | |
| 2012/0023658 | A1 | 2/2012 | Bobeck et al. | |
| 2012/0198655 | A1 | 8/2012 | Lapping | |
| 2013/0214544 | A1* | 8/2013 | Chen | E05B 53/00 292/162 |
| 2015/0225985 | A1* | 8/2015 | Guidos | E05C 1/12 292/218 |

OTHER PUBLICATIONS http://www.contractorswardrobe.com/instructions_all.html ; Door Panel Model #5000-45-45; assembly and installation instructions;. mobilehomepartsstore.com ; Kinro Vinyl Sliding Patio Door; 2002-2012;.
Photos of rollers.
Photos of enclosures; the photos were taken on Jul. 6, 2011.
Photo of adjustable roller; http://cqyqgd.en.made-in-china.com/.
Photo of broken hinge roller.
Photo of garage door roller; Pub. 2006.
Photo of Roller-Hinge replacement.
Pictures of Known Related Rollers for Shower Doors.

* cited by examiner

100

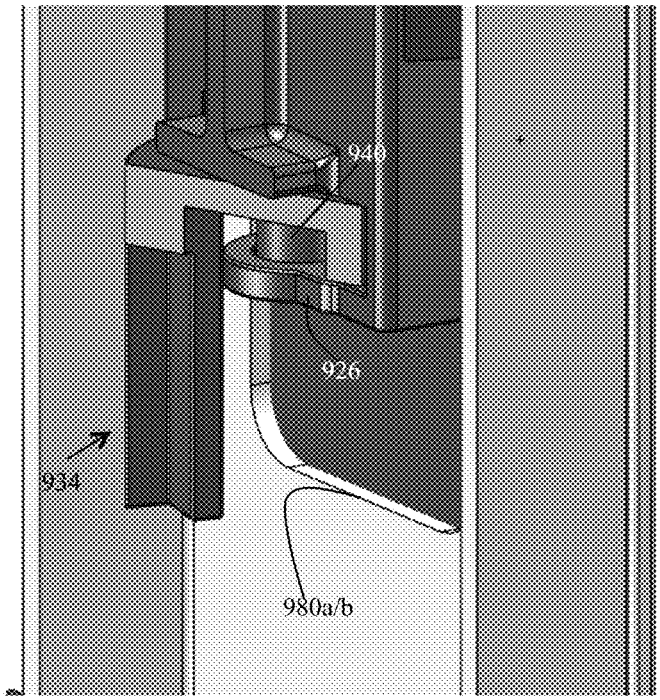
FIG. 9G-4
FIG. 9G-5
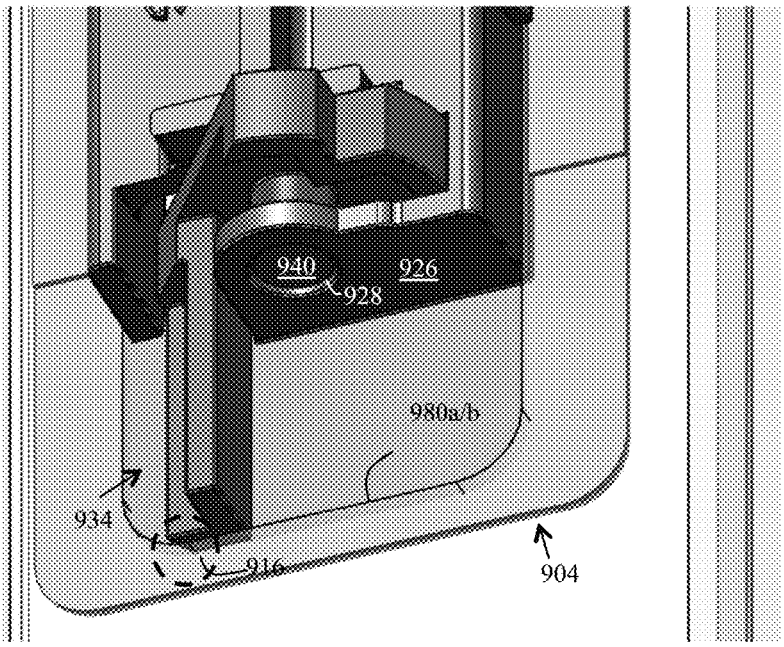

LATCH AND LOCK SYSTEM

CROSS-REFERENCE TO RELATED APPLICATIONS

This Application is Non-Provisional Application that claims the benefit of priority of the U.S. Provisional Utility Patent Application 61/939,216 with a filing date 12 Feb. 2014, the entire disclosures which is expressly incorporated by reference in its entirety herein. It should be noted that where a definition or use of a term in the incorporated patent application is inconsistent or contrary to the definition of that term provided herein, the definition of that term provided herein applies and the definition of that term in the incorporated patent application does not apply.

BACKGROUND OF THE INVENTION

Field of the Invention

One or more embodiments of the present invention relate to a latch and lock system and, more particularly, to a latch and lock system that is mostly self-contained and incorporated within an extrusion of an enclosure (e.g., surface mounted sliding door, panels, etc.).

Description of Related Art

Conventional lock mechanisms are well known and have been in use for a number of years. In general, most conventional lock mechanisms are used on enclosures (e.g., doors, windows, etc.) that abut against a secondary structure (e.g., jambs, casing, headers, floor, etc.) that incorporates one, single strike portion (or a "keeper") of the locking mechanism while the enclosure itself accommodates a latch mechanism of the locking mechanism. The strike portion or the keeper is fixed onto the secondary structure so that most types of enclosures (e.g., surface mounted doors, pocket doors, sliding doors, pivot doors, windows, etc.) that use conventional lock mechanisms are locked and unlocked at only one single position in relation to keeper of the secondary structure, which is generally a fully closed position of the enclosure to fully close access to an area.

A further drawback with conventional lock mechanisms is that the latch mechanism and the single keeper must be assembled on the respective enclosure and the secondary structure at a very close proximity to one another, which limits their use and application. For example, if an enclosure is to be locked and secured from its top, then the latch mechanism must be positioned at the top of the enclosure near the keeper so that a latching member of the latch mechanism may reach to and cooperatively engage with the keeper, and the keeper is positioned on the secondary structure near the top of the enclosure, close to and aligned with the latch mechanism so that it can receive the latching member. This physically limits and compels the positioning of the latch mechanism near the keeper, which in certain instances may not be practical, esthetically pleasing, or in some instances even legal (as not being compliant with various jurisdictional requirements such as not being compliant with American Disability Act (ADA)). Accordingly, positioning of a convention lock mechanisms with respect to the enclosure and the secondary structure is very limited, dictated by the positioning of the latch mechanism in relation to the keeper.

A further drawback with most conventional latch and lock mechanisms is that they are manufactured and used for specific types (e.g., makes/models) of enclosures and hence, lack the universal adaptability to be able to be used in different types of enclosures. As a further disadvantage, conventional latch and lock mechanisms lack the desired adjustability to allow for tolerances to accommodate variations in structures with which the latch and lock mechanisms are associated.

Accordingly, in light of the current state of the art and the drawbacks to current latching and locking mechanisms mentioned above, a need exists for a latching and locking system that would enable adjustably latching and securely locking and unlocking an enclosure at a desired position in relation to a structure. Further, a need exists for a latching and locking system that would not require physical proximity between a keeper and a latch mechanism of a latching and locking system, and would be accommodative for variations in distance between the keeper and the latch mechanism. Additionally, a need exists for a latching and locking system that would be able to be used in more than one type of enclosure (e.g., surface mounted doors, wardrobe doors, sliding doors, pocket doors, pivot doors, etc.), while allowing for tolerances for accommodating variations in structures with which the latching and locking system is associated for continued correct operations.

BRIEF SUMMARY OF THE INVENTION

A non-limiting, exemplary aspect of an embodiment of the present invention provides a lock mechanism, comprising:

a latch mechanism that includes:

a remote latch actuator that is positioned remotely from a remote latch assembly and a keeper assembly, with the latch mechanism housed and accommodated within an enclosure.

These and other features or aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIG. 1A to 1C-2 are non-limiting, exemplary illustrations of a latch and lock system in accordance with one or more embodiments of the present invention;

FIGS. 2A to 4L-4 are non-limiting, exemplary illustrations of a remote latch actuator of the latch and lock system shown in FIGS. 1A to 1C-2 in accordance with one or more embodiments of the present invention;

FIGS. 5A-1 to 5B-2 are non-limiting, exemplary illustrations of a remote latch assembly and keeper assembly of the latch and lock system shown in FIGS. 1A to 4L-4 in accordance with one or more embodiments of the present invention;

FIGS. 6A-1 to 6J are non-limiting, exemplary illustrations of a remote latch assembly of the latch and lock system shown in FIGS. 1A to 5B-2 in accordance with one or more embodiments of the present invention;

FIGS. 7A to 7F are non-limiting, exemplary illustrations of a keeper assembly of the latch and lock system shown in FIGS. 1A to 6J in accordance with one or more embodiments of the present invention;

FIGS. 8A to 8F-2 are non-limiting, exemplary illustrations of a latch and lock system that includes a handle assembly in accordance with one or more embodiments of the present invention; and FIGS. 9A to 9I-5 are non-limiting, exemplary illustrations of a latch and lock system with an optional handle assembly in accordance with one or more embodiments of the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

As detailed below, one or more embodiments of the present invention provide a latching and locking system that may adjustably latch and securely lock and unlock an enclosure at multiple positions in relation to a structure. Further, since the enclosure may be adjustably fixed to multiple desired positions in relation to a structure and securely latched, locked, and unlocked in multiple desired positions, the enclosures using the latching and locking system in accordance with one or more embodiments may be used and function as wall panels, separating rooms and functioning as room partitions. Further more, one or more embodiments of the present invention provide a latching and locking system that does not require physical proximity between a keeper and a latch mechanism of the latching and locking system, but is accommodative for variations in distance between the keeper and the latch mechanism. Additionally, one or more embodiments of the present invention provide a latching and locking system that is universal in that it may be used in more than one type of enclosure (e.g., surface mounted doors, wardrobe doors, sliding doors, pocket doors, etc.). Furthermore, one or more embodiments of the present invention provide a latching and locking system that allows for tolerances for accommodating variations in structures with which the latching and locking system is associated for continued correct operations.

Figure 1A:
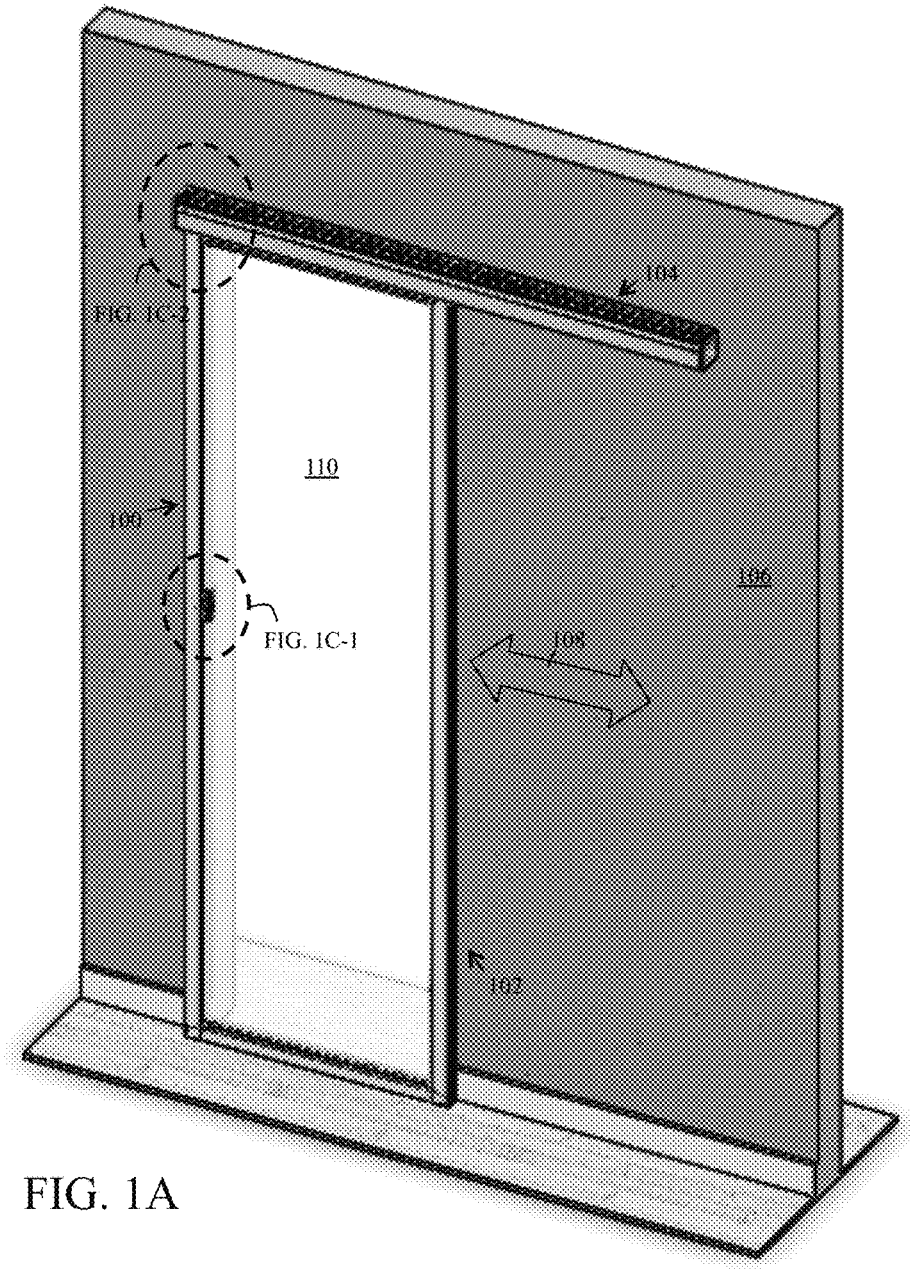
Figure 1B:
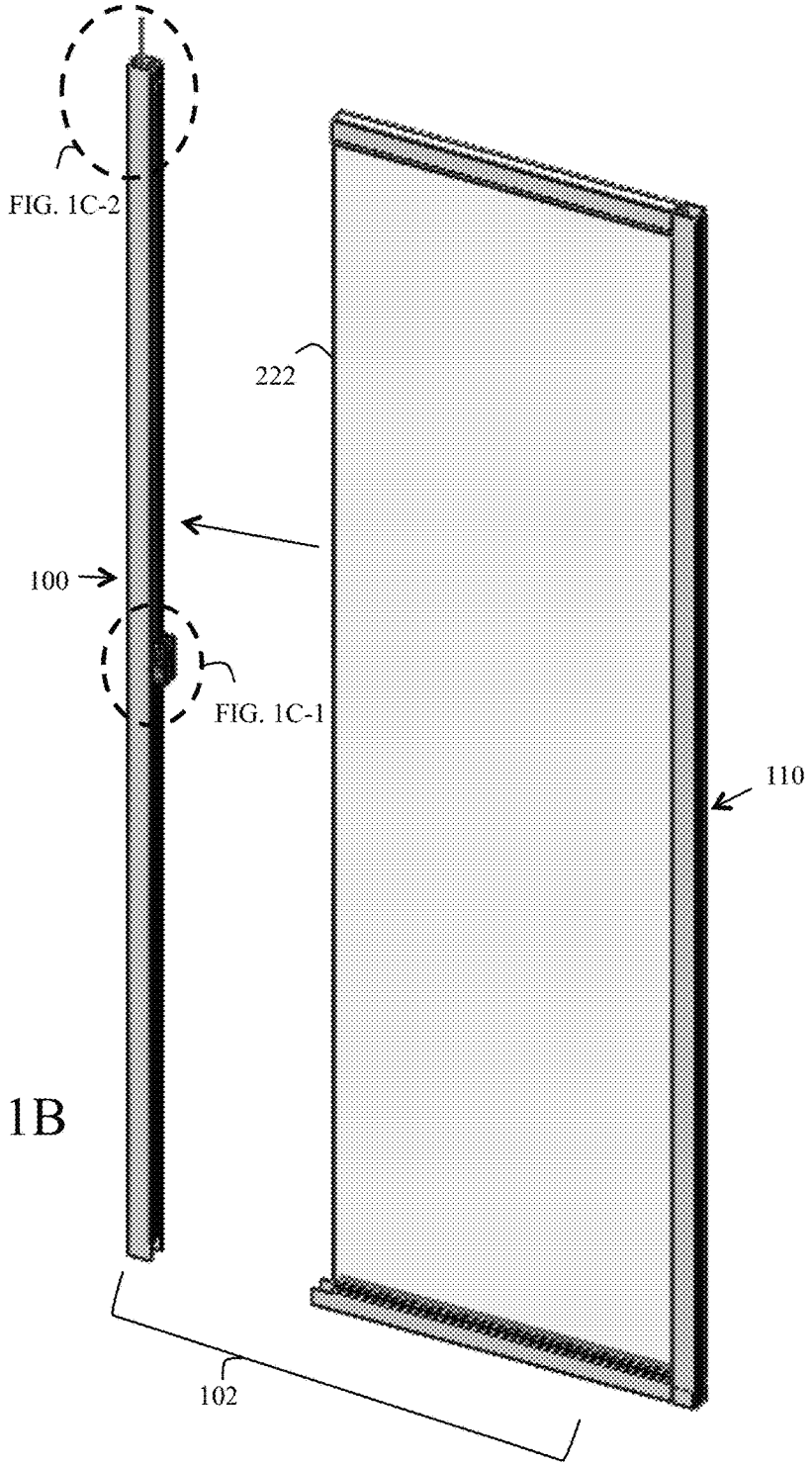
Figures 1, 1C, 2:
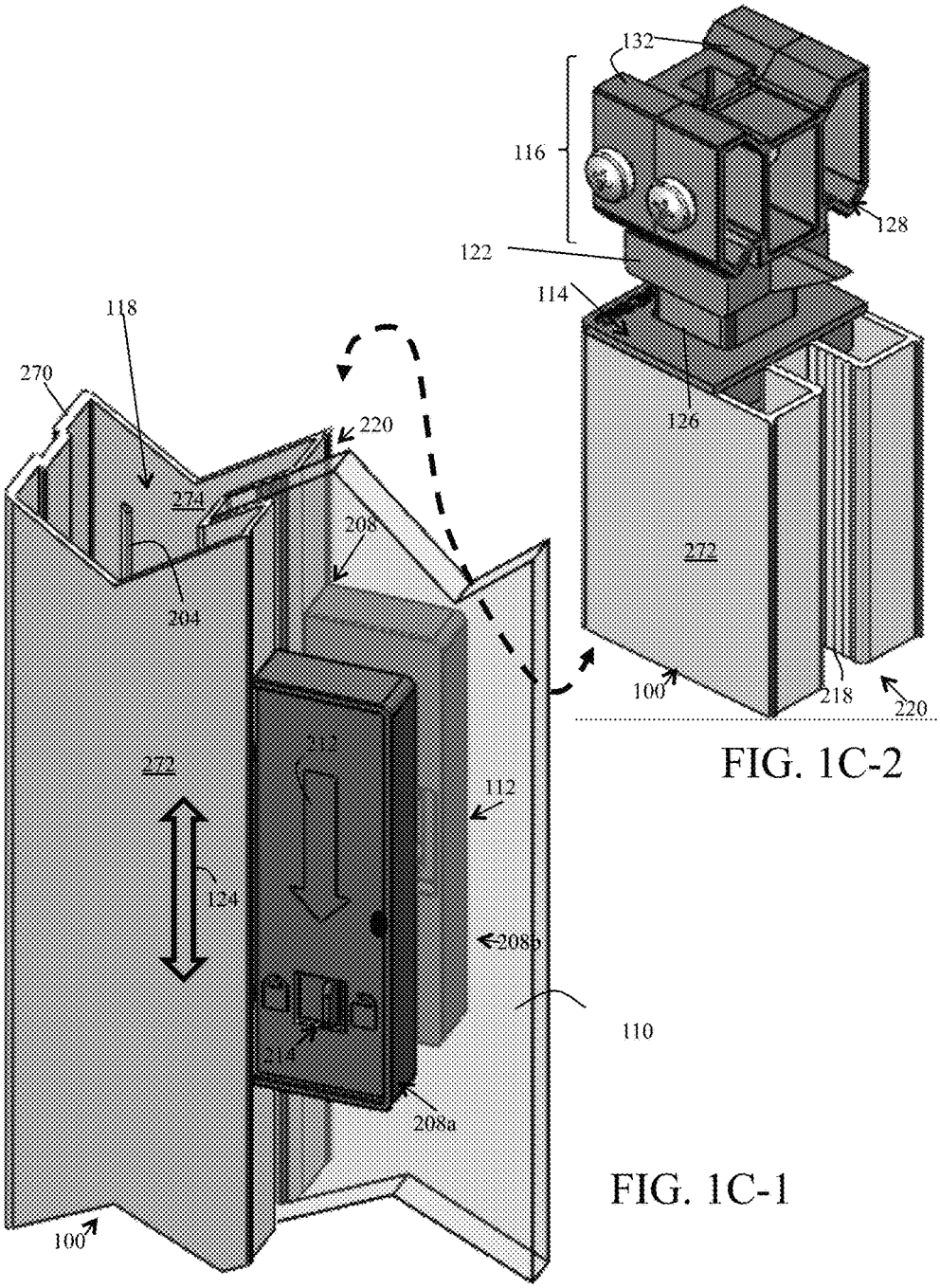

FIG. 1A is a non-limiting exemplary illustration of an exemplary enclosure with an extrusion that incorporates a latching and locking system in accordance with one or more embodiments of the present invention, FIG. 1B illustrates the same, but with the extrusion shown separated from the rest of the enclosure, and FIGS. 1C-1 and 1C-2 illustrate an enlarged portions of extrusion, exemplarily illustrating a remote latch actuator (FIG. 1C-1) and remote latch assembly and keeper assembly (FIG. 1C-2).

As illustrated in FIGS. 1A to 1C-2, in this non-limiting exemplary embodiment, the enclosure is represented as a glass door 102 that is suspended from a track 104. Door 102 moves along a reciprocating path indicated by arrow 108 along track 104 to open or close access to the illustrated opening of wall 106. Track 104 may be secured onto wall 106 in a well-known manner as illustrated. As best illustrated in FIG. 1B, door 102 may comprise of frame/glass portion 110 that is associated (e.g., glazed) with extrusion 100 to form a fully assembled door 102.

As best illustrated in FIGS. 1C-1 and 1C-2 and further detailed below, one or more embodiments of the present invention provide a latching and locking system that includes a latch mechanism that has a remote latch actuator 112 that is positioned physically away and remote from a remote latch assembly 114 and a keeper assembly 116, with the latch mechanism housed and accommodated within extrusion 100 of enclosure 102. Remote latch assembly 114 includes a latch 126 that latches onto a keeper 122 of keeper assembly 116. In general, as illustrated, extrusion 100 has an interior 118 that is hollow, accommodating remote latch actuator 112 and remote latch assembly 114.

Figure 2A:
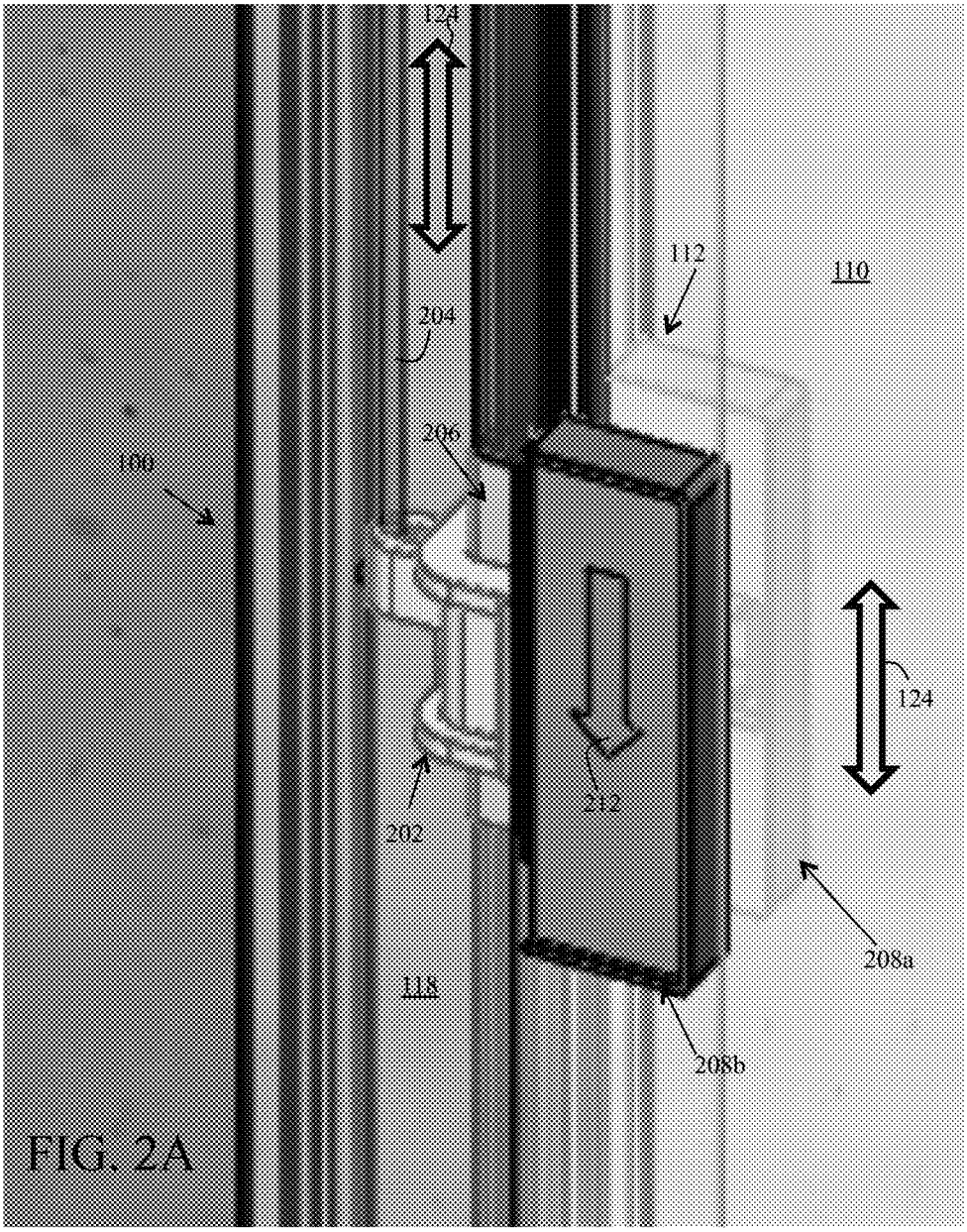
Figure 2B:
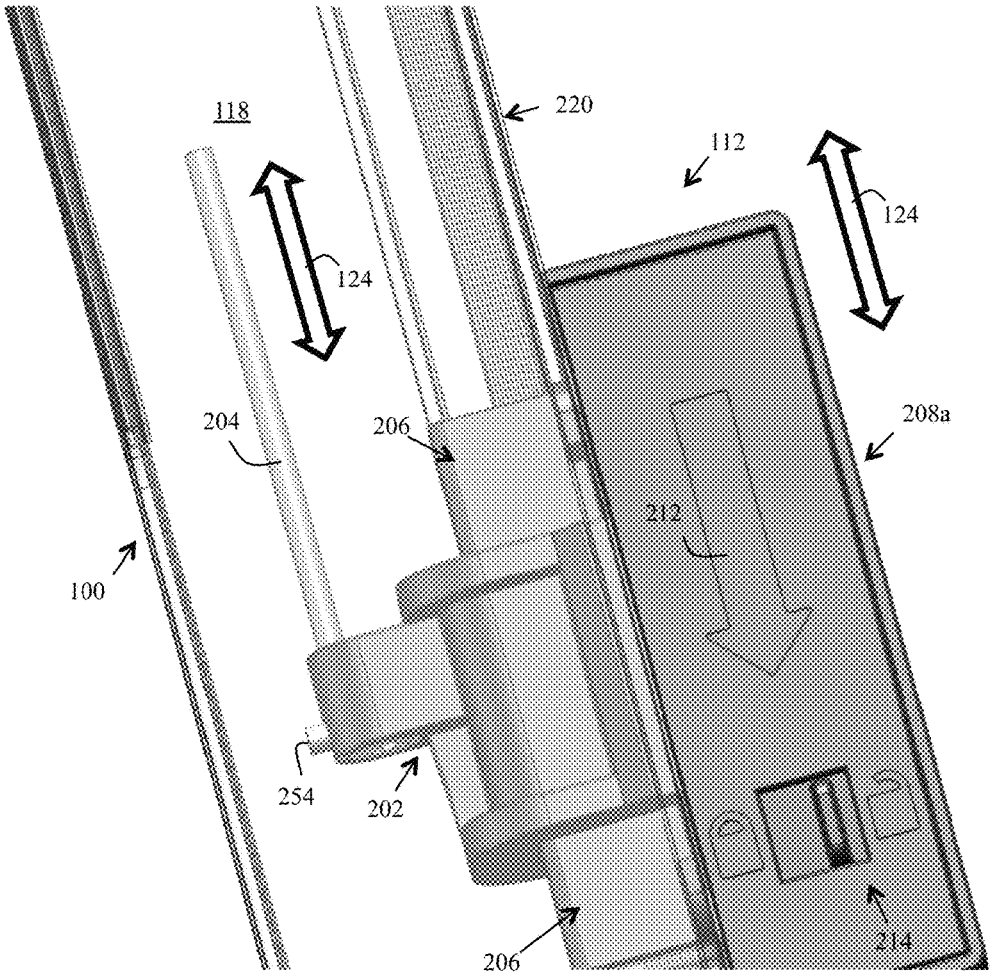
Figure 2C:
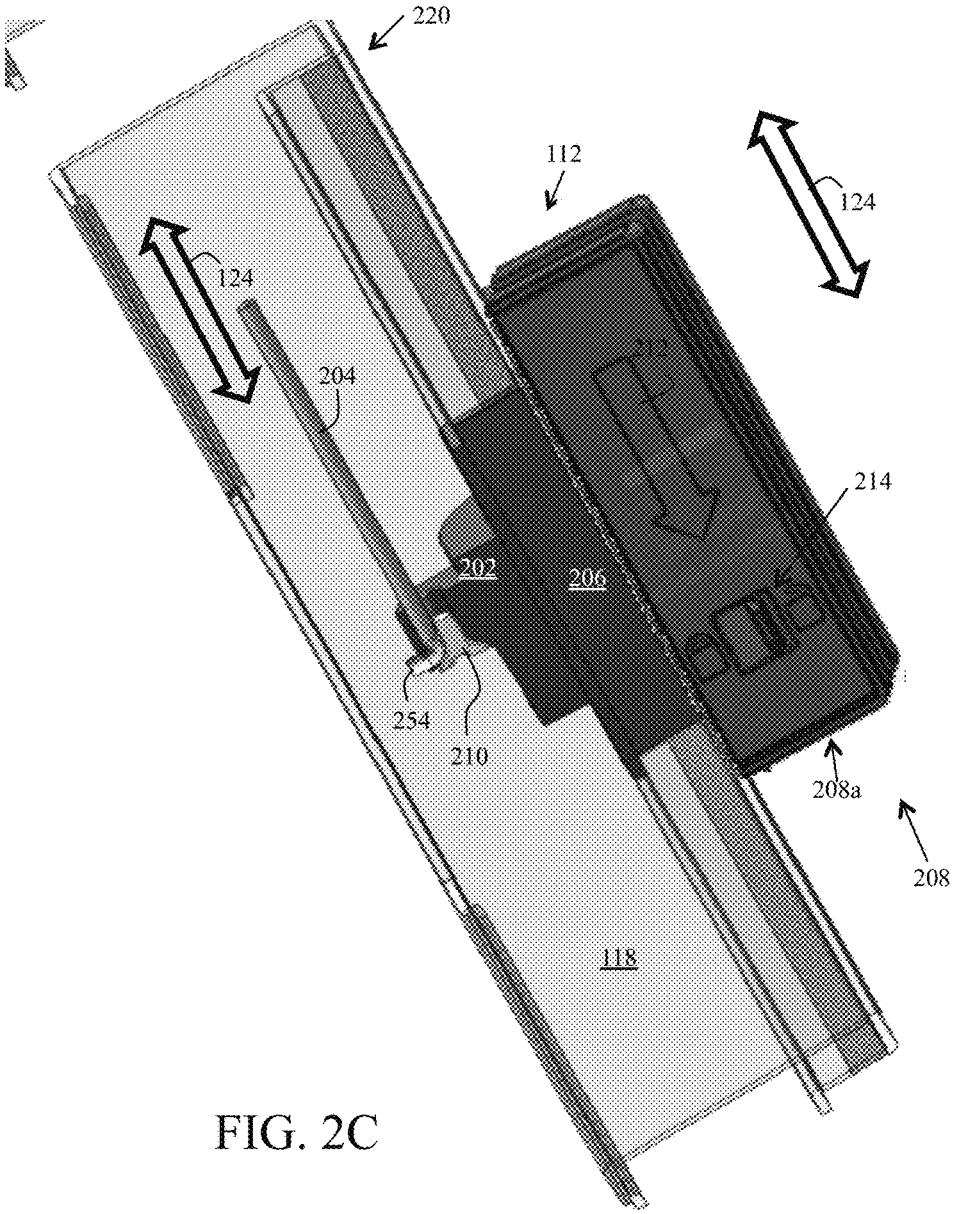
Figure 2D:
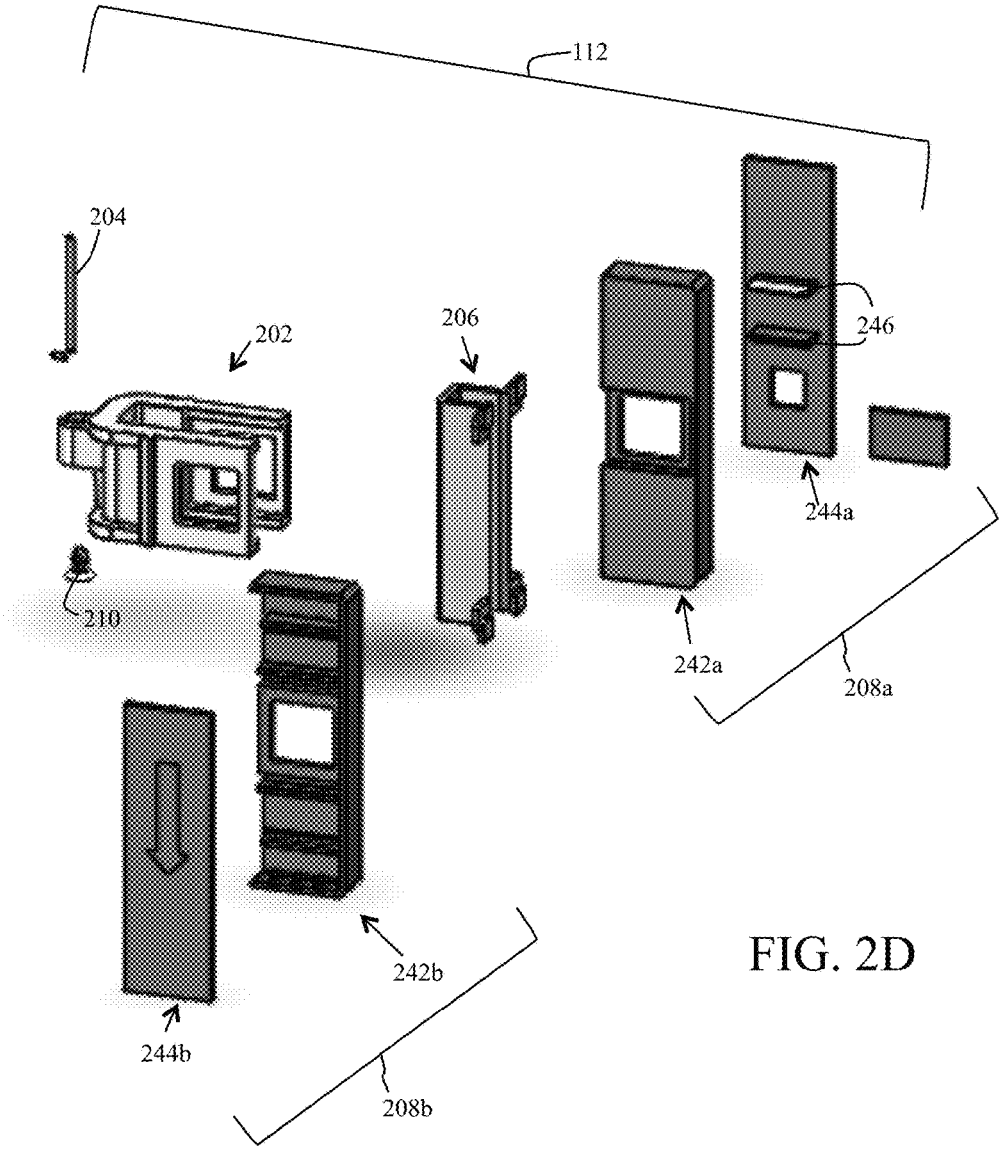
Figures 1, 2E:
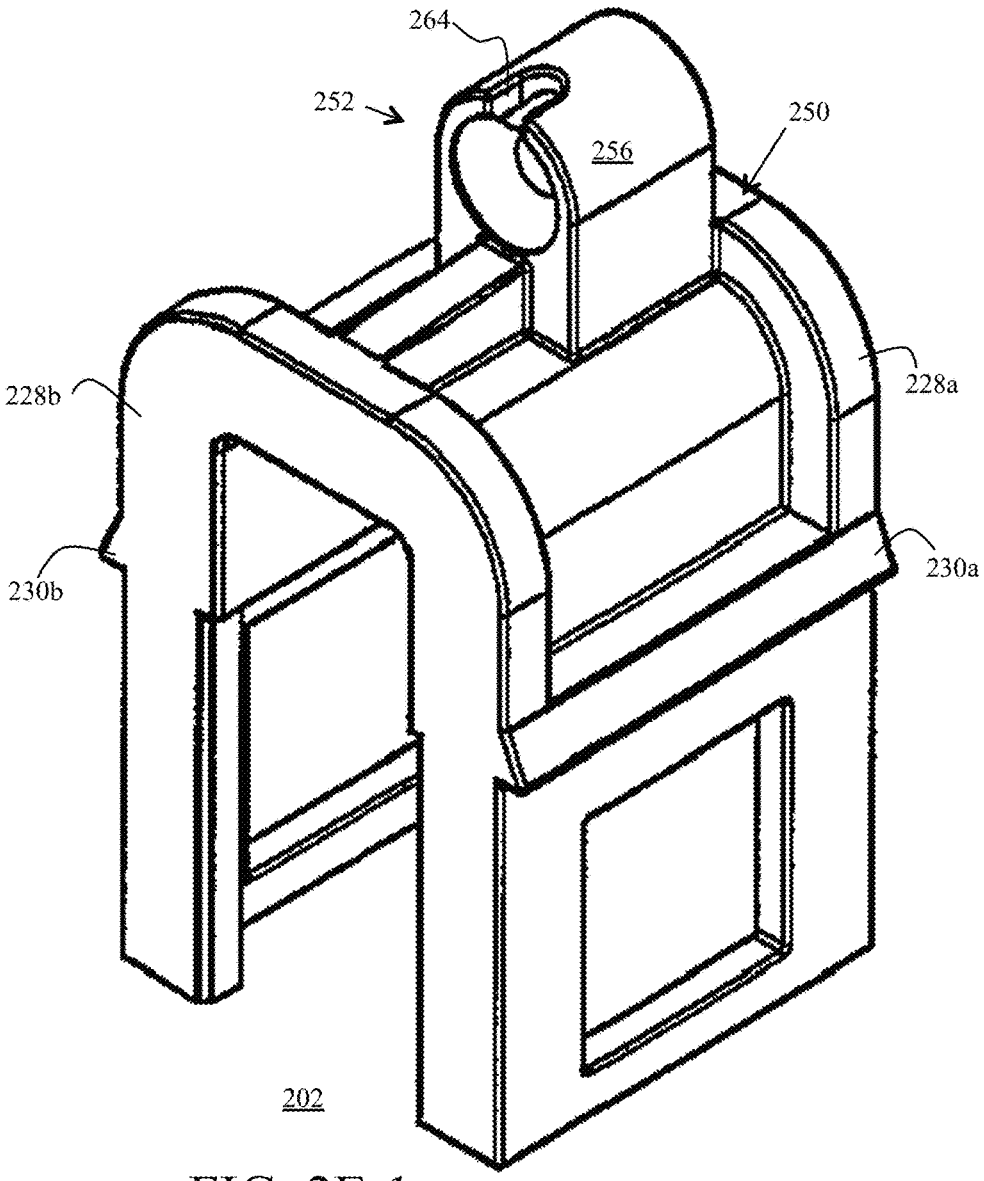
Figures 2, 2E:
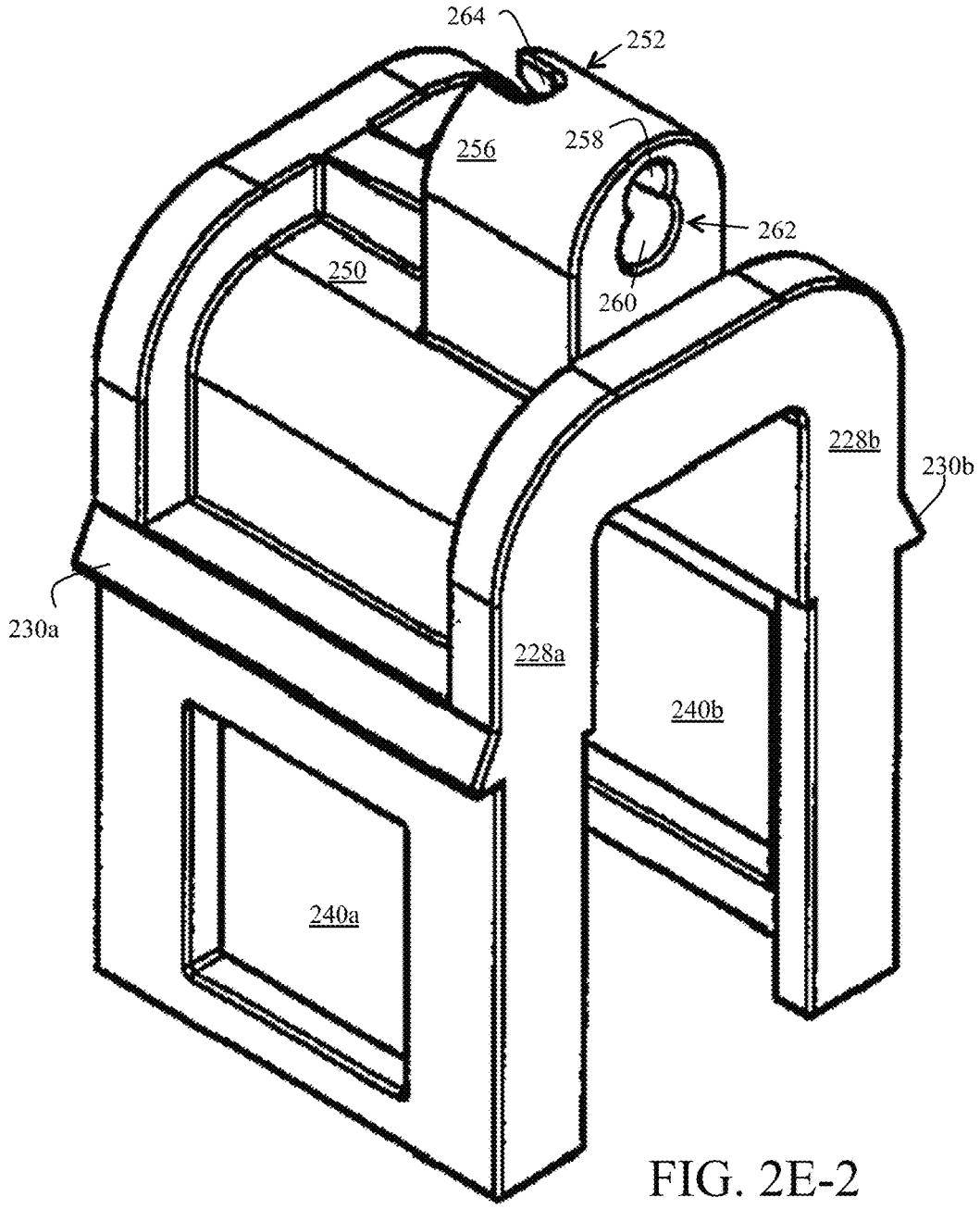

FIGS. 2A to 2C are non-limiting, exemplary illustrations of remote latch actuator shown housed within the extrusion that is illustrated as transparent for discussion purposes in accordance with one or more embodiments of the present invention. FIG. 2D is a non-limiting, exemplary illustration of an exploded view of the remote latch actuator in accordance with one or more embodiments of the present invention.

As illustrated in FIGS. 1A to 2C, extrusion 100 is comprised of two lateral sides 272 and 274 and back side 220 and front side 270 includes an opening 216 (best shown in FIGS. 2G-1 and 2G-3), allowing remote latch actuator 112 to be inserted along path shown by arrow 224 (FIG. 2G-1) through opening 216 and housed within interior 118 of extrusion 100 at a desired height of extrusion 100. Back (or first) side 220 of extrusion 100 receives frame/glass portion 110 of enclosure 102, with first side 220 comprised of a first extrusion groove 218 that accommodate a distal end 222 (FIG. 1B) of frame/glass portion 110 of door 102 (shown in FIG. 1C-1). Opening 216 for insertion and housing remote latch actuator 112 is positioned along first side 220 at a desired height of extrusion 100.

As further illustrated in FIGS. 1A to 2C, an embodiment for the latch mechanism of the present invention includes latch actuator handle assembly 208 comprised of an interior-facing latch actuator handle assembly 208*a* and an exterior-facing latch actuator handle assembly 208*b*, with the interior-facing latch actuator handle assembly 208*a* provided with a privacy latch 214 to prevent access to interior of an area divided or enclosed by enclosure 102. As illustrated in FIGS. 2A and 2B, interior and exterior facing latch actuator handle assemblies 208*a* and 208*b* may be reverse installed at either side of extrusion 100. Distal end 222 (FIG. 1B) of frame/glass portion 110 of door 102 is inserted in between the interior and the exterior-facing latch actuator handle assemblies 208*a* and 208*b*, secured within groove 218 of extrusion 100.

As further detailed below, latch actuator handle assembly 208 may be moved along reciprocating path shown by arrows 124. When latch actuator handle assembly 208 is moved along path 124 (shown by arrow 212 as "down,"), it actuates remote latch assembly 114 to unlock or release latch member 126 from keeper 122 of keeper assembly 116. More specifically and as further detailed below, when latch actuator handle assembly 208 is pushed down, a chassis 202 connected with latch actuator handle assembly 208 moves along reciprocating path shown by arrow 124 down, guided by a linear guide 206 to pull onto an actuator shaft 204 against a force of resilient member 226 pulling remote latch assembly 114. This action remotely disengages remotely positioned latch 126 of remote latch assembly 114 from keeper 122.

FIGS. 2E-1 to 2G-3 are exemplary illustration of few of the components of the remote latch actuator, which also illustrate a non-limiting, exemplary method of assembly thereof to form a fully assembled remote latch actuator as shown in FIGS. 1A to 2C. As indicated above, remote latch actuator 112 includes chassis 202 upon which latch actuator handle assembly 208 is mounted, including other components such as actuator shaft 204 that are detailed below. After securing a first end of actuator shaft 204 onto chassis 202 of remote latch actuator 112, chassis 202 is inserted (as shown by arrow 224) and secured within opening 216, as shown in FIGS. 2G-1 to 2G-3.

Figures 1, 2F:
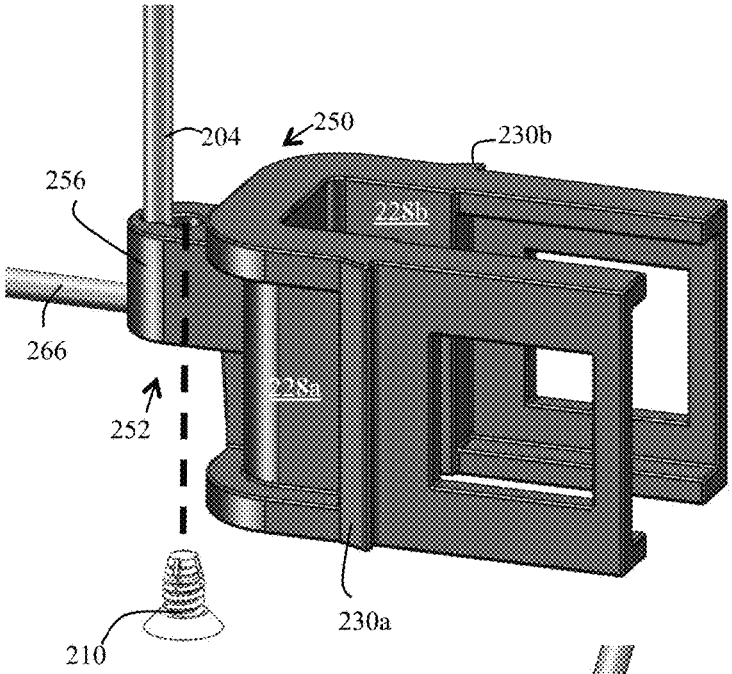
Figures 2, 2F:
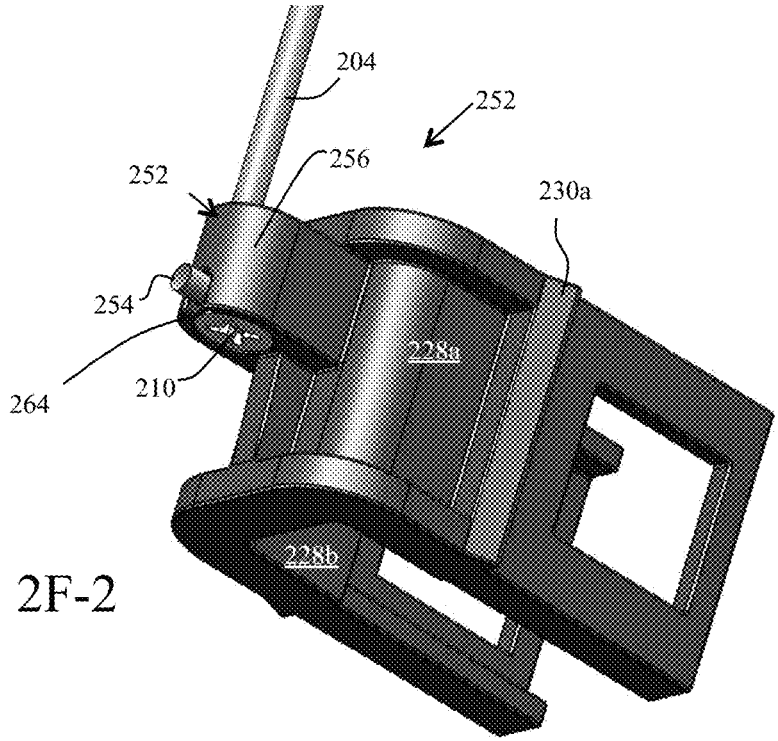
Figures 1, 2G:
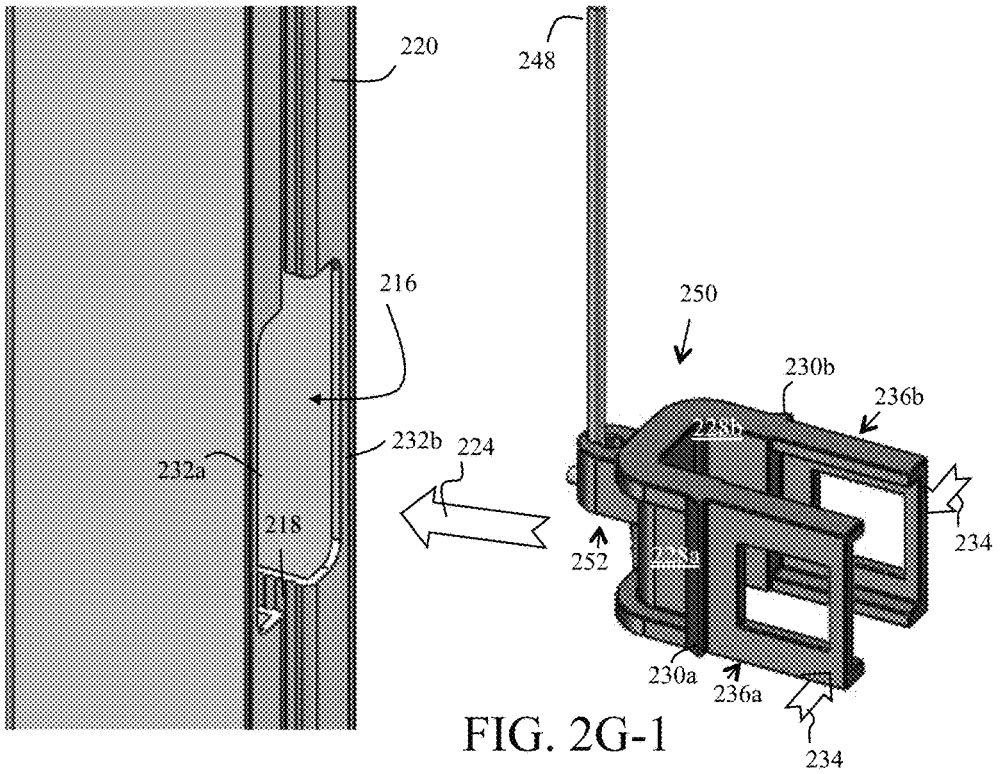
Figures 2, 2G:
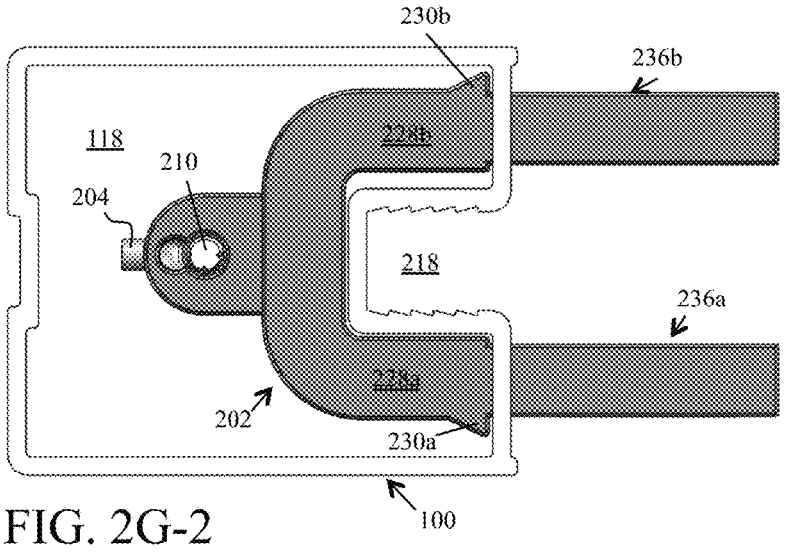
Figures 2, 2G, 3:
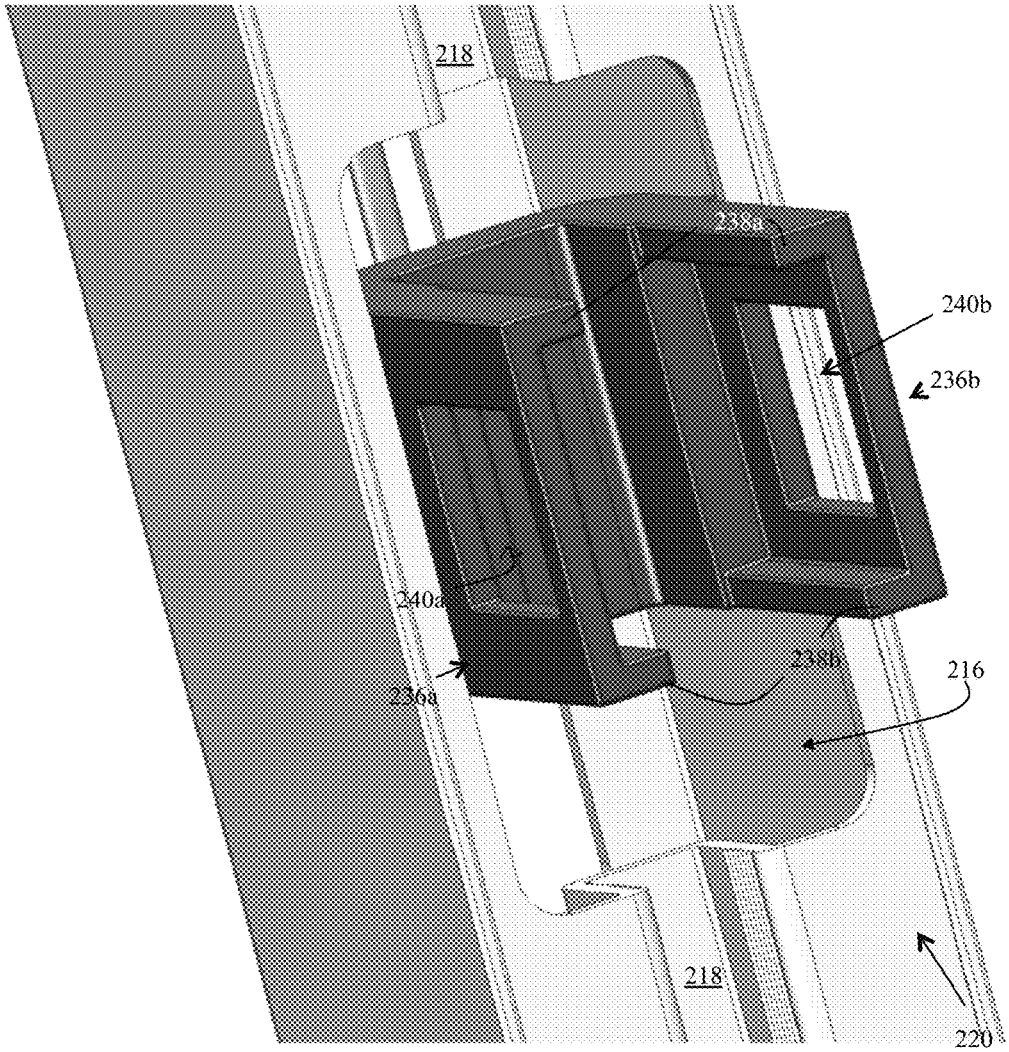
Figure 3A:
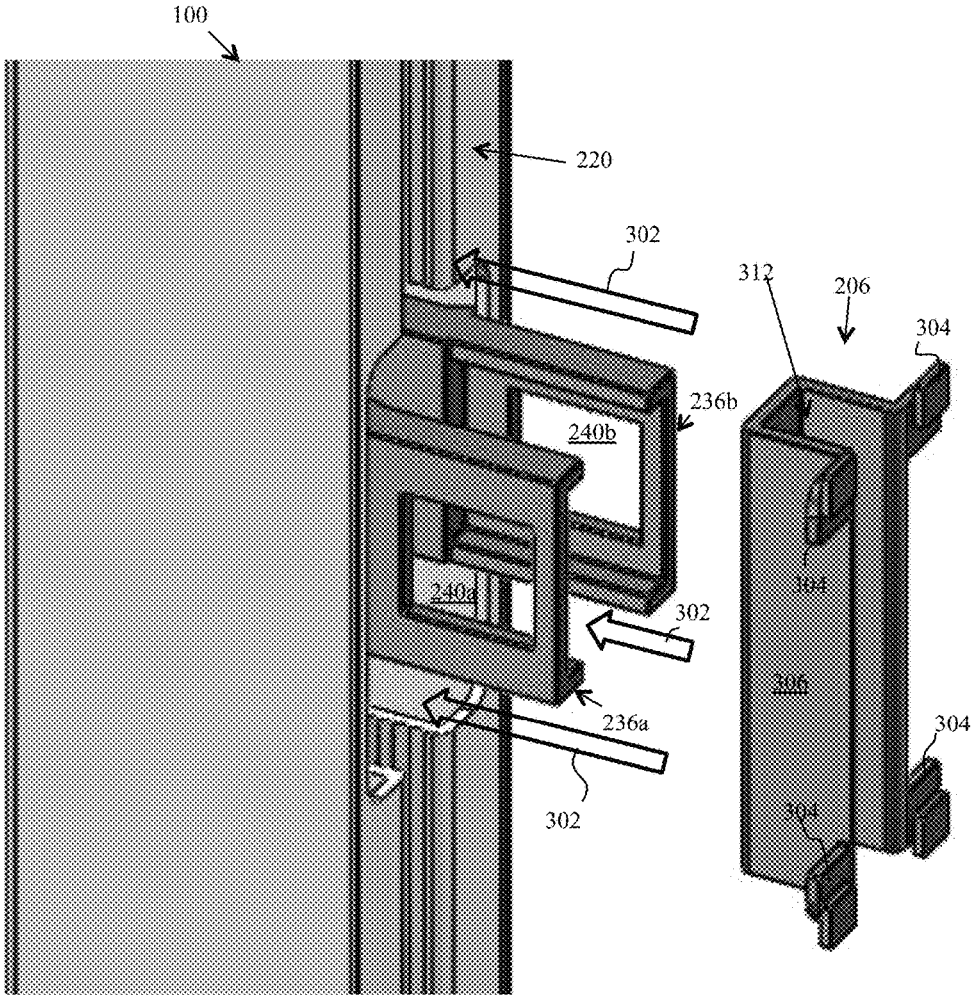
Figures 1, 3B:
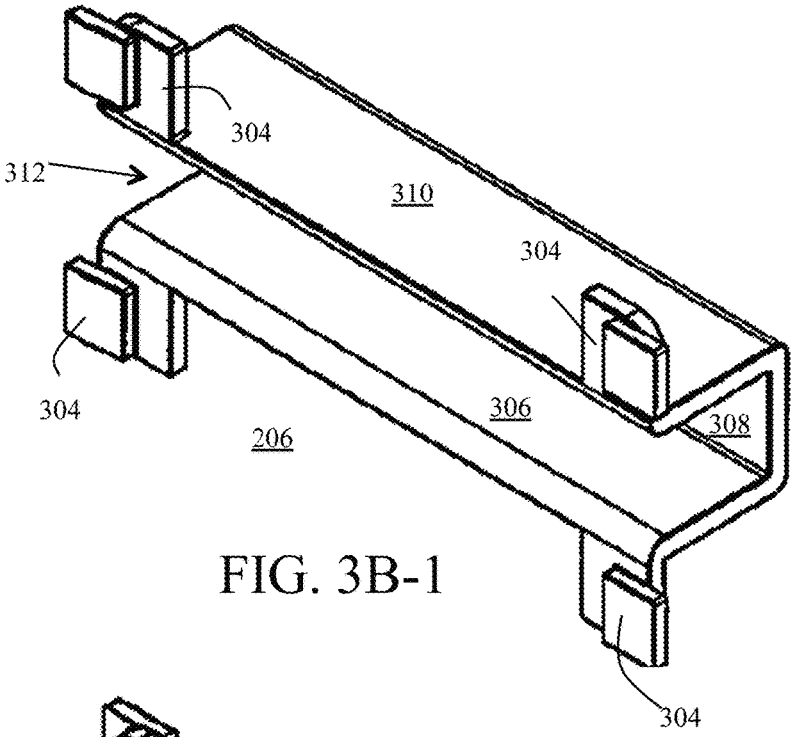
Figures 2, 3B:
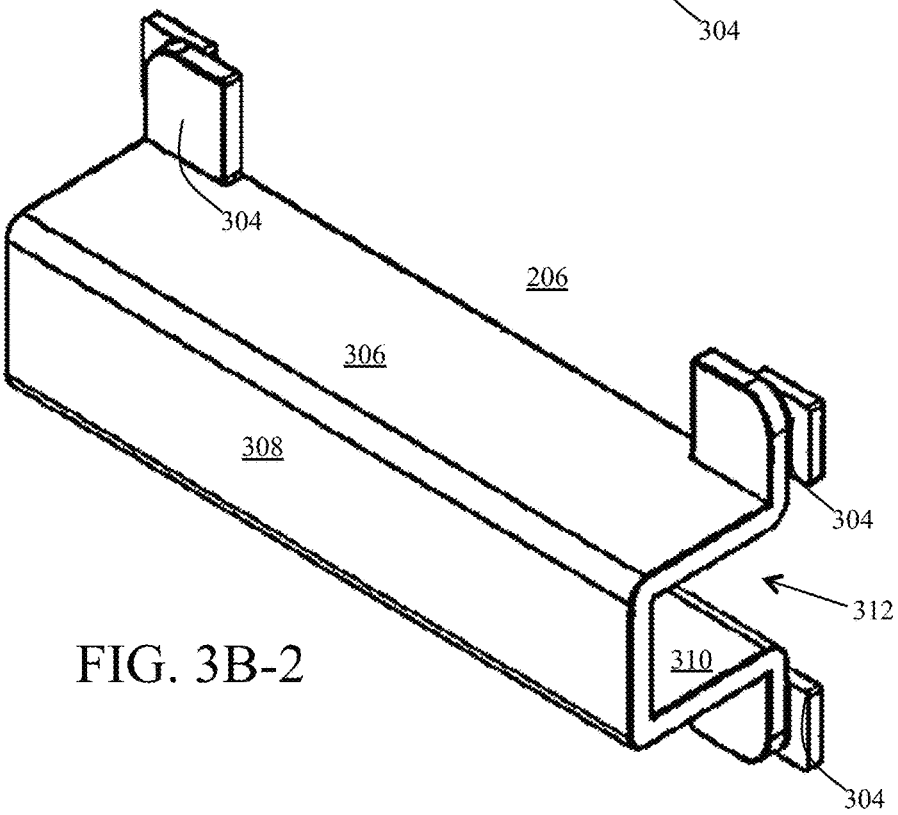
Figures 1, 3C:
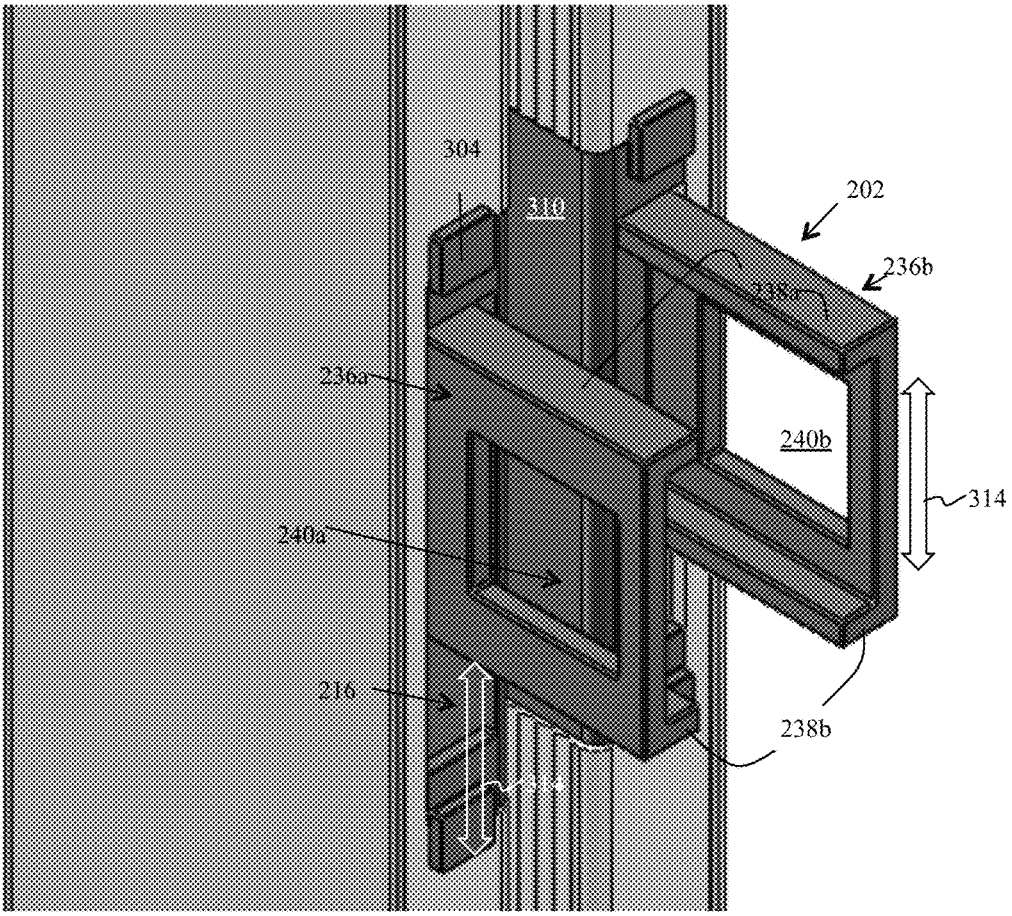
Figures 2, 3C:
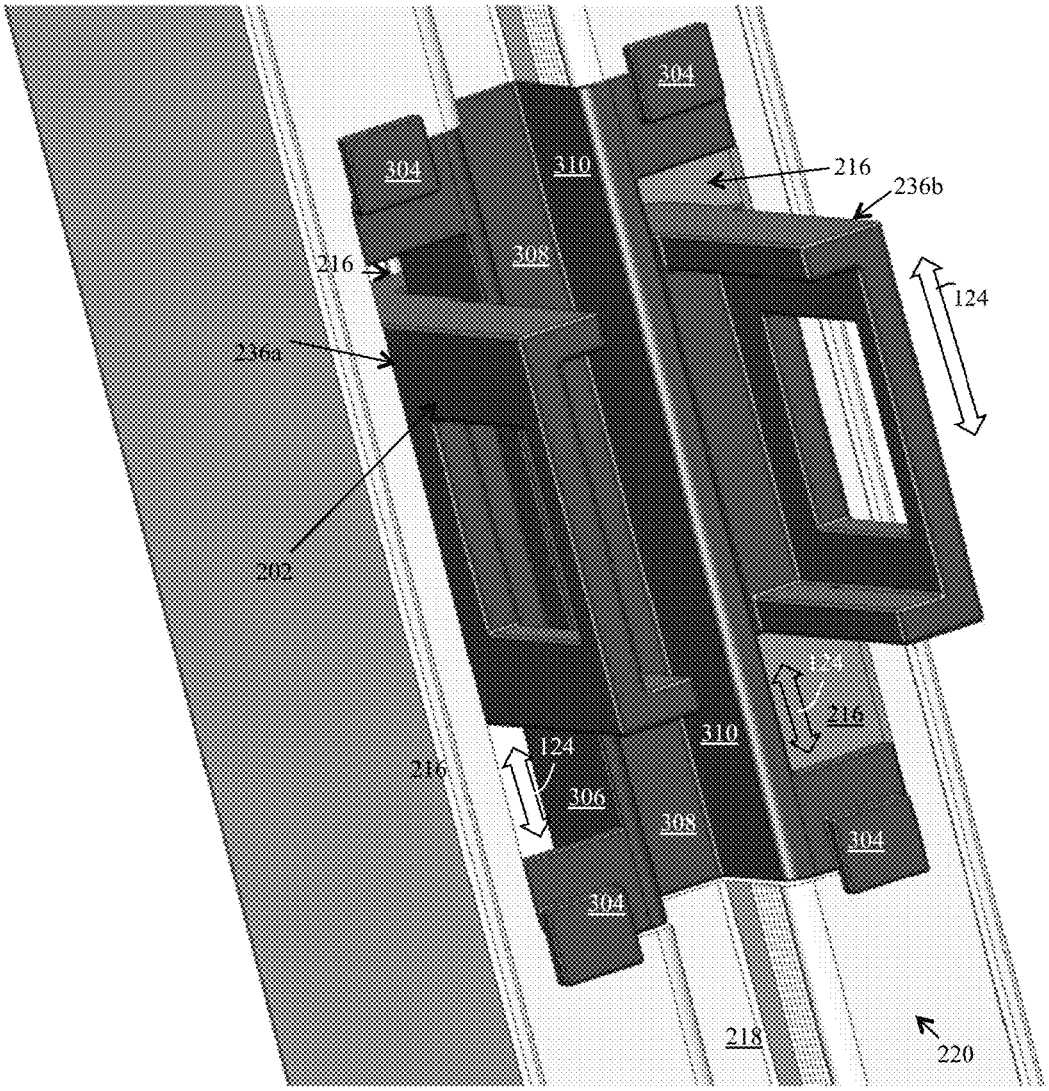

Chassis 202 includes a pair of locking shoulders 228*a* and 228*b* that may be compressed as indicated by arrows 234 (FIG. 2G-1) to enable chassis 202 to "snap" fit within opening 216 of interior 118 of the extrusions 100. When inserted within opening 216 of extrusion 100, a respective pair of locking tabs or flanges 230*a* and 230*b* of the locking shoulders 228*a/b* slide over interior side 232*a* and 232*b* of opening 216 and engage the respective interior sides 232*a* and 232*b* of opening 216 to secure chassis 202 within extrusion 100. Chassis 202 further includes mounting extension portions or arms 236*a* and 236*b* that extend out of opening 216 for mounting of latch actuator handle assembly 208. As best illustrated in FIG. 2G-3, mounting extensions 236*a/b* have a bracket shaped profile (e.g., "[ ]") with a top and bottom flange 238*a* and 238*b* configured to received and accommodate latch actuator handle assembly 208. Mounting extension 236*a/b* further include lateral openings 240*a/b* configured to receive and interlock a cover plate 244 of latch actuator handle assembly 208.

Chassis 202 includes a first chassis side 250 associated with a first end 254 of an actuator shaft 204 for transmission of motion of remote latch actuator 112 to remote latch assembly 114, which, in turn, is associated with second end 248 of actuator shaft 204. Actuator shaft 204 is an elongated coupler, a non-limiting example of which may include monofilament line, or other cable lines or wires, etc. so long as they provide adjustability (e.g., can be trimmed to desired length) and provide longevity and reliable connection between remote latch actuator 112 and remote latch assembly 114.

First chassis side 250 includes a holding structure 252 to receive and secure a first end 254 of actuator shaft 204, with holding structure 252 defined by a protuberance 256 that is bulged out of first chassis side 250 and includes a primary hole 258 for insertion (or feeding) of first end 254 of actuator shaft 204. Primary hole 258 is optionally opened into a secondary, wider hole 260 (forming an opening 262 with a generally "8" silhouette configuration) for receiving a fastener 210 that frictionally maintains first end 254 of actuator shaft 204 within "8" configured opening 262 of holding structure 252 (best shown in FIG. 2C). As further illustrated, holding structure 252 includes a slot 264 that receives and secures excess length of actuator shaft 204, enabling installers to trim the excess portion 266 to form first end 254 of actuator shaft 204. Accordingly, as illustrated in FIGS. 2F-1 and 2F-2, actuator shaft 204 is first inserted through opening 262, with excess distal end 266 (FIG. 2F-1) thereof rested within slot 264. Thereafter, fastener 210 is fastened within opening 260 to frictionally maintain excess portion 266 of actuator shaft 204, where it is then trimmed to form first end 254 as shown in FIG. 2F-2. Thereafter, the assembled chassis 202 and actuator shaft 204 are inserted within opening 216 as shown in FIGS. 2G-1 and 2G-2. That is, actuator shaft 204 is first inserted into interior 118 of extrusion 100 and fed towards top end thereof until second end 248 is moved out of top portion of extrusion 100. As indicated above, chassis 202 includes a pair of locking shoulders 228*a* and 228*b* that may be compressed as indicated by arrows 234 (FIG. 2G-1) to enable chassis 202 to "snap" fit within opening 216 of interior 118 of the extrusions 100 (FIGS. 2G-2 and 2G-3).

It should be noted that holding structure 252 (and the amount from which it protrudes or extends away from first chassis side 250) may be varied but is preferably at a span where primary hole 258 is vertical aligned directly underneath and inline with remote latch assembly 114. This arrangement maintains a linear cooperative and working relationship between remote latch actuator 112 and remote latch assembly 114. Accordingly, the position of primary hole 258 in relation to remote latch assembly 114 is to orient actuator shaft 204 vertically underneath remote latch assembly 114 and further, substantially parallel a longitudinal axis of extrusion 100. However, given the flexibility of the monofilament line (if used), the disclosed vertical alignment between primary hole 258 and remote latch assembly 114 is not mandatory, but is preferred.

As a further note, holding structure 252 itself is provided at first chassis side 250 in order to maintain the structural integrity of first chassis side 250 in terms of strength. Therefore, it is possible to move primary and secondary holes 258 and 260 of holding structure 252 within first chassis side 250, but that may weaken the overall structure of chassis 202. It should further be noted that the length of actuator shaft 204 might vary greatly commensurate with the desired distance needed between remote latch actuator 112 and remote latch assembly 114. Chassis 202 is configured as a "U" or a "C" for receiving linear-guide 206 (detailed below).

FIGS. 3A to 3C-2 are non-limiting, exemplary illustrations, detailing a linear-guide and also illustrate a non-limiting, exemplary method of assembly thereof in accordance with one or more embodiments of the present invention. As illustrated, as part of remote latch actuator 112, linear-guide or guide 206 functions like a "bearing" in relation to chassis 202, enabling chassis 202 to glide on guide 206. Linear-guide 206 is inserted into the opening 216, oriented between extensions 236*a/b* of chassis 202 as shown by arrows 302 (FIG. 3A), with anchors 304 securing linear-guide 206 within opening 216 of extrusion 100. This assembly enables chassis 202 to glide over linear-guide 206, with the movement commensurate with orientation of guide 206, which in this non-limiting, exemplary instance, is a vertical motion, parallel the longitudinal axial length of extrusion 100. In other words, linear-guide 206 enables linear movement of chassis 202 and all other components associated therewith at a linear orientation (motion) 124 so to prevent wobbling of chassis 202. Linear-guide 206 further has three sides 306, 308, and 310 that form a cavity or groove 312 that receives or accommodates frame/glass portion 110 of enclosure 102, with three sides 306, 308, and 310 being linear for allowing chassis 202 to smoothly glide along reciprocating path 124 to actuate remote latch assembly 114 (by the connected actuator shaft 204).

FIGS. 4A to 4K-2 are non-limiting, exemplary illustrations, detailing latch actuator handle assembly and progressively illustrating a non-limiting, exemplary method of assembly thereof in accordance with one or more embodiments of the present invention. As illustrated, latch actuator handle assembly 208 are comprised of an interior facing latch actuator handle assembly 208*a* that faces the interior of the enclosed area or space enclosed by the enclosure 102, and an exterior facing latch actuator handle assembly 208*b*, which faces the exterior of the enclosed area or space that is enclosed by enclosure 102. In general, interior facing latch actuator handle assembly 208*a* includes the privacy latch 214 to prevent access to the interior of an area divided or enclosed by enclosure 102. Latch actuator handle assembly 208 (interior 208*a* or exterior 208*b*) includes respective frames 242*a/b* and covers 244*a/b* that when assembled, form latch actuator handle assembly 208.

FIG. 4A to 4E are non-limiting, exemplary illustrations, detailing exterior facing latch actuator handle assembly 208*b* and progressively illustrating a non-limiting, exemplary method of assembly thereof in accordance with one or more embodiment of the present invention, and FIGS. 4F to 4K-2 are non-limiting, exemplary illustrations, detailing interior facing latch actuator handle assembly 208*a* and progressively illustrating a non-limiting, exemplary method of assembly thereof in accordance with one or more embodiment of the present invention. The exemplary illustrations shown would form the arrangement shown in FIG. 2A. As illustrated, exterior and interior latch actuator handle assembly 208*b* and 208*a* are mounted onto extension portions or arms 236*a* and 236*b* of chassis 202 that extend out of opening 216. Mounting extensions 236*a* and 236*b* are configured to received and accommodate frames 242*b* and 242*a* of respective exterior and interior latch actuator handle assembly 208*b* and 208*a* to form arrangement of FIG. 2A. Mounting extension 236*a* and 236*b* further include lateral openings 240*a* and 240*b* configured to receive and interlock a set of prongs 246 of a cover plates 244*b* and 244*a* of respective exterior and interior latch actuator handle assembly 208*b* and 208*a* with cover prongs 246 interlocking with both mounting extension 236*a/b* and the frame 242*a/b*.

Figure 4A:
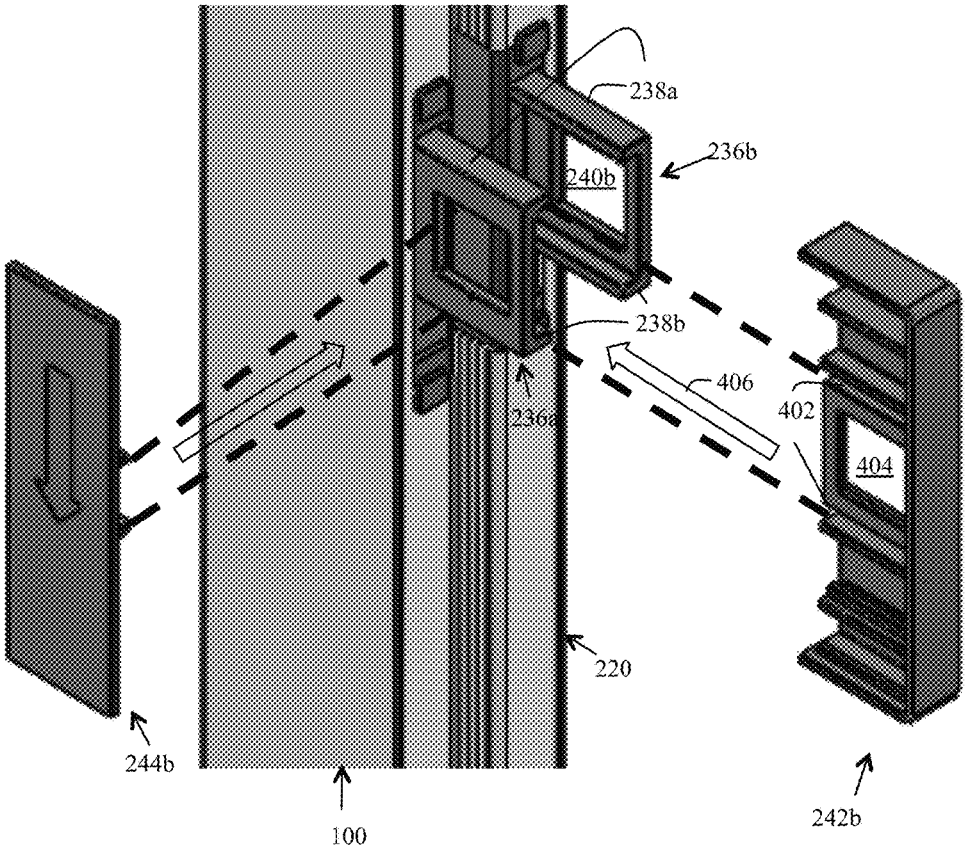
Figure 4B:
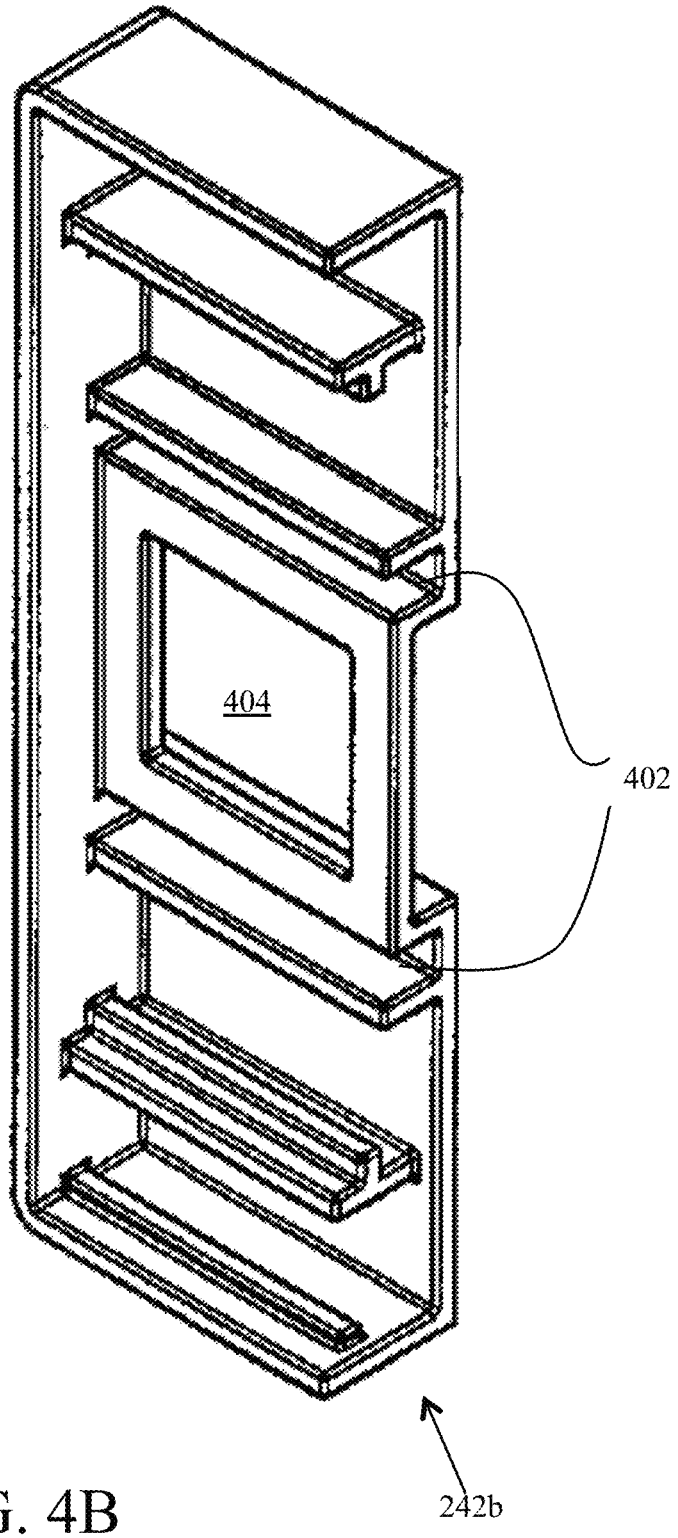
Figure 4C:
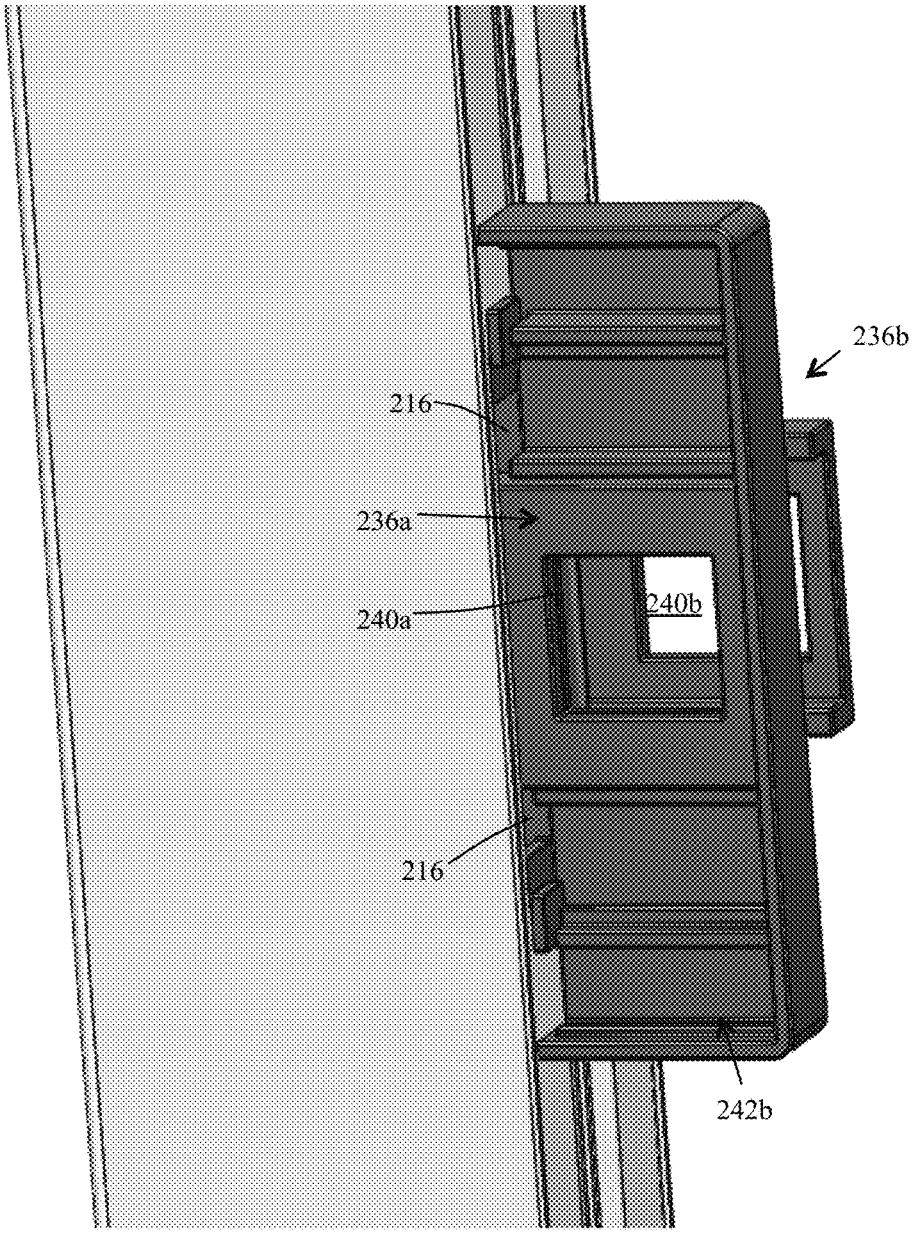
Figure 4D:
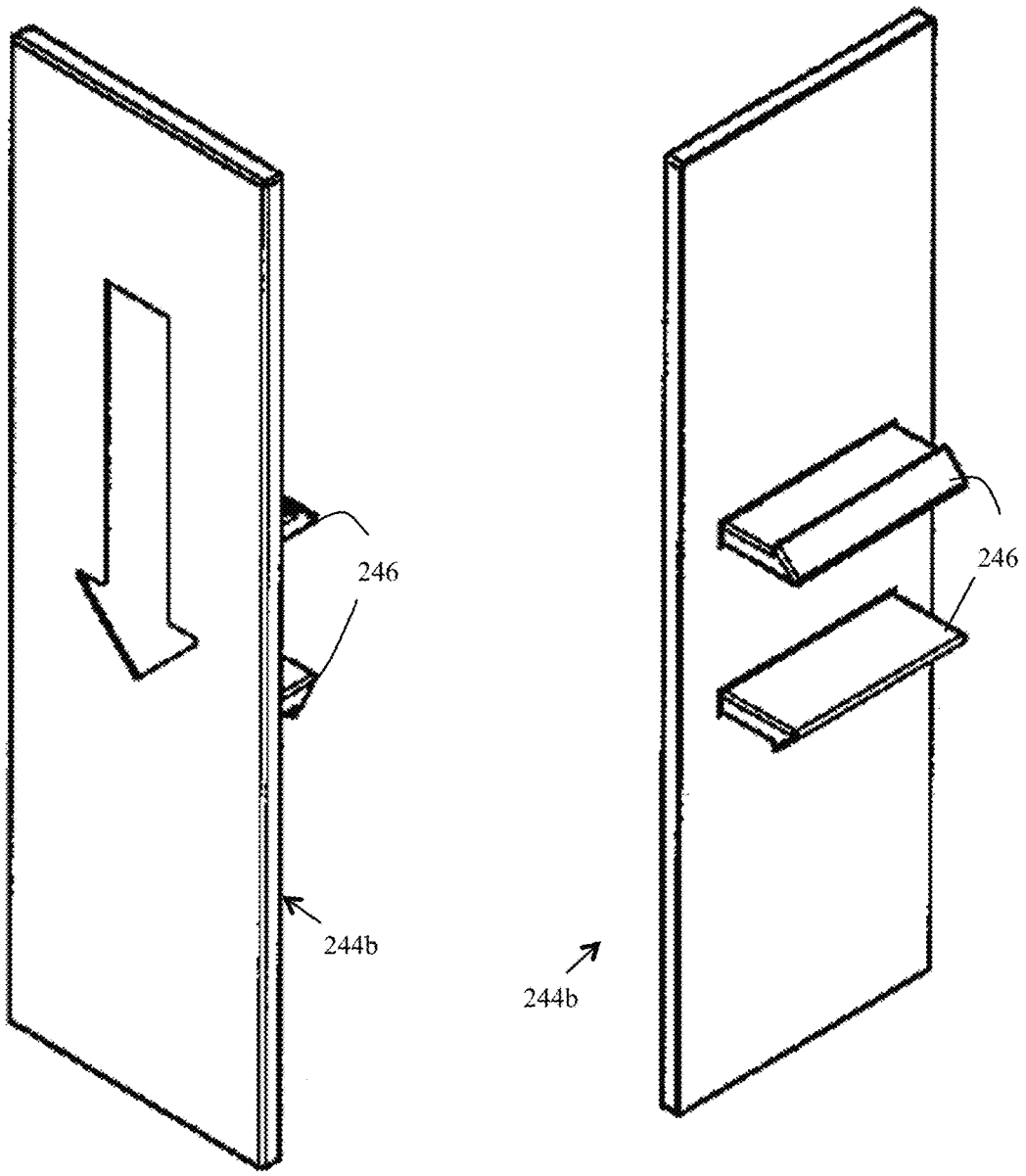
Figure 4E:
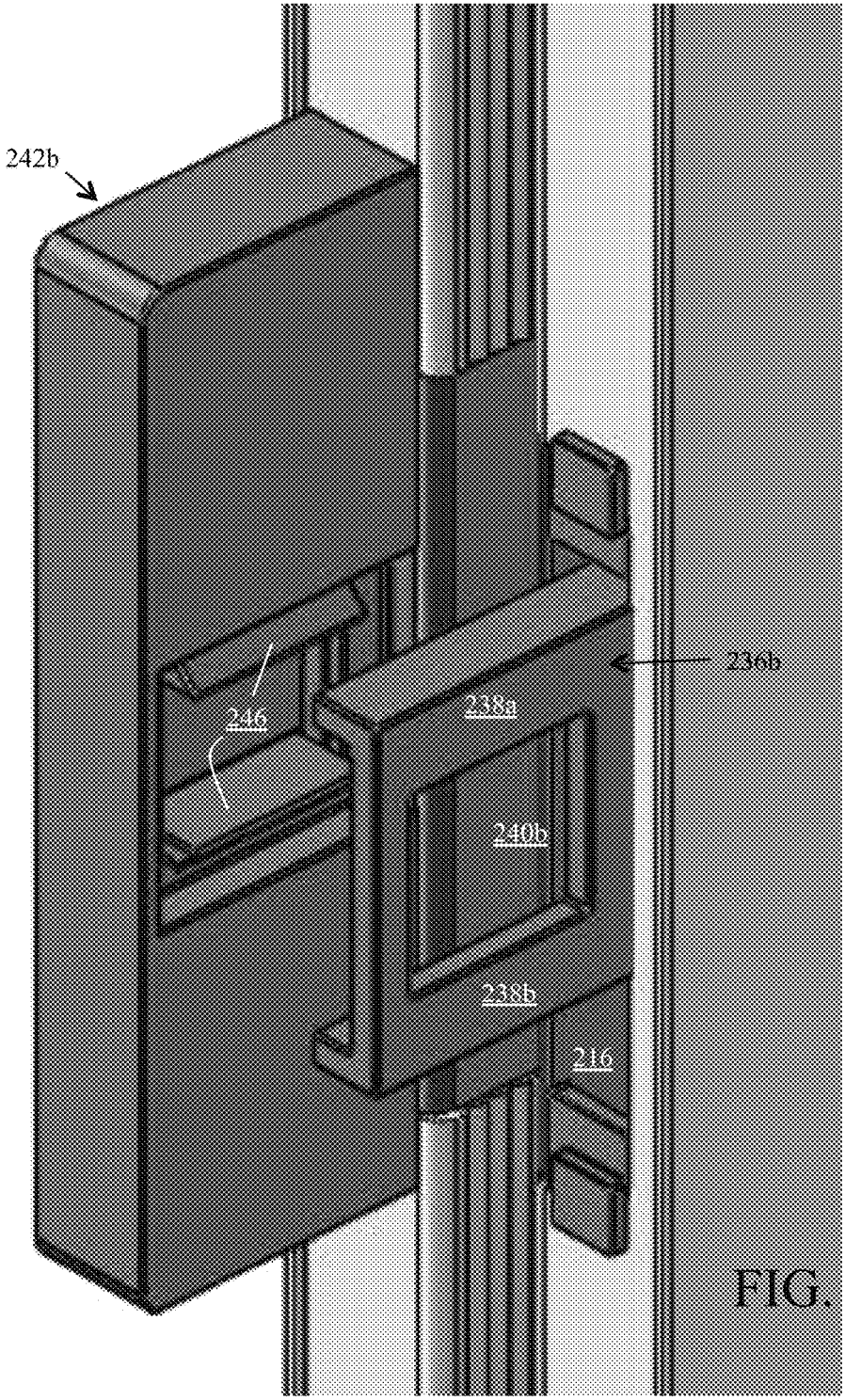
Figure 4F:
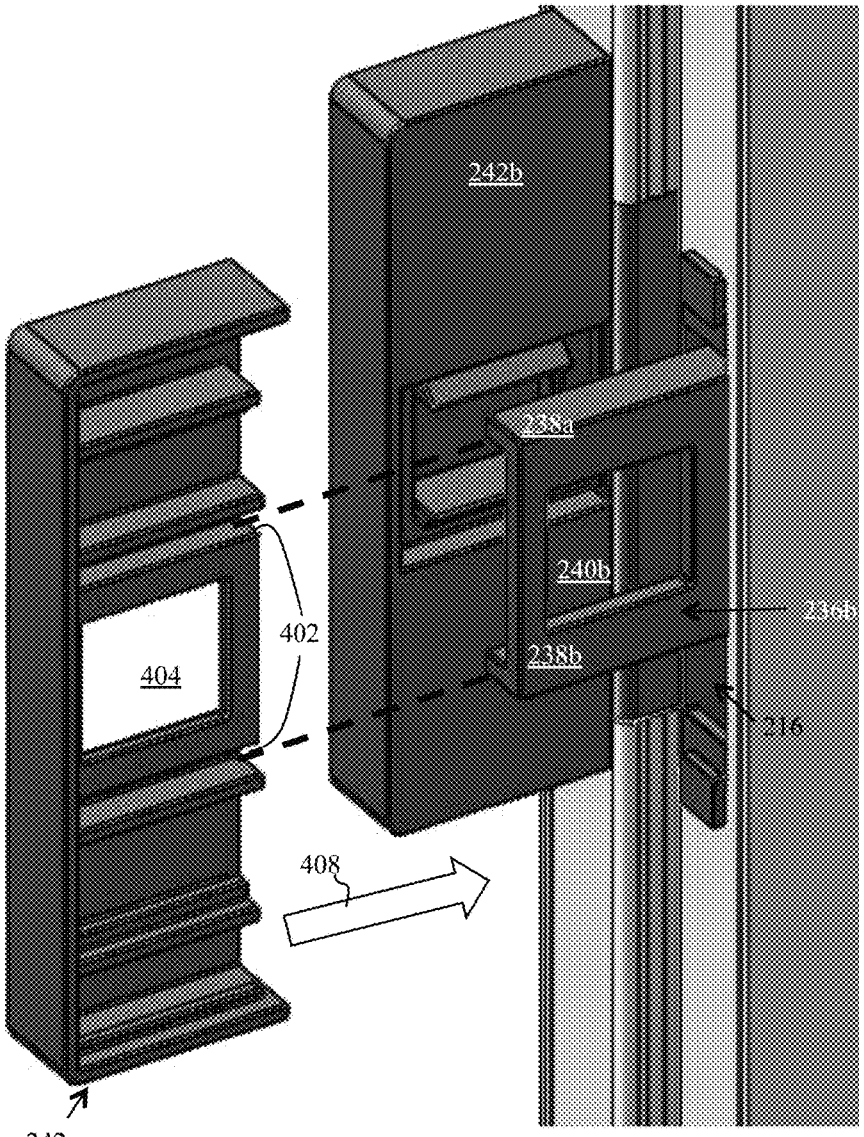
Figure 4G:
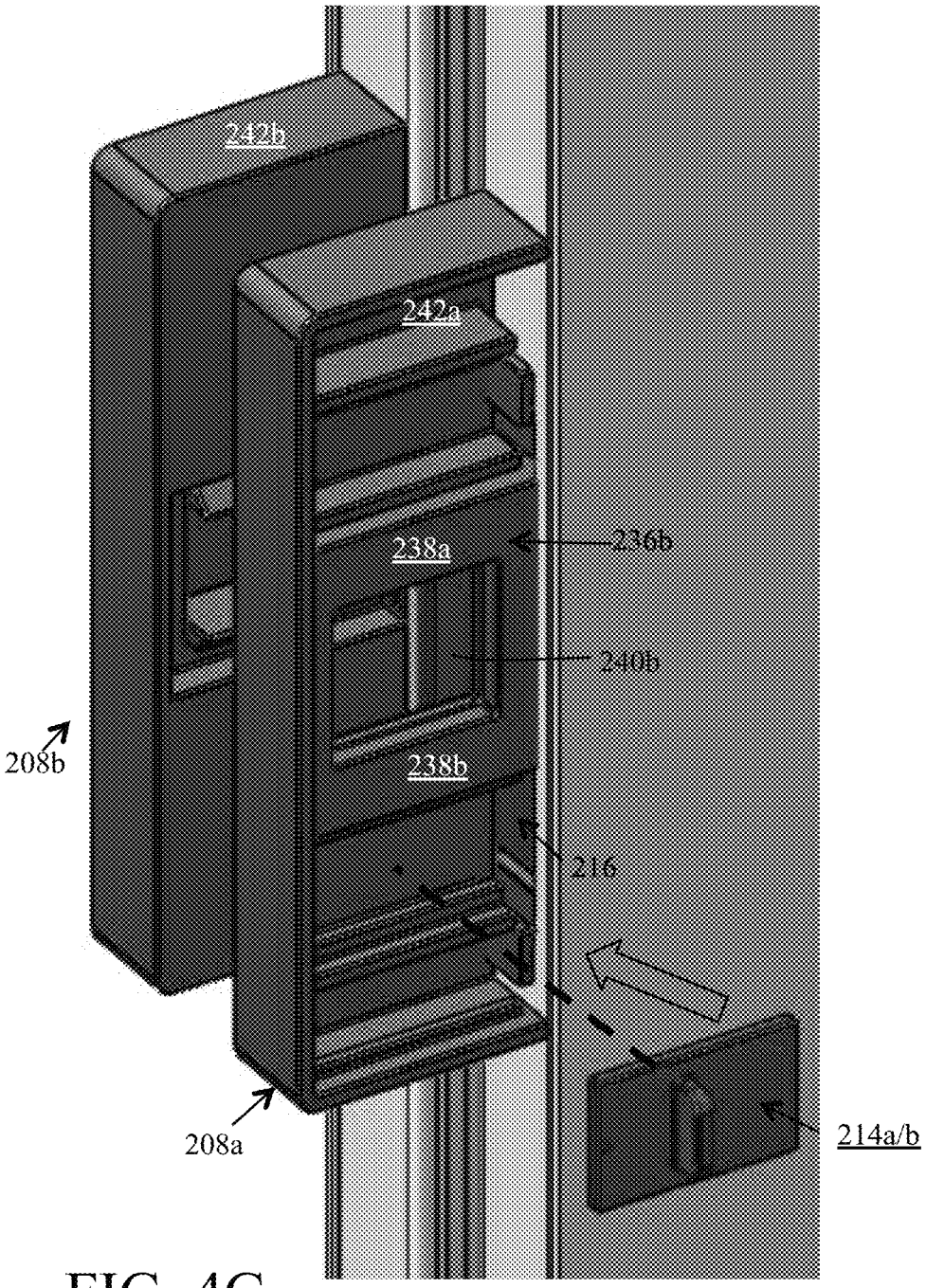

More specifically, frames 242*a/b* include mounting grooves 402 that receive and slides over upper and lower brackets 238*a/b* of respective extensions 236*a/b* as shown by arrow 406 in FIG. 4A and arrow 408 shown in FIG. 4F. The frames 242*a/b* also include opening 404 that when mounted onto extensions 236*a/b*, openings 404 align with respective openings 240*a/b* of chassis 202 on respective extensions 236*a/b* to accommodate cover prongs 246 of covers 244*a/b*, which interlock (e.g., snap) with both mounting extension 236*a/b* and frame 242*a/b*. It should be noted and as illustrated in FIGS. 4E to 4G, installing of frame 242*a* is similar to that of frame 242*b* after which, a privacy latch 214 is installed (FIG. 4G). FIGS. 4K-1 and 4K-2 are non-limiting, exemplary illustrations of cover 244*a* that is similar to cover 244*b*, but with an opening 410 to accommodate privacy latch 214*a/b*. Once a privacy latch 214 is mounted, cover 244*a* (FIGS. 4K-1 and 4K-2) is installed in similar manner to that of cover 244*b* disclosed above.

As further illustrated in FIGS. 4G to 4K-2, interior latch actuator handle assembly 208*a* accommodates privacy latch 214, which functions to prevent enclosure 102 from being unlatched. It should be noted that as stated above, privacy latch 214 and interior/exterior handle assembly 208*a/b* are reversible, which may be installed and mounted onto either the "interior" or "exterior" facing sides of the door 102. In other words, handle assembly 208*a/b* and privacy latch 214 may be mounted so that enclosure 102 is latched from outside of an enclosed area or from inside of an enclosure area.

Figures 1, 4H:
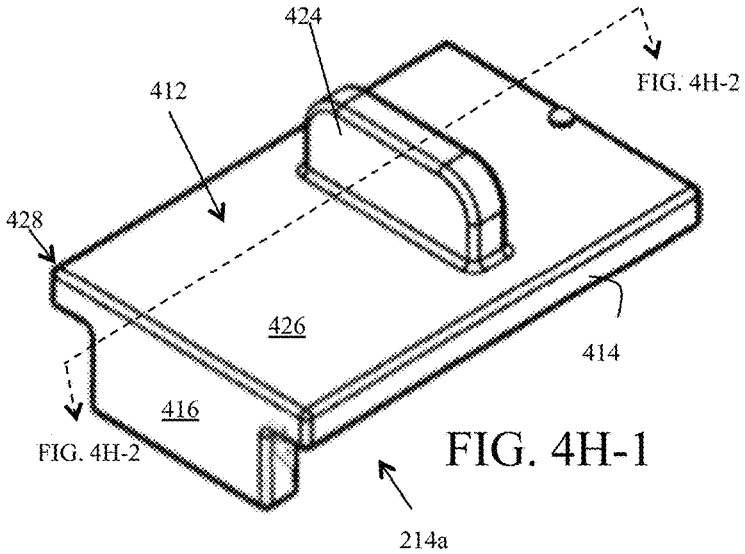
Figures 2, 4H:
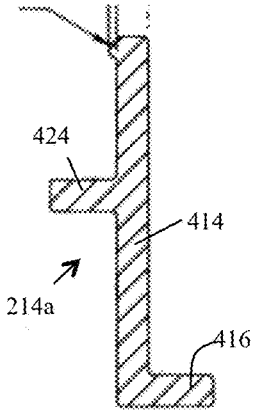
Figures 3, 4H:
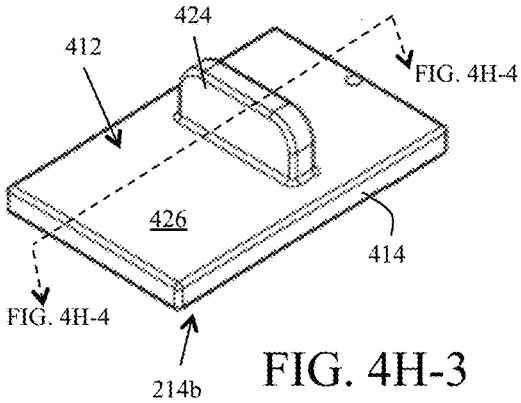
Figures 4, 4H:
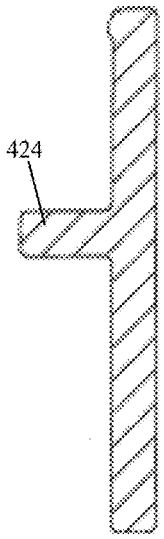
Figure 4I:
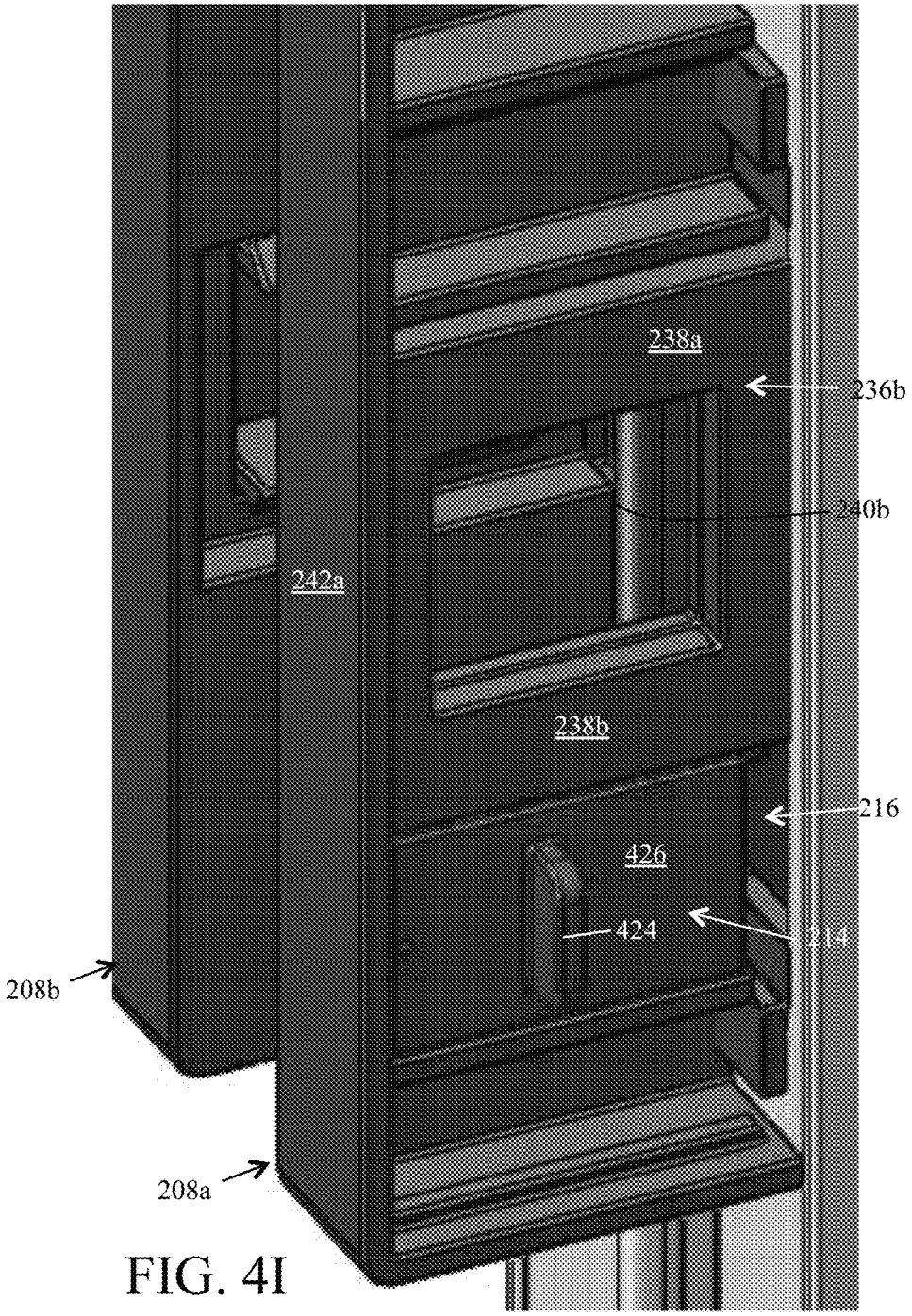
Figure 4J:
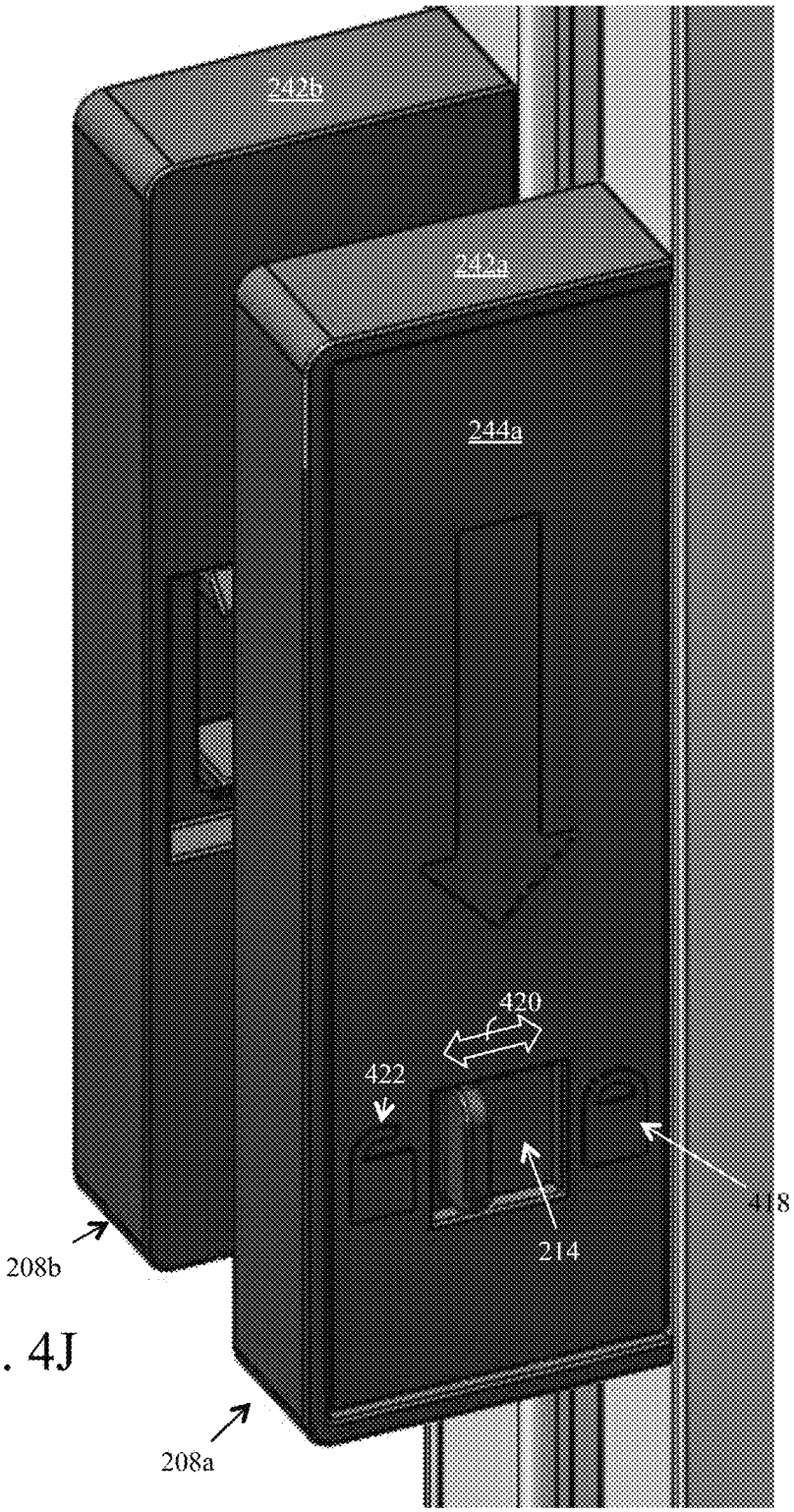
Figures 1, 4K:
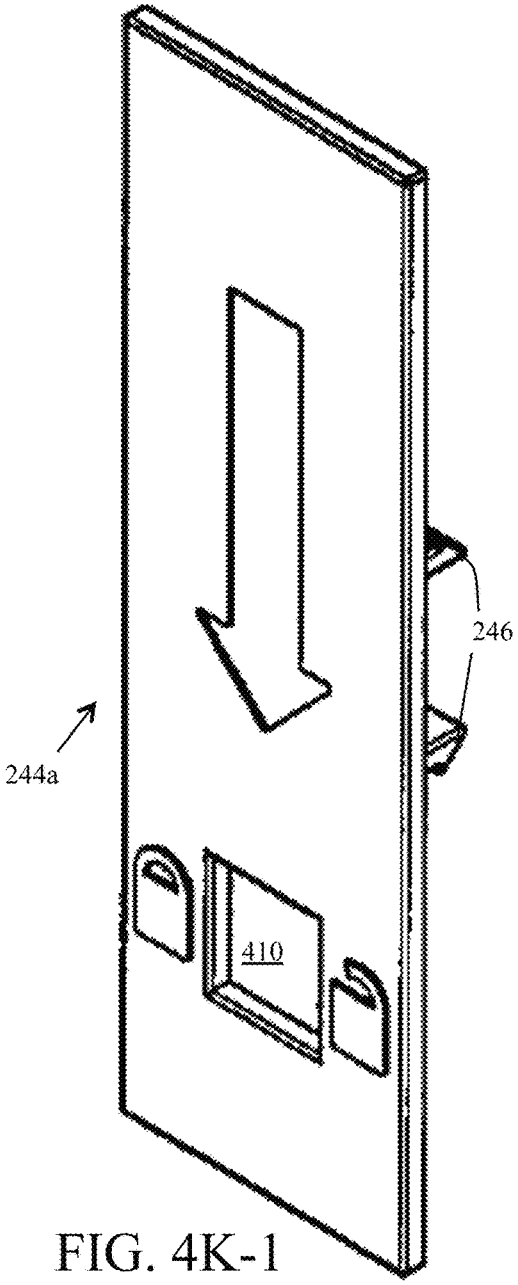
Figures 2, 4K:
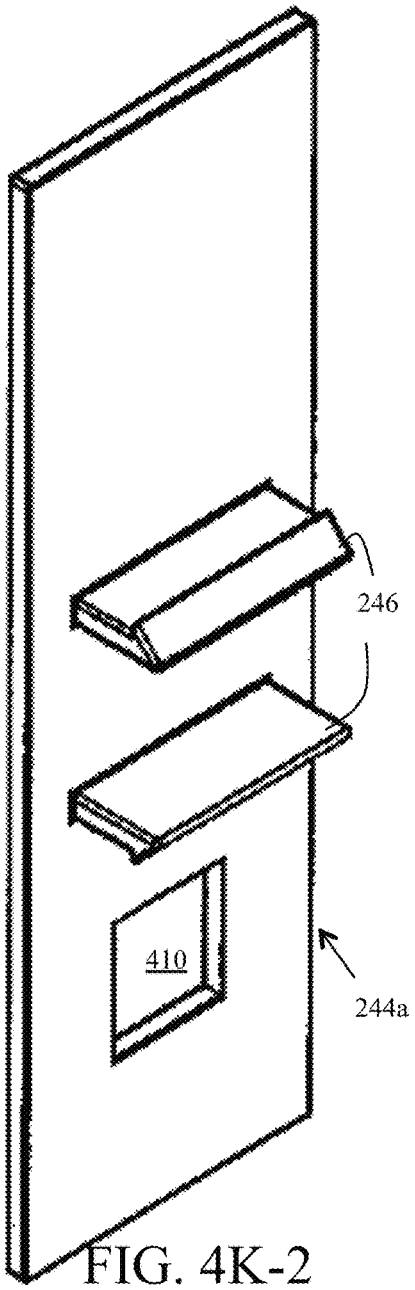

FIGS. 4H-1 to 4H-4 are non-limiting, exemplary illustrations of various views and embodiments that detail a privacy latch in accordance with one or more embodiments of the present invention. FIGS. 4H-1 and 4H-2 illustrate an embodiment of a privacy latch 214*a* that includes a flange 416 for a "forced" unlatching of privacy latch 214*a* from outside an enclosed, latched area (detailed below), whereas FIGS. 4H-3 and 4H-4 illustrate an embodiment of a privacy latch 214*b* without the flange. FIGS. 4H-2 and 4H-4 are respective cross-sectional views along the sectional lines shown in respective FIGS. 4H-1 and 4H-3.

Figures 1, 4L:
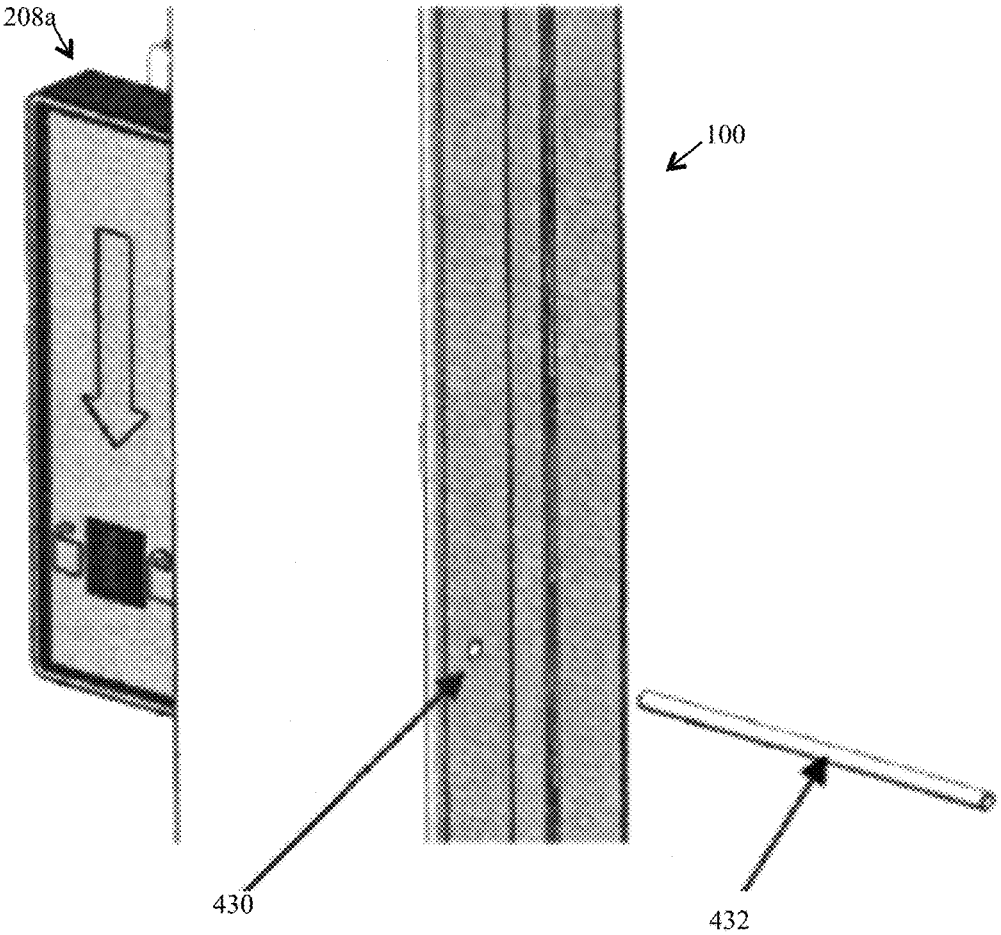
Figures 2, 4L:
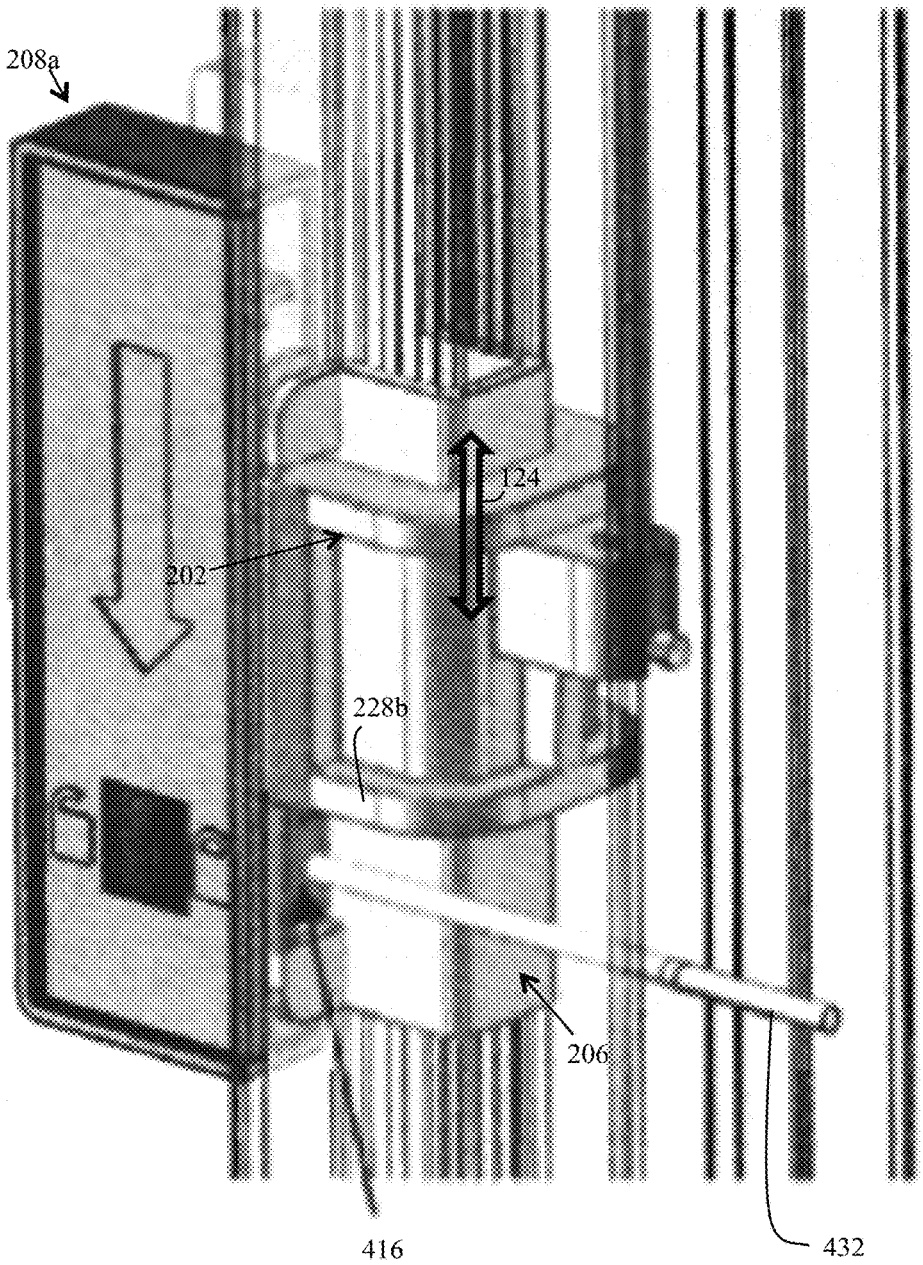
Figures 3, 4L:
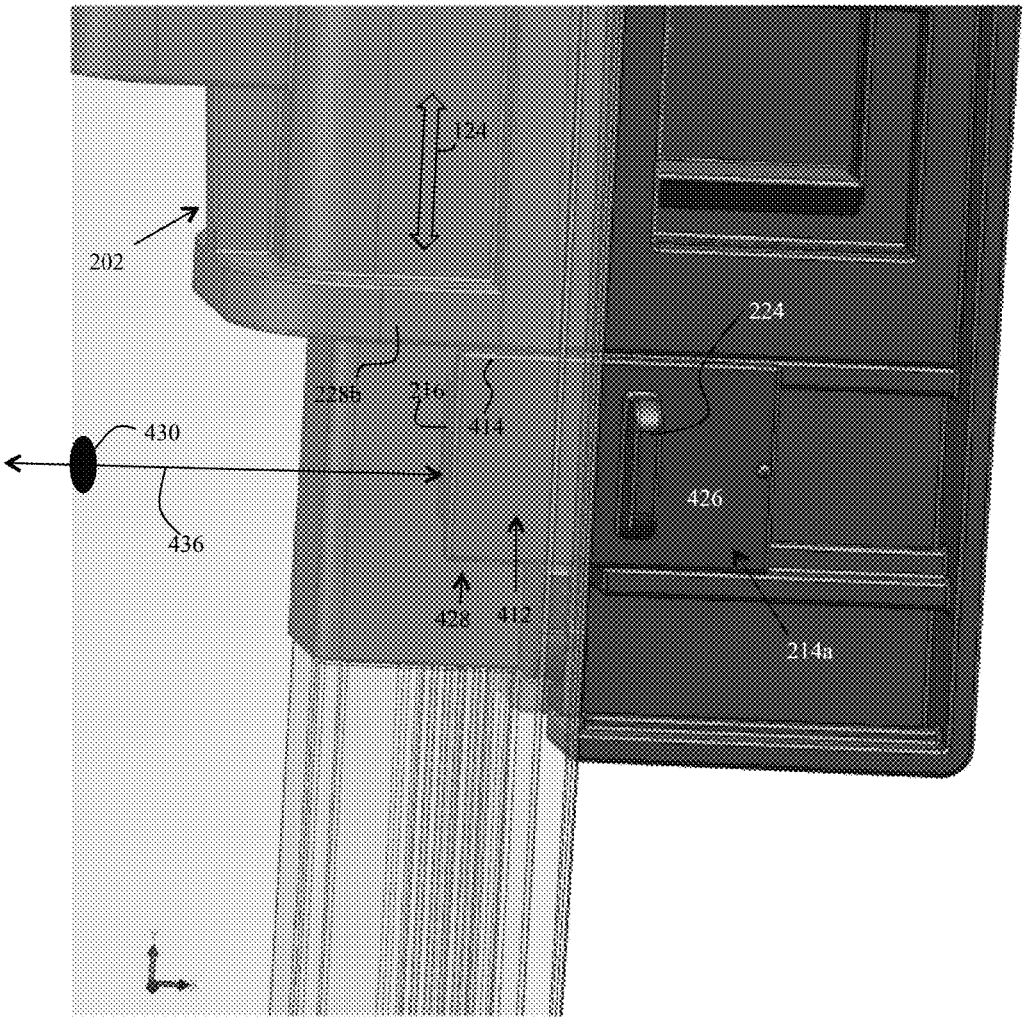
Figures 4, 4L:
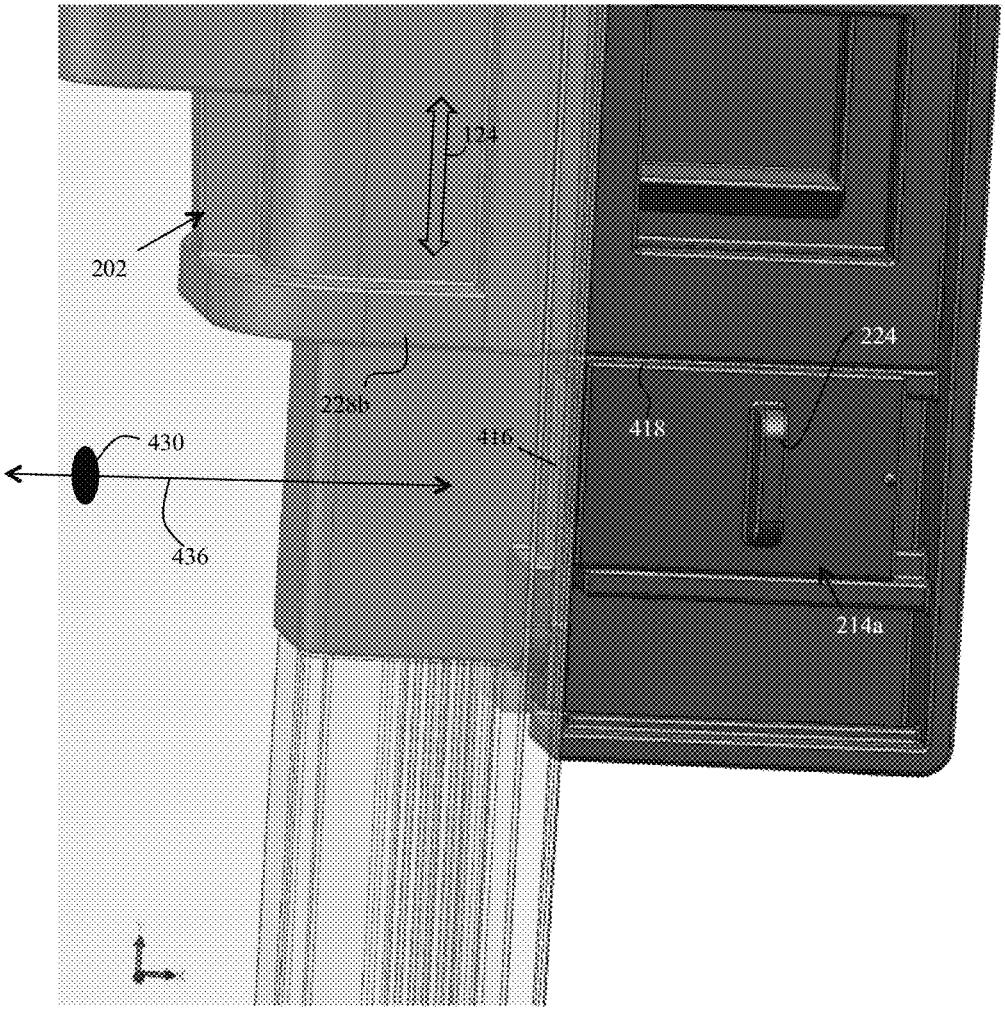

Privacy latch 214*a/b* includes a body 412 that is accommodated within the frame 242*a/b*, with the body 412 in a latching position 418 (FIGS. 2B and 4J) preventing the latch mechanism from moving and when refracted (along reciprocating path as shown by arrow 420) to an unlatch position 422 enables normal motion of the latch mechanism. More specifically and as best illustrated in FIG. 4L-3, lateral edges 414 of the body 412 of privacy latch 214*a/b* engage one of the shoulders 228*a* or 228*b* (depending on "exterior" or "interior" installation) and block the motion of chassis 202 in relation to linear-guide 206 along path 124 and hence, block motion of handle assembly 208 and the entire latch mechanism. Privacy latch 214*a/b* further includes a handle or grip portion 424 that is protruded from a surface 426 of the body 412 for grasping privacy latch 214*a/b* to move privacy latch 214*a/b* to one of a lock 418 or unlock 422 position. In one embodiment (privacy latch 214*a*), flange 416 protruded from a distal end 428 of surface 426 of body 412, in an orientation opposite a direction of handle 424 is provided to facilitate unlocking a locked privacy latch 214*a* from outside of an enclosed area. As best illustrated in FIGS. 4L-1 to 4L-4, in one embodiment, extrusion 100 may include a drilled hole 430 opposite the orientation of the flange 416, where a pin 432 may be inserted there through drilled hole 430 with the end of pin 432 pushing along arrow 436 shown in FIGS. 4L-3 and 4L-4 against flange 416 to push back privacy latch 214*a* from closed (FIG. 4L-3) to an open (FIG. 4L-4) position.

Figures 1, 5A:
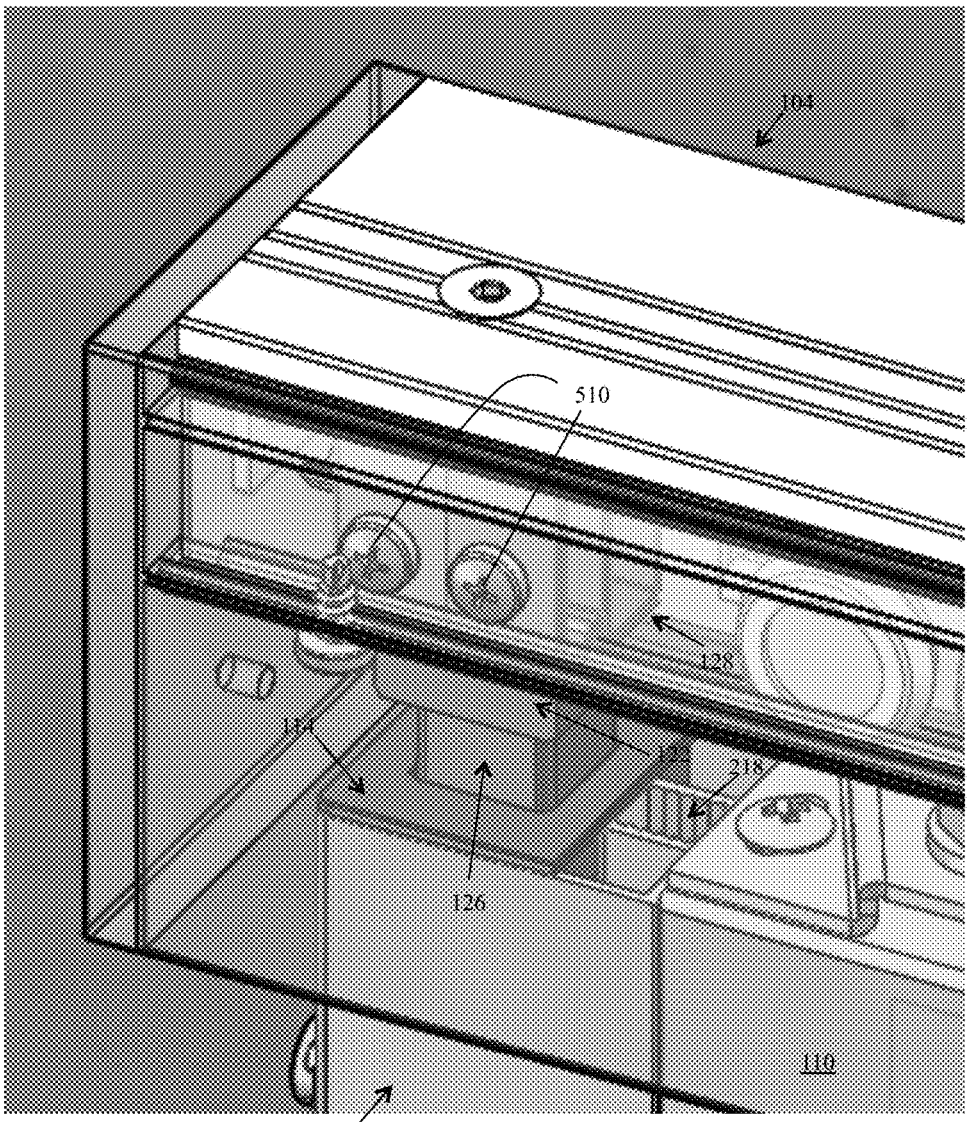
Figures 2, 5A:
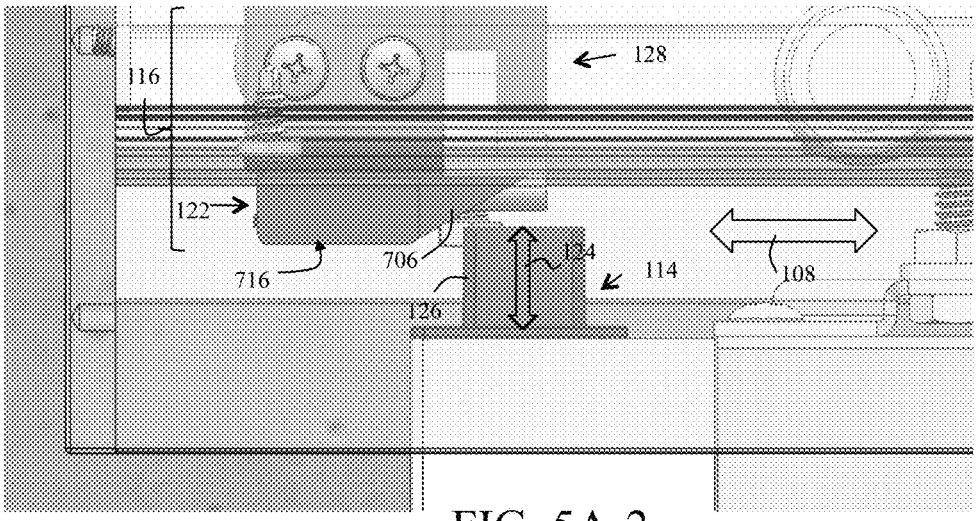
Figures 3, 5A:
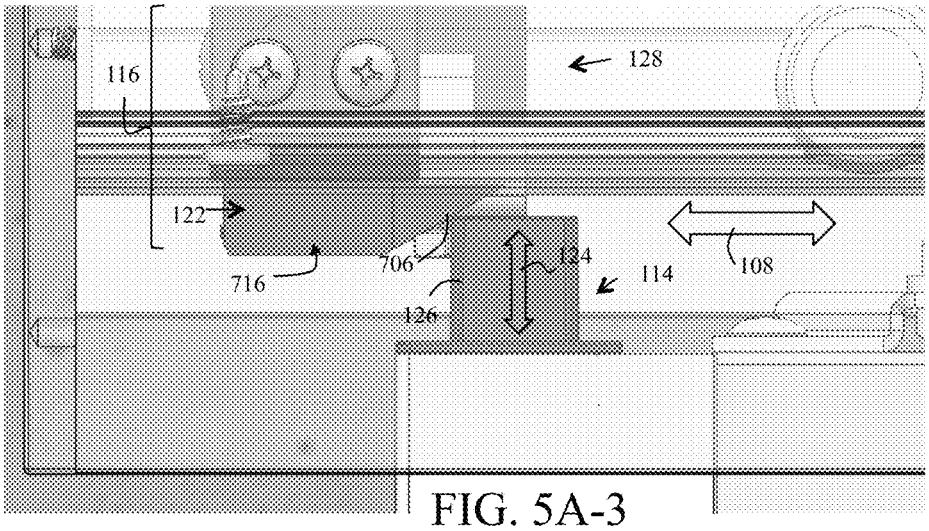
Figures 4, 5A:
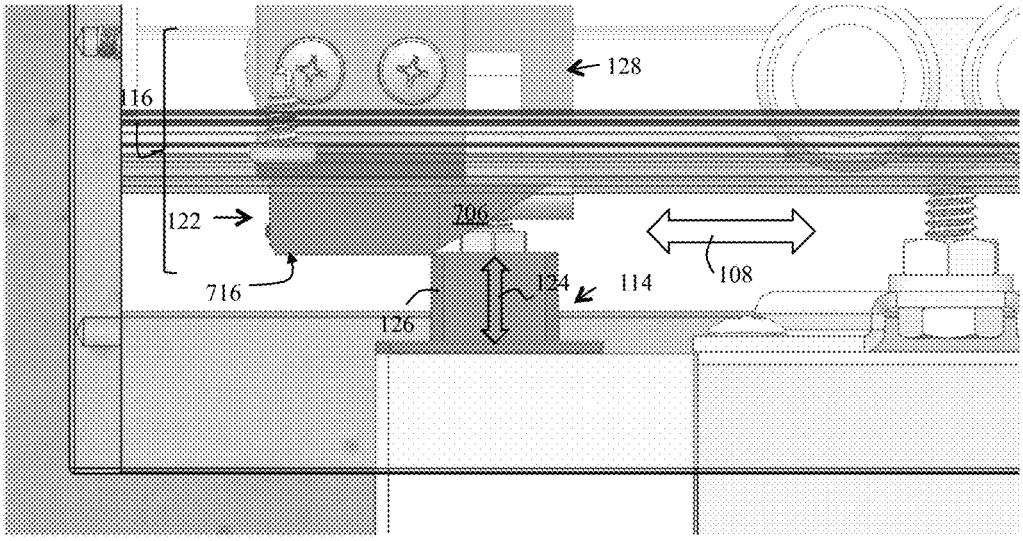
Figures 1, 5B:
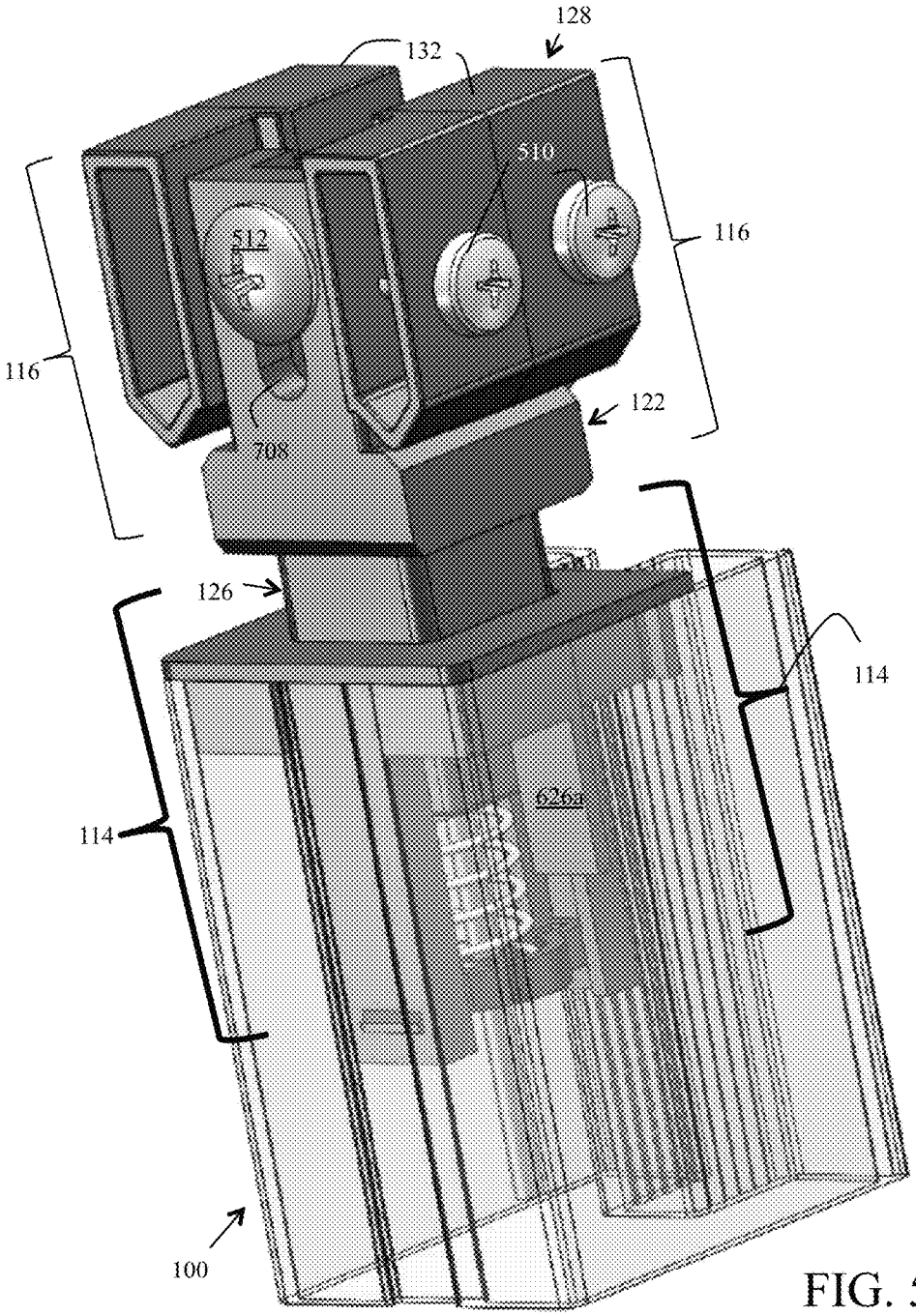
Figures 2, 5B:
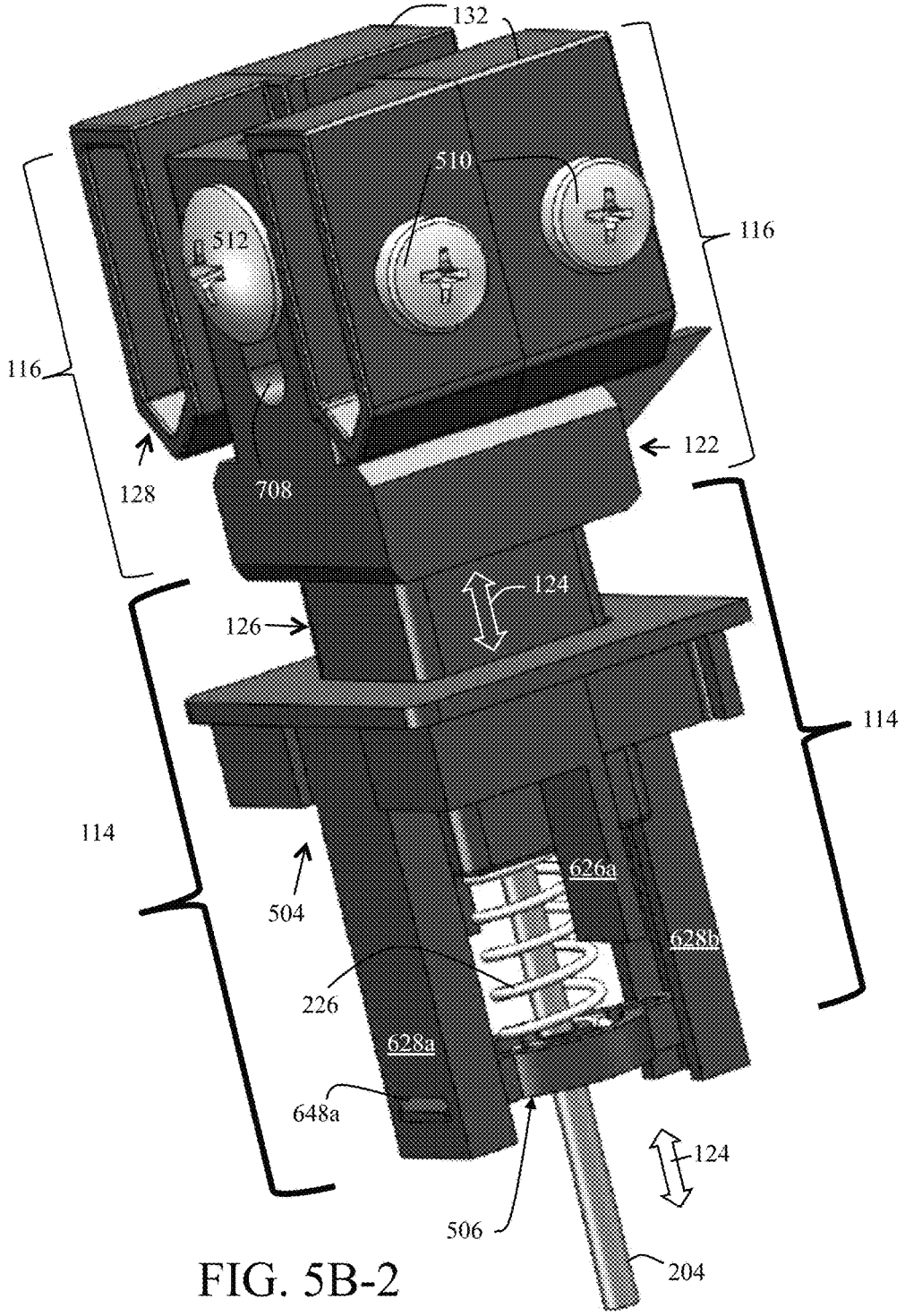

FIGS. 5A-1 to 5B-2 are non-limiting, exemplary overview illustrations of remote latch assembly and keeper assembly in accordance with one or more embodiments of the present invention. In particular, FIGS. 5A-1 to 5A-4 are non-limiting, exemplary overview illustrations that progressively illustrate a latching of remote latch assembly with a keeper assembly in accordance with one or more embodiments of the present invention. FIGS. 5B-1 and 5B-2 are non-limiting, exemplary overview illustrations of remote latch assembly and keeper assembly without the track or railing in accordance with one or more embodiments of the present invention, with FIG. 5B-2 showing the same but without extrusion 100. As best illustrated in FIGS. 5A-1 to 5B-2, as extrusion 100 of door 102 moves along path 108, when remote latch assembly 114 reaches keeper assembly 116, an edge of latch 126 contacts a chamfered-guide portion 706 of keeper 122, with chamfered-guide portion 706 pushing latch 126 down along path 124 (FIG. 5A-4) from its biased extended position (FIGS. 5A-1 and 5A-2) to contracted position (FIGS. 5A-3 and 5A-4). As door 102 moves further along path 108, latch 126 is moved into a relief or cavity 716 (FIGS. 7E-1 and 7E-2) of keeper 122, wherein it is extended back to its default biased, extended position within cavity 716.

Figures 1, 6A:
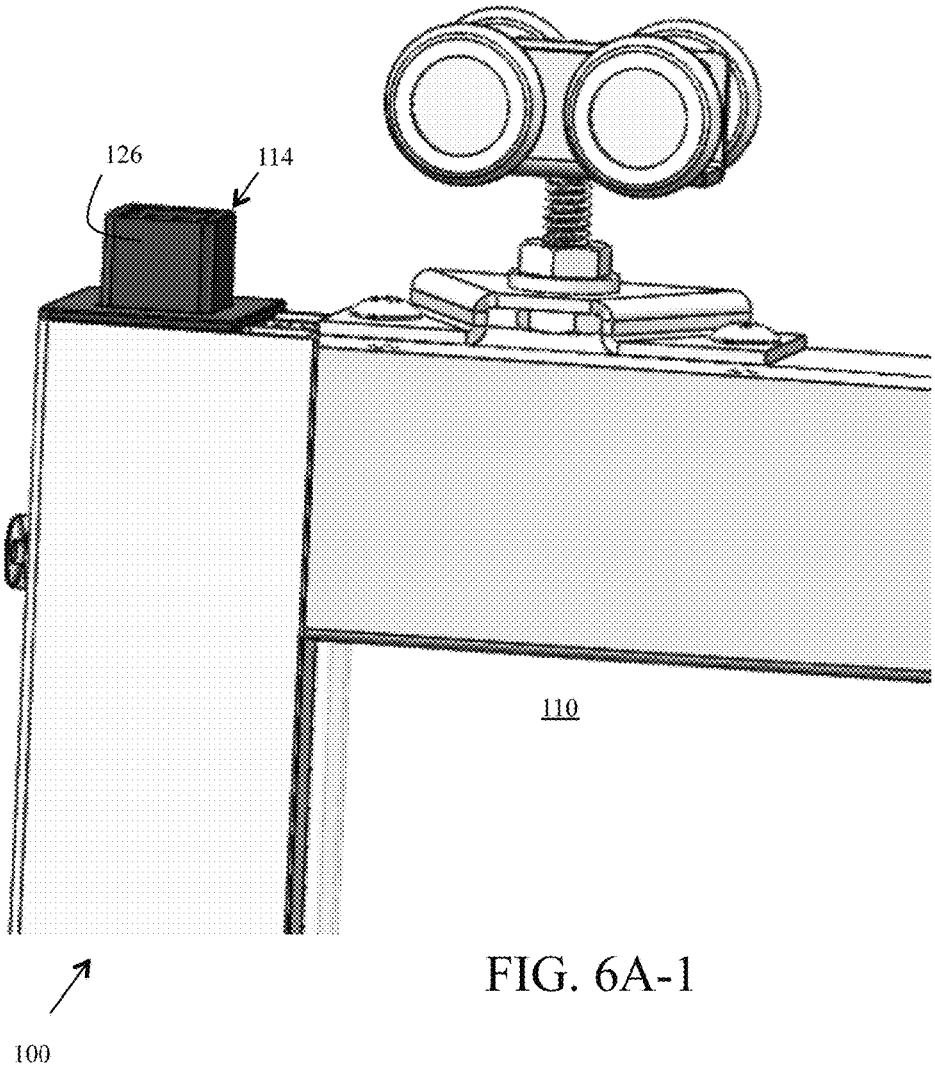
Figures 2, 6A:
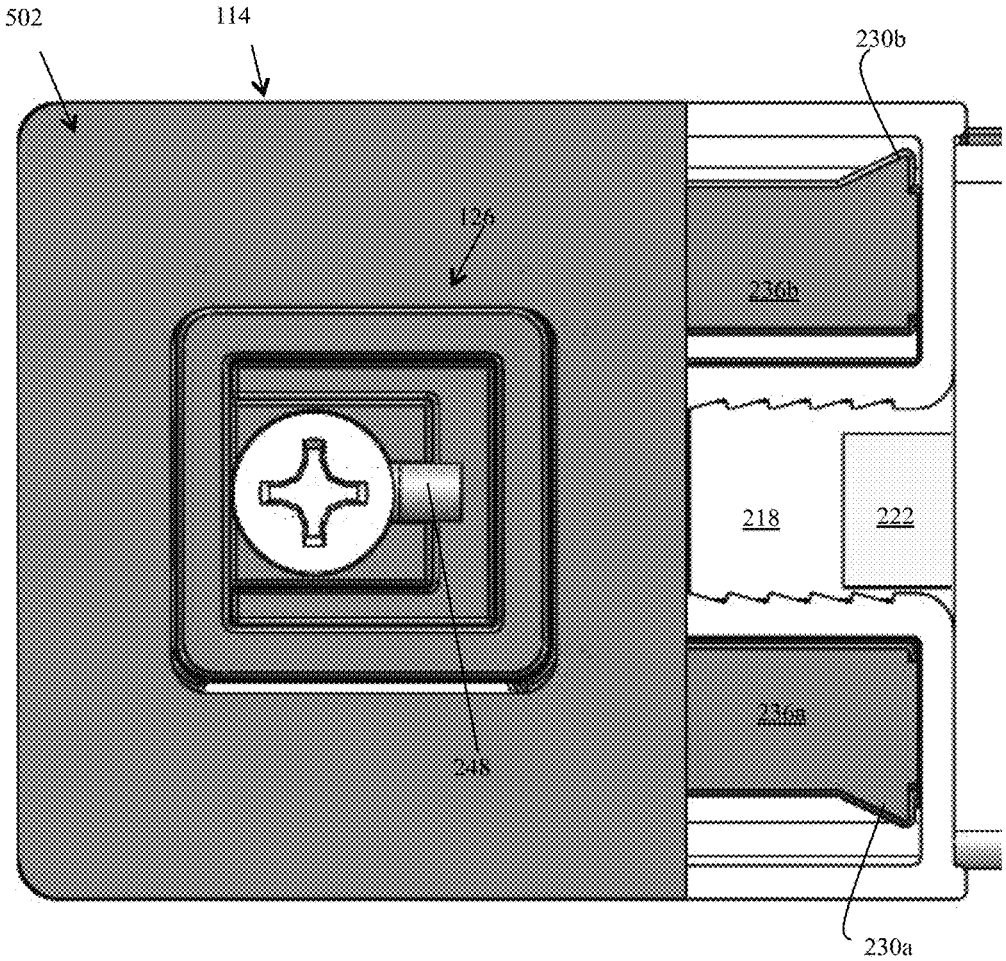
Figure 6B:
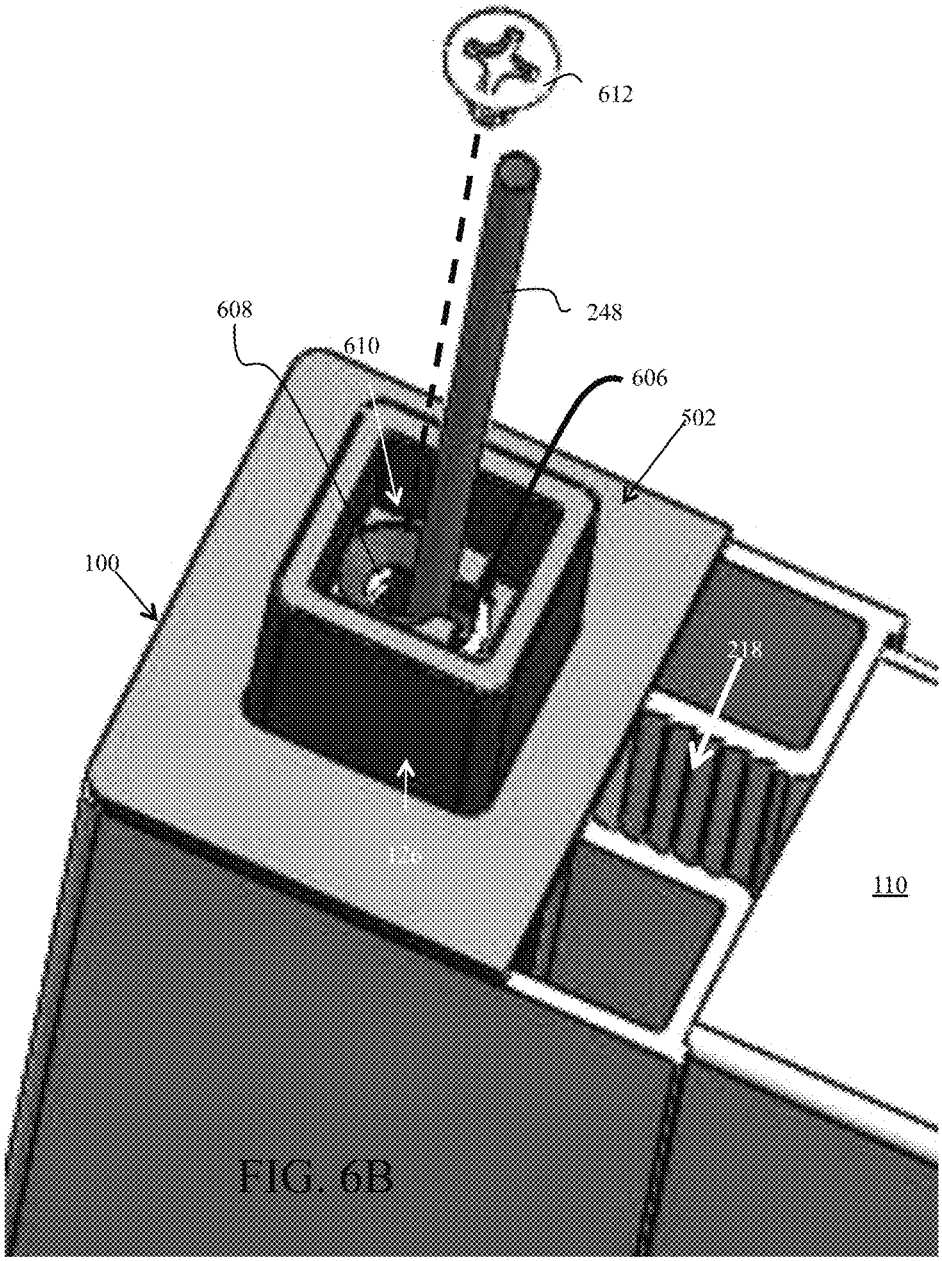
Figure 6C:
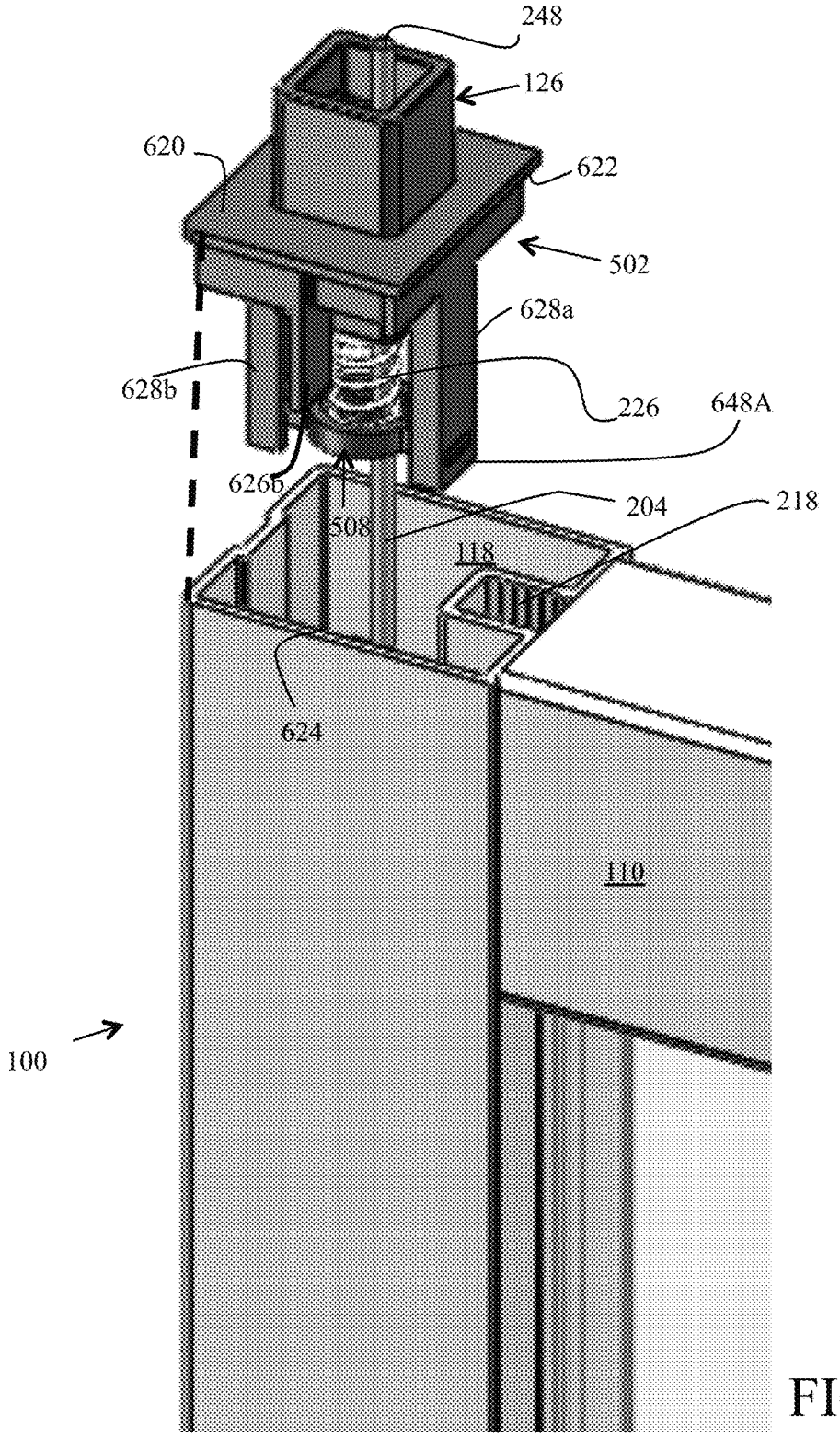
Figure 6D:
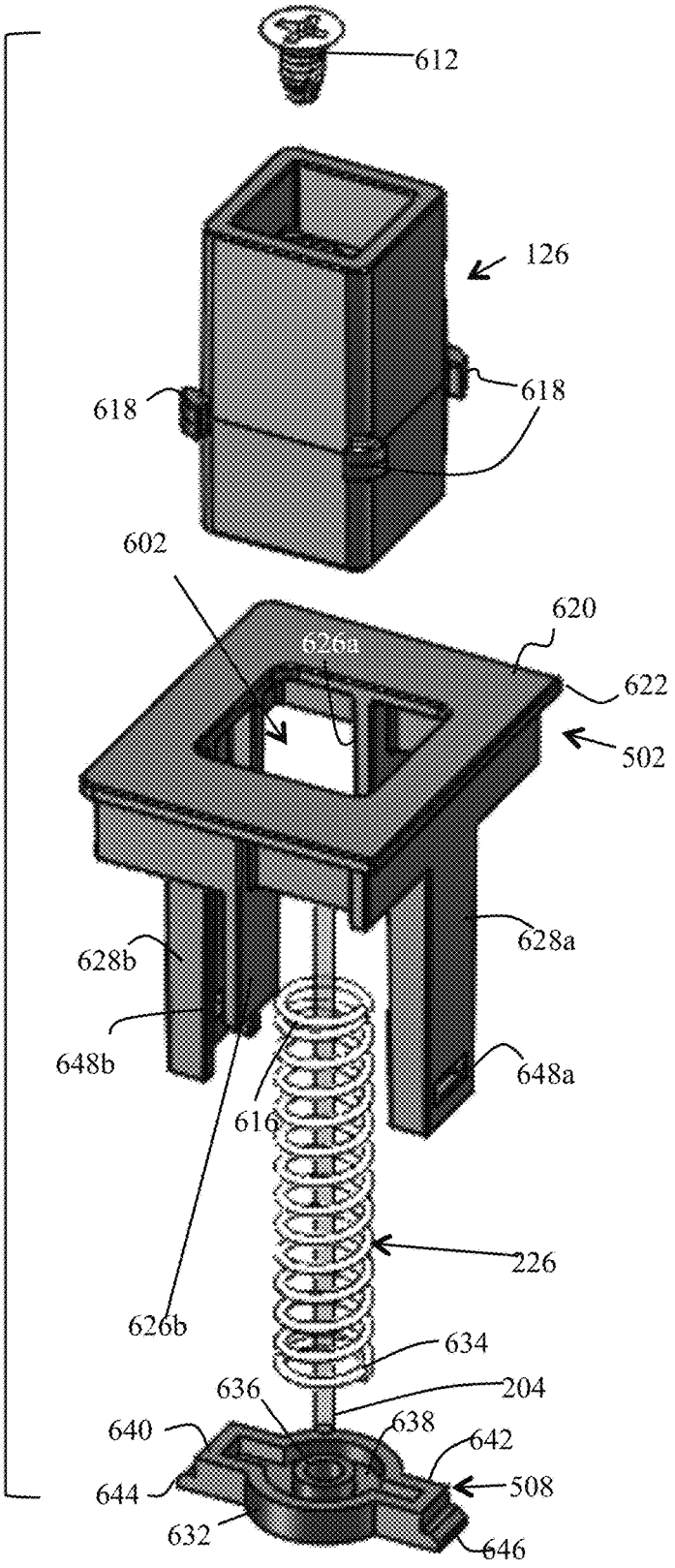
Figure 6E:
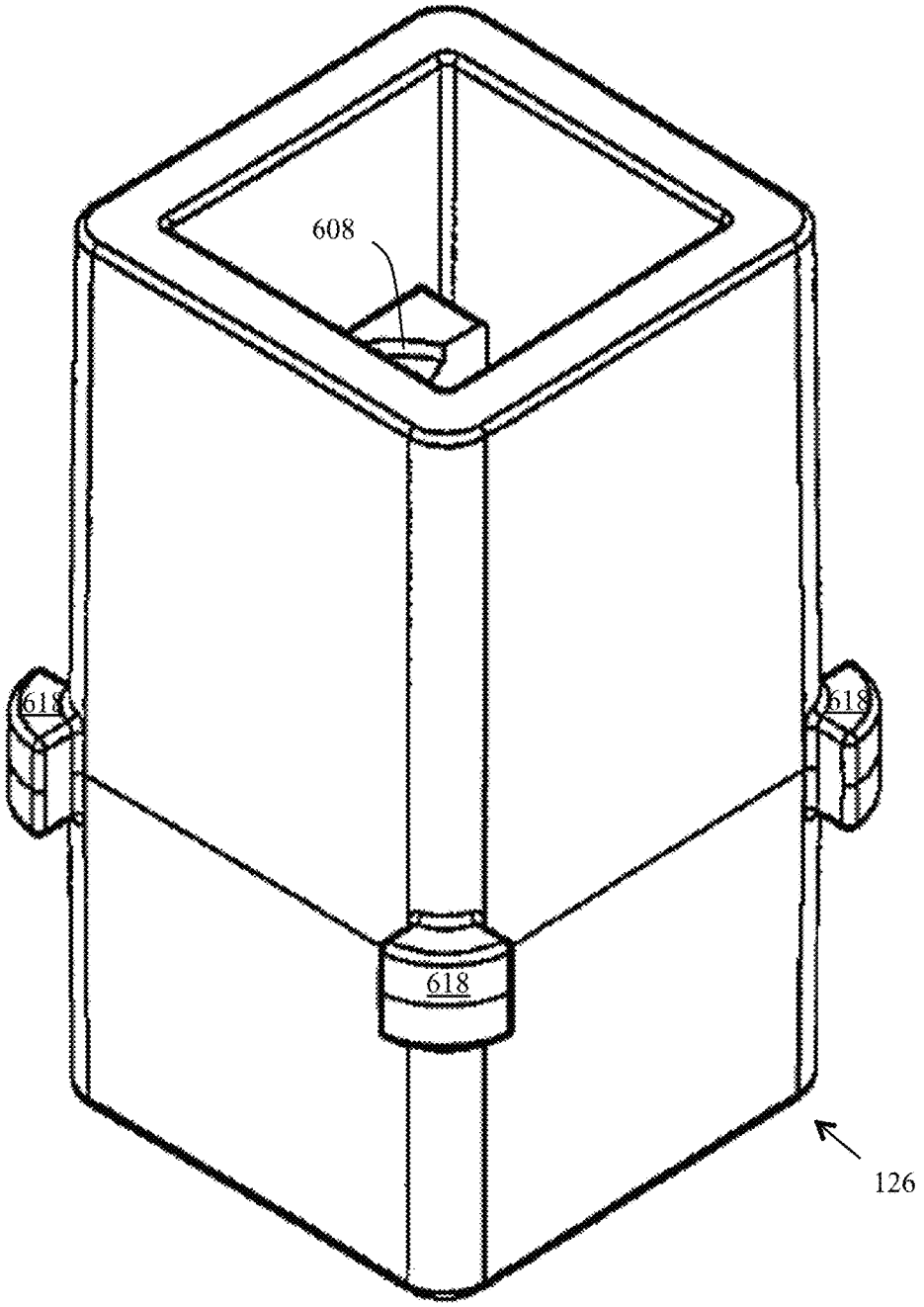
Figure 6F:
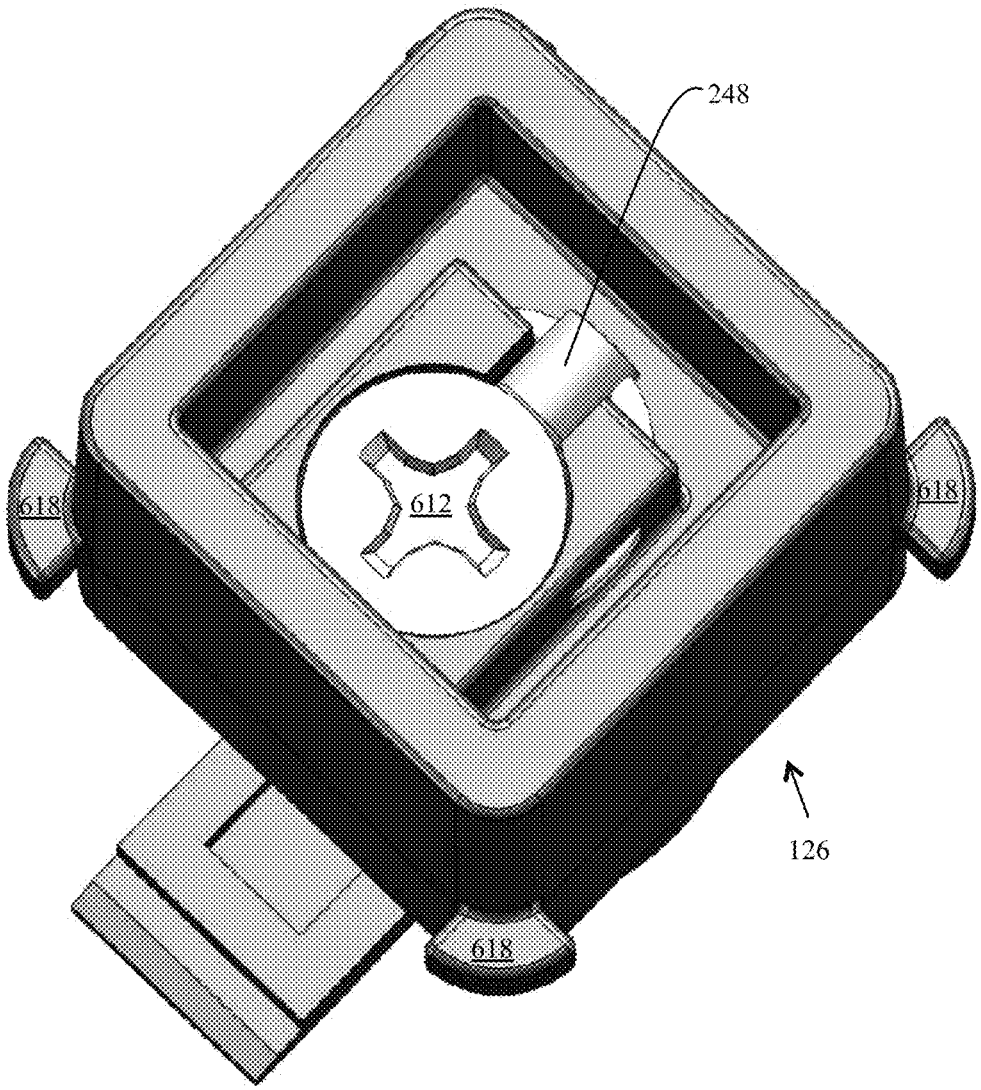
Figure 6G:
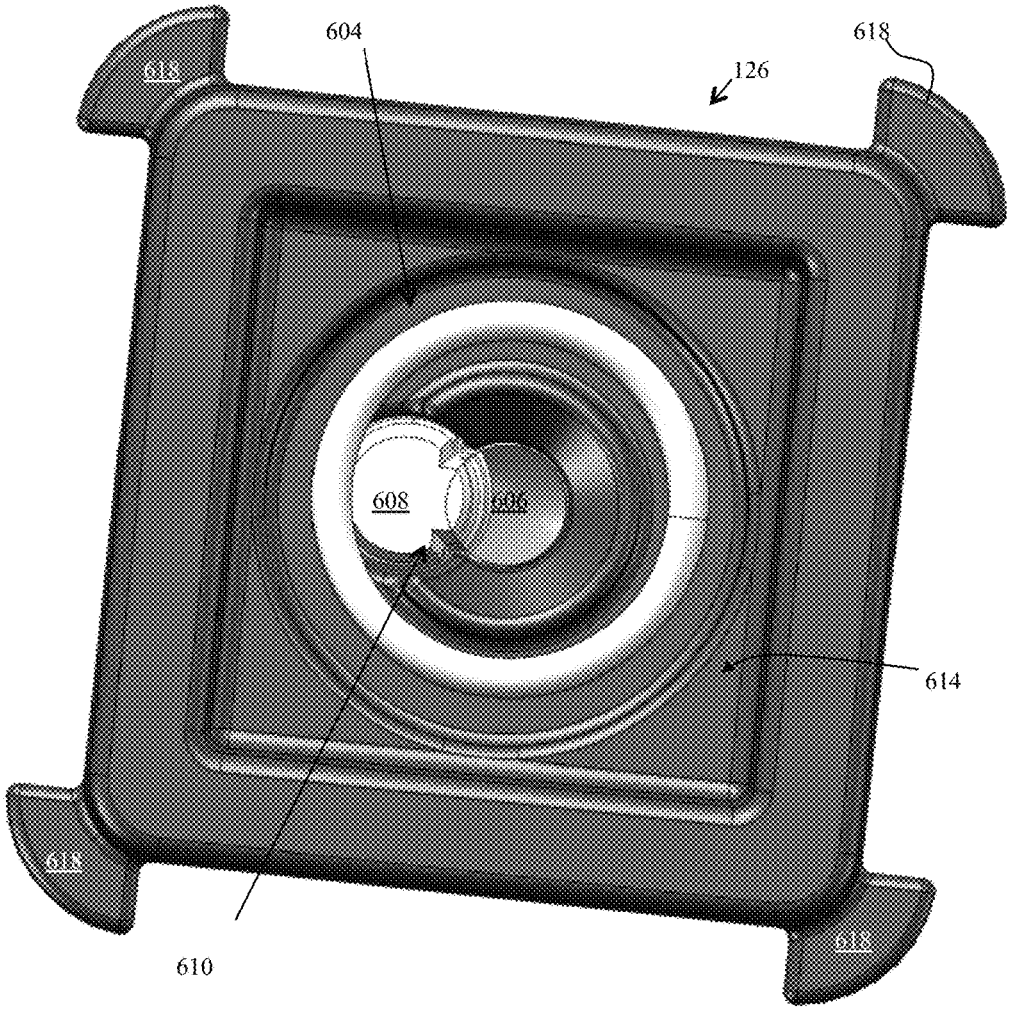
Figure 6H:
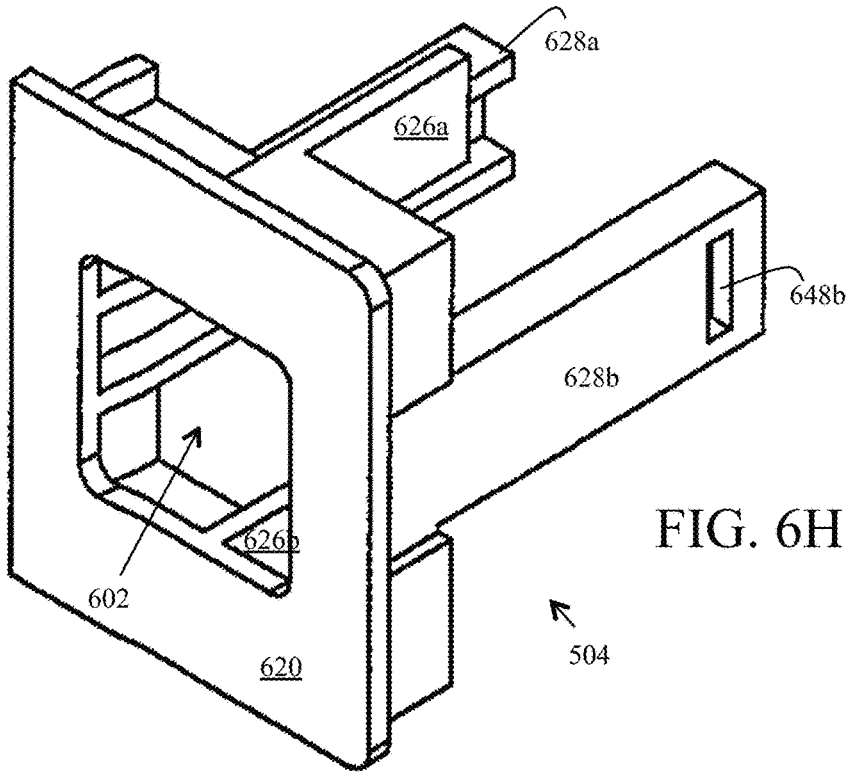
Figure 6I:
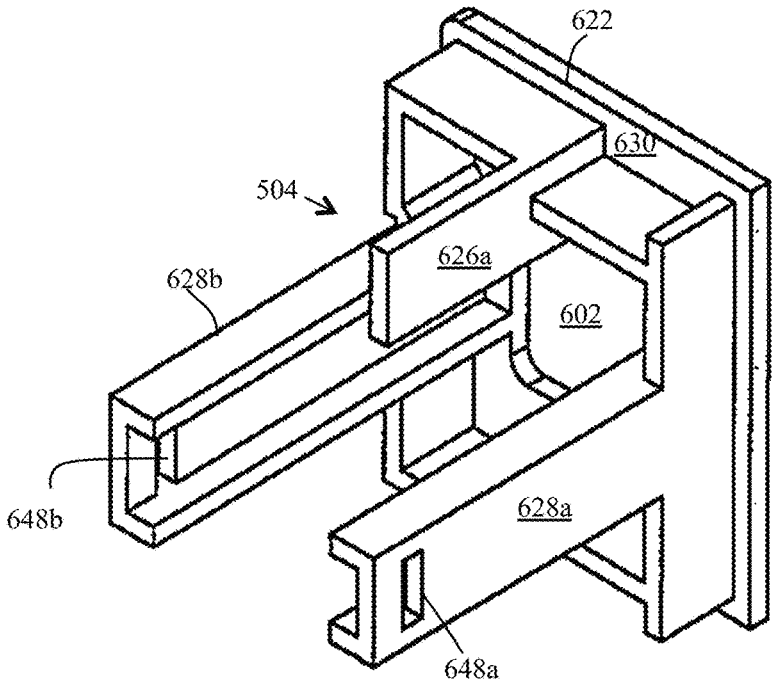
Figure 6J:
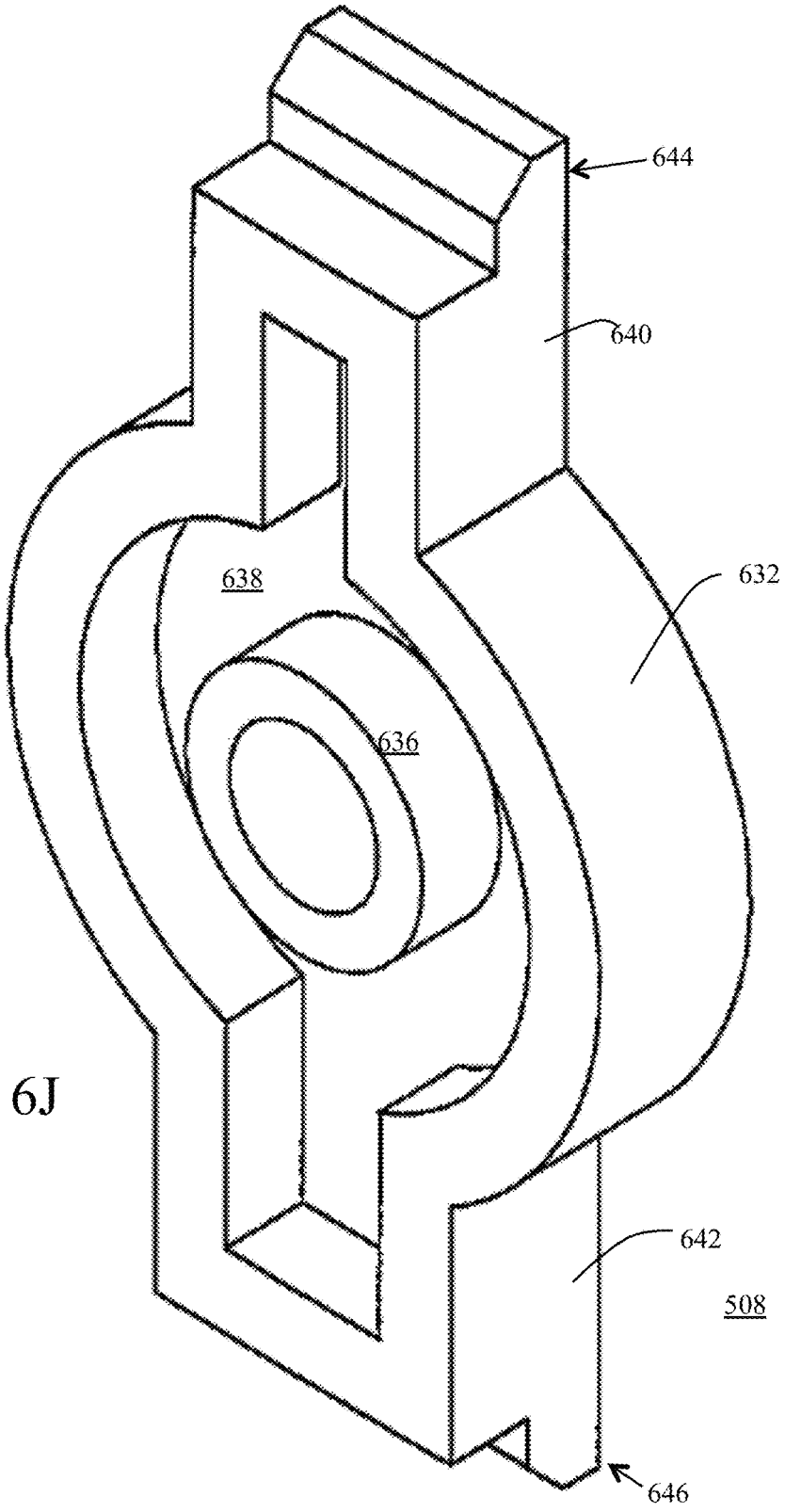

FIGS. 6A-1 to 6J are non-limiting, exemplary detailed illustrations of remote latch assembly, including individual components thereof in accordance with one or more embodiments of the present invention. As illustrated in FIGS. 5A-1 to 6J, the latching and locking system of the present invention further includes remote latch assembly 114 that is actuated by remote latch actuator 112 to engage with keeper assembly 116. Remote latch assembly 114 is comprise of latch 126 that reciprocally moves along path shown by arrow 124 within an opening 602 of a cap (or guide) 504, biased to a default extended position by a resilient member 226, which itself is secured by a support member 508. Remote latch assembly 114 moves along path 124 when actuator shaft 204 is move by remote latch actuator 112 along same path.

Latch 126 of remote latch assembly 114 is preferably comprised of a substantially square profile so that it does not rotate during installation. Latch 126 includes a holding structure 604 that receives and secures a second end 248 of actuator shaft 204, with holding structure 604 defined by a primary through-hole 606 for insertion (or feeding) of second end 248 of actuator shaft 204. Primary hole 606 is optionally opened laterally into a secondary, wider hole 608 (forming an opening 610 with "8" shape configuration) for receiving a fastener 612 that frictionally maintains first end 248 of actuator shaft 204 within "8" configured opening 610 of holding structure 604 (best shown in FIGS. 6B, 6F, and 6G). As best illustrated in FIG. 6G, latch 126 further includes a bottom cavity 614 that houses a first end 616 of resilient member 226, which pushes against internal holding structure 604 to bias latch 126 to the default extended position. Latch 126 further includes a set of external protuberances 618 that function as stops to prevent latch 126 from extending out of cap or guide 502 and overreaching keeper 122.

Cap or guide 502 (FIGS. 6H and 6I) of remote latch assembly 114 is comprised of opening 602 for allowing latch 126 to move within and extend out there-from to reach keeper 122. Cap 502 includes a support-base 620 with periphery flanges 622 that enables cap 502 to rest on top edge 624 (FIG. 6C) of extrusion 100 and has a first and second guide-posts 626*a/b* that extend from a bottom 630 of the support-base 620 of cap 502, securing cap 502 within extrusion 100, preventing lateral movement of cap 502.

Cap or guide 502 further includes set of interlock extensions 628*a/b* that are associated with support member 508 of remote latch assembly 114. Support member 508 (FIG. 6J) of remote latch assembly 114 includes a base 632 that retains and supports a second end 634 of resilient member 226, with base 632 including a cylindrical projection 636 from a surface 638 of base 632 to securely maintain the resilient member 226 in appropriate orientation when resilient member 226 is compressed. Support member 508 further includes lateral securing arms 640 and 642 that extend laterally in opposite directions from base 632, and include respective distal ends 644 and 646 that interlock with respective interlocking apertures 648*b* and 648*a* of interlock extensions 628*b* and 628*a* of cap 502. Resilient member 226 maintains tension within actuator shaft 204 by pushing out latch 126 from cap opening 602, with external protuberances 618 of latch 126 maintaining latch 126 from falling out when they abut against bottom surface 630 of support-base 620 of cap 502. In other words, the mechanical biasing scheme in accordance with one or more embodiments of the invention generates a dynamic holding strength that is maintained under increased tensile/compression forces that attempt to separate the components. It should be noted that in this non-limiting, exemplary instance, a first lateral securing arm 640 is wider than second lateral securing arm 642, commensurate with cap interlock extensions 628*b* and 628*a*. The reason one is wider that the other is primarily due to the shape of the interior of the extrusion. Also, whenever possible it is advantageous to reduce material costs by eliminating unnecessary material from non-structural aspects of the part. Additionally, it also helps in assembly of the unit and, in most cases, also helps in manufacturing the part.

FIGS. 7A to 7F are non-limiting, exemplary detailed illustrations of keeper assembly, including individual components thereof in accordance with one or more embodiments of the present invention. As illustrated, latching and locking system of the present invention further includes keeper assembly 116 comprise of an adapter member 128 that is adjustably associates with keeper 122 and coupled with a structure 104. Adapter member 128 of keeper assembly 116 is securely fastened by a set of fasteners 510 at desired positions with structure 114. Adapter member 128 is comprised of a first portion (one or more lateral supports) 132 configured (adapted) to associate with structure 104, and includes a second portion 702 adjacent the one or more lateral supports 132 and including a fastener hole 704 configured to associate with keeper 122, with keeper 122 adjustably associated with the second portion 702 by a fastener 512.

It should be noted that the present latching mechanism may function with most types of structures 104 as first portion (one or more lateral supports) 132 of adapter member 128 may be configured commensurate with rail track profile configurations (best shown in FIG. 7B-1), independent of second portion 702, keeper 122, or the remaining components of the present invention. For example, structure 104 may have a circular profile in which case, first portion (one or more lateral supports) 132 of adapter member 128 may comprise of a commensurate configuration in relation to rail while maintaining its second portion 702 connection with keeper 122 the same. Accordingly, the present invention may be substantially universally applicable to most structures 104 so long as first portion (one or more lateral supports) 132 of adapter member 128 may be configured commensurately.

As illustrated in FIGS. 7C to 7E-2, keeper 122 includes a chamfered-guide portion 706 that progressively engages with and moves latch 126 that is biased by default to an extended position by resilient member 226 to a retracted position so that latch 126 clears walls of cavity 716 of the keeper 122, and once aligned with relief or cavity 716, latch 126 is extended to the extended default position by resilient member 226 and locked into cavity 716 of keeper 122. Keeper 122 further includes a fastener hole 708 configured to associate with fastener hole 704 of second portion 702 of adaptor member 128. That is, as best illustrated in FIG. 5B-1, fastener hole 708 of keeper 122 is aligned with fastener hole 704 of adaptor member 128, with a fastener 512 passed through both to secure keeper 126 with adapter member 128. It should be noted that the holes 704 and 708 are elongated to allow keeper 122 to adjustably secure (vertical or up/down) to adapter member 128. Keeper 122 may be adjustably secured to adapter member 128 using serration surface 710 of keeper 122 as markings, abutting serration surface 712 of second portion 702 of the adaptor member 128.

Keeper assembly 116 is therefore adjustable in a first orientation (e.g., vertically) to vary distance between latch 126 of remote latch assembly 112 and a keeper 122, and is adjustable in a second orientation (e.g., horizontal) to accommodate latching and secure locking and unlocking of an enclosure in a desired fixed position in relation to fixed structure 104. As illustrated in FIG. 7F, one or more keeper assembly 116 may be associated with structure 104 at desired positions as illustrated, along structure 104 to allow latching and secure locking and unlocking of an enclosure in multiple desired position in relation to structure 104. Further, one or more keeper assembly 116 are vertically adjustable (via elongated fastener holes 704 and 708 and contacts of respective serrations 710 of keeper 122 with serrations 712 of adaptor member 128) to allow for tolerances for accommodating variations in structures with which the latching and locking system is associated for continued correct operations.

FIGS. 8A to 8F-2 are non-limiting exemplary illustrations of another enclosure with the same extrusion that incorporates the same latching and locking system shown in FIGS. 1A to 7F, with the addition of a handle in accordance with one or more embodiments of the present invention. Extrusion and the latching and locking system illustrated in FIGS. 8A to 8F-2 includes similar corresponding or equivalent components, interconnections, functional, operational, and or cooperative relationships as that shown in FIGS. 1A to 7F, and described above. Therefore, for the sake of brevity, clarity, convenience, and to avoid duplication, the general description of FIGS. 8A to 8F-2 will not repeat every corresponding or equivalent component, interconnections, functional, operational, and or cooperative relationships that has already been described above in relation to the extrusion and the latching and locking system that is shown in FIGS. 1A to 7F.

As illustrated in FIGS. 8A to 8F-2, the latch and lock system of the present invention may also be used with a well-known and conventional pocket door 800. As illustrated in this non-limiting, exemplary embodiment, a handle assembly 802 is provided, comprising a housing 804 that includes an opening 806 for receiving a handle 808, and lateral sides 810 and 812 that include a set of protrusions 814 and 816 that enable the housing 804 to snap within opening 818 of extrusion 100 (opposite opening 216). Housing 804 includes periphery 820 that cover over periphery 822 of opening 818. Housing 804 of handle assembly 802 also includes a set of slots 824*a* and 824*b* with hook shaped profile that enable an interlocking distal end 826 of handle 804 of the handle assembly 802 to snap into the slots 824*a* and 824*b*. A cavity 828 within housing 804 is also provided for housing a body 830 of handle 808 and grip portion 832 thereof. Handle 804 itself has commensurately configured set of interlocking member 834 that extend laterally from the interlocking distal ends 826 of handle 804, perpendicular longitudinal axis of handle 804. When installed, interlocking member 834 extends beyond slots 824*a/b* and periphery 822 of the opening 818, resting against interior surface of extrusion 100 (best illustrated in FIG. 8C) so that pocket door handle assembly 802 is not pulled out of opening 818 when the handle 802 is pulled. The grip portion 832 of handle 802 is comprised of protruded flange 836.

It should be noted that handle 802 and housing 804 are semi-assembled together and than installed within opening 818 of extrusion 100. Handle 802 (via the front part or the grip portion 832) is maneuvered from back 836 of housing 804 through opening 838, with the combination of housing 804 and handle 802 pushed into opening 818 of extrusion 100 until housing 804 snaps into opening 818 (via the set of protrusions 814) of extrusion 100, and then snapping interlocking member 834 into the set of slots 824*a/b*. Because interlocking member 834 are longer than the width of housing 804, they abut against extrusion body, preventing housing 804 from being pulled out.

FIGS. 9A to 9I-5 are non-limiting exemplary illustrations of another enclosure that incorporates another embodiment of latching and locking system in accordance with one or more embodiments of the present invention. Extrusion and the latching and locking system illustrated in FIGS. 9A to 9I-5 includes similar corresponding or equivalent components, interconnections, functional, operational, and or cooperative relationships as that shown in FIGS. 1A to 8F-2, and described above. Therefore, for the sake of brevity, clarity, convenience, and to avoid duplication, the general description of FIGS. 9A to 9I-5 will not repeat every corresponding or equivalent component, interconnections, functional, operational, and or cooperative relationships that has already been described above in relation to the extrusion and the latching and locking system that is shown in FIGS. 1A to 8F-2.

Figure 9A:
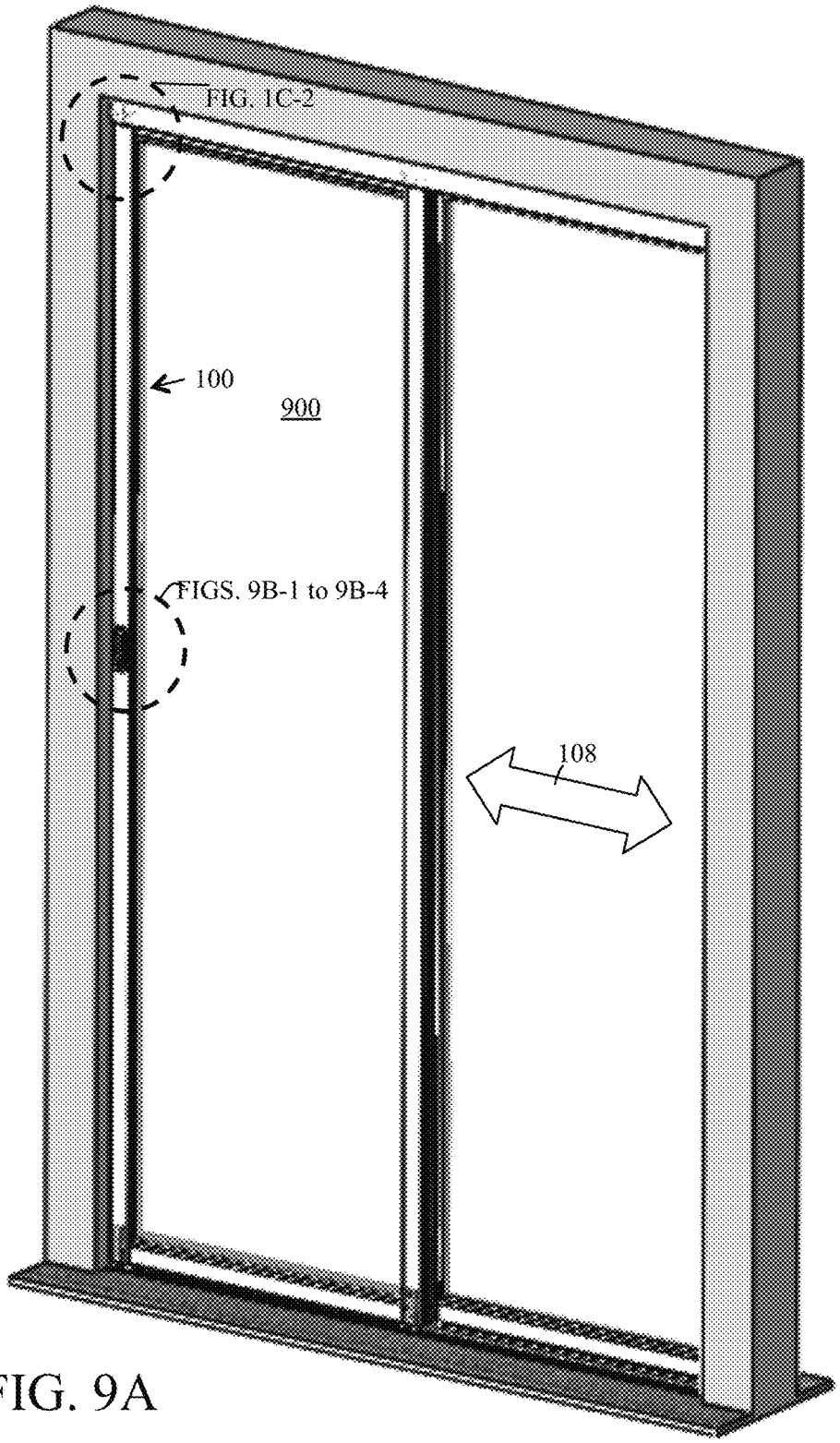
Figures 1, 4, 9B:
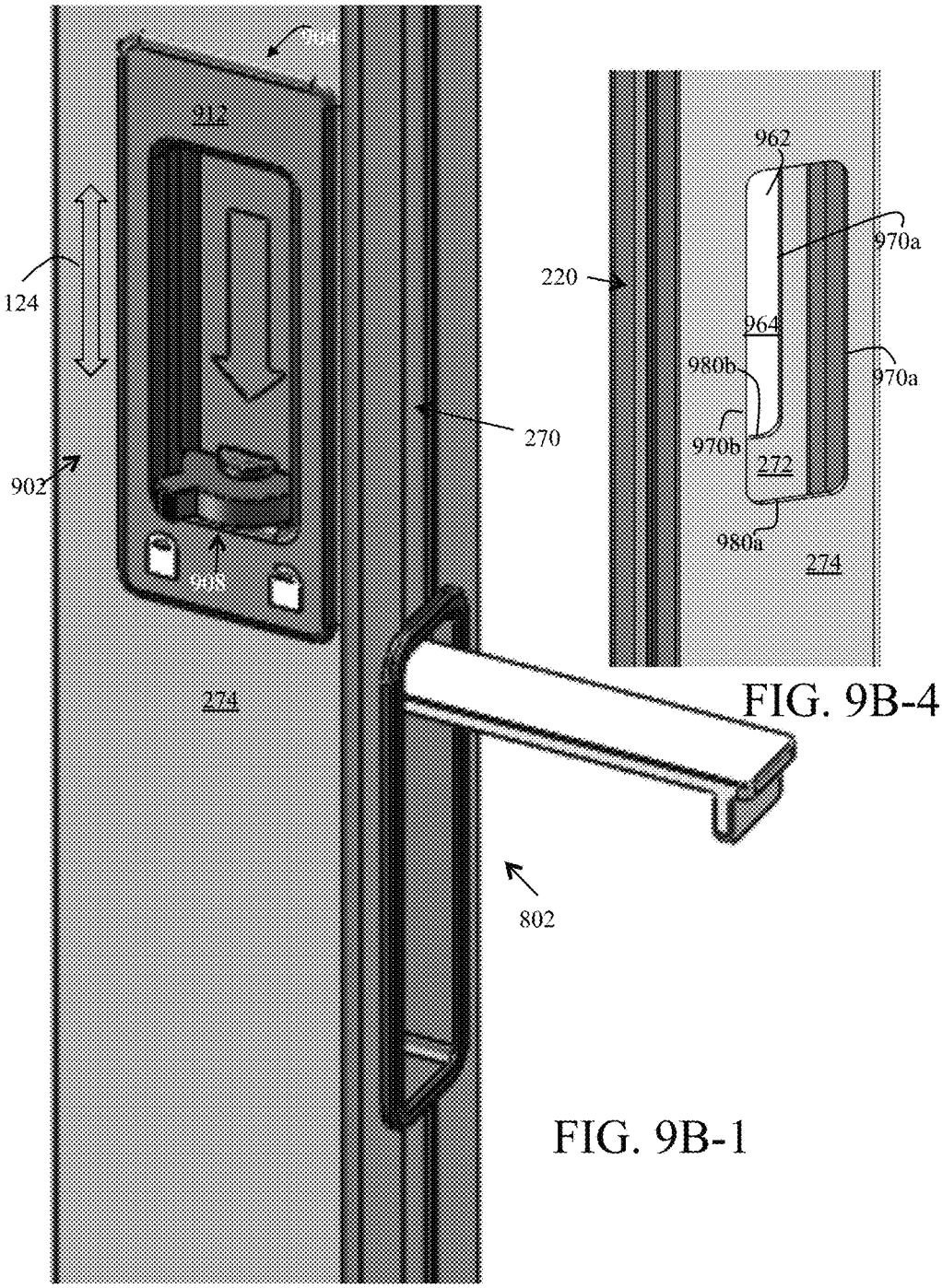
Figures 2, 9B:
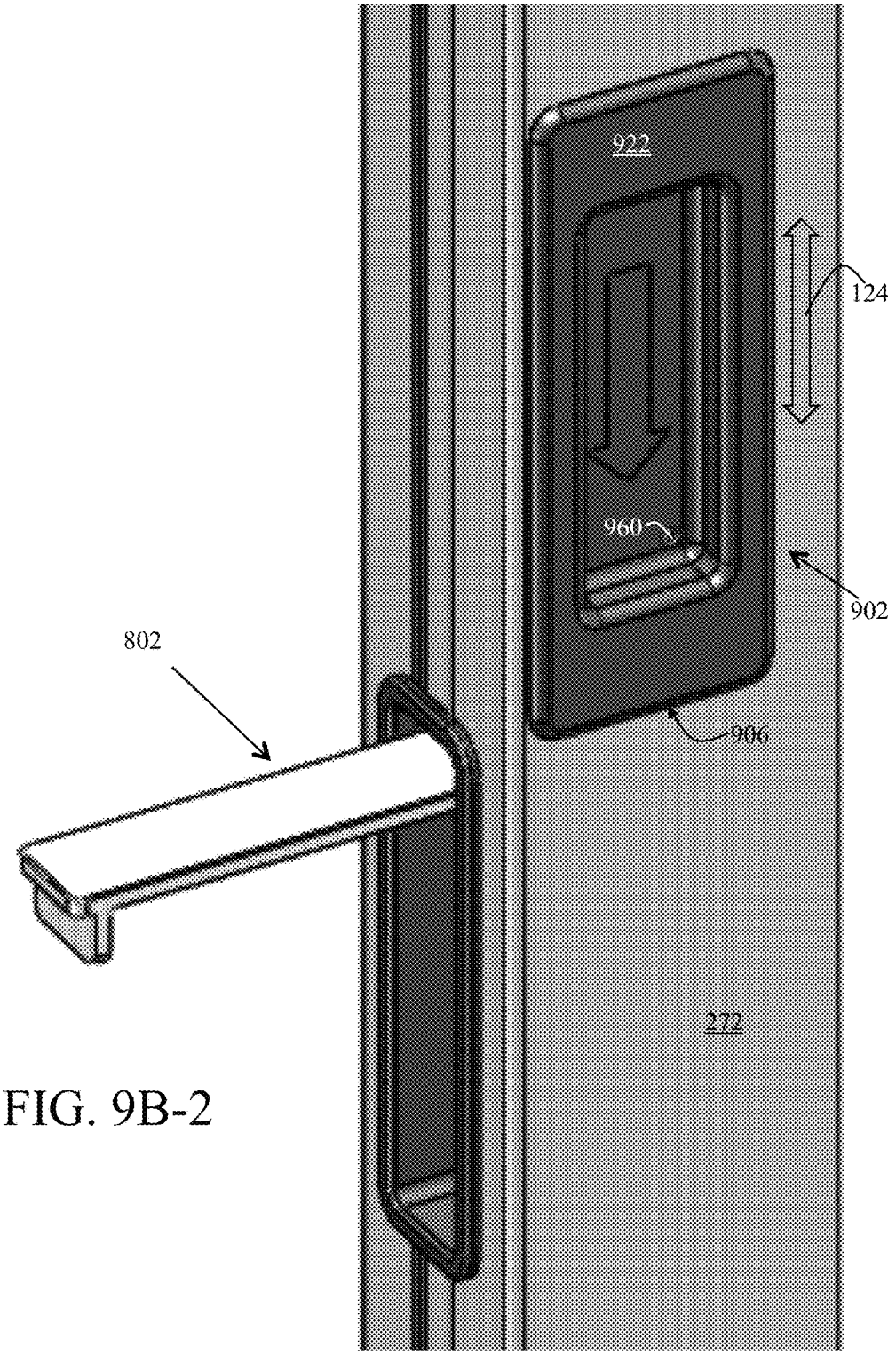
Figures 3, 9B:
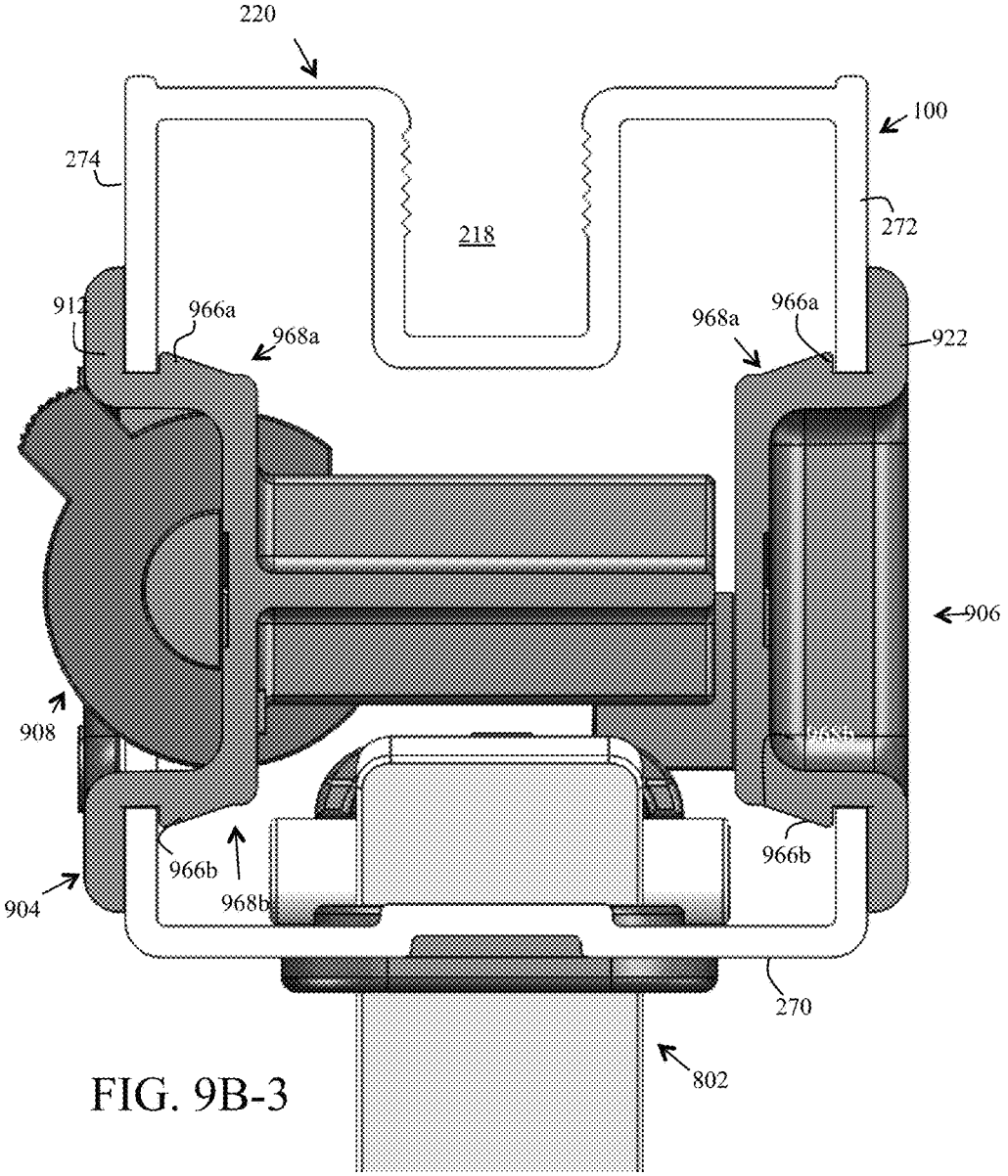
Figures 1, 9C:
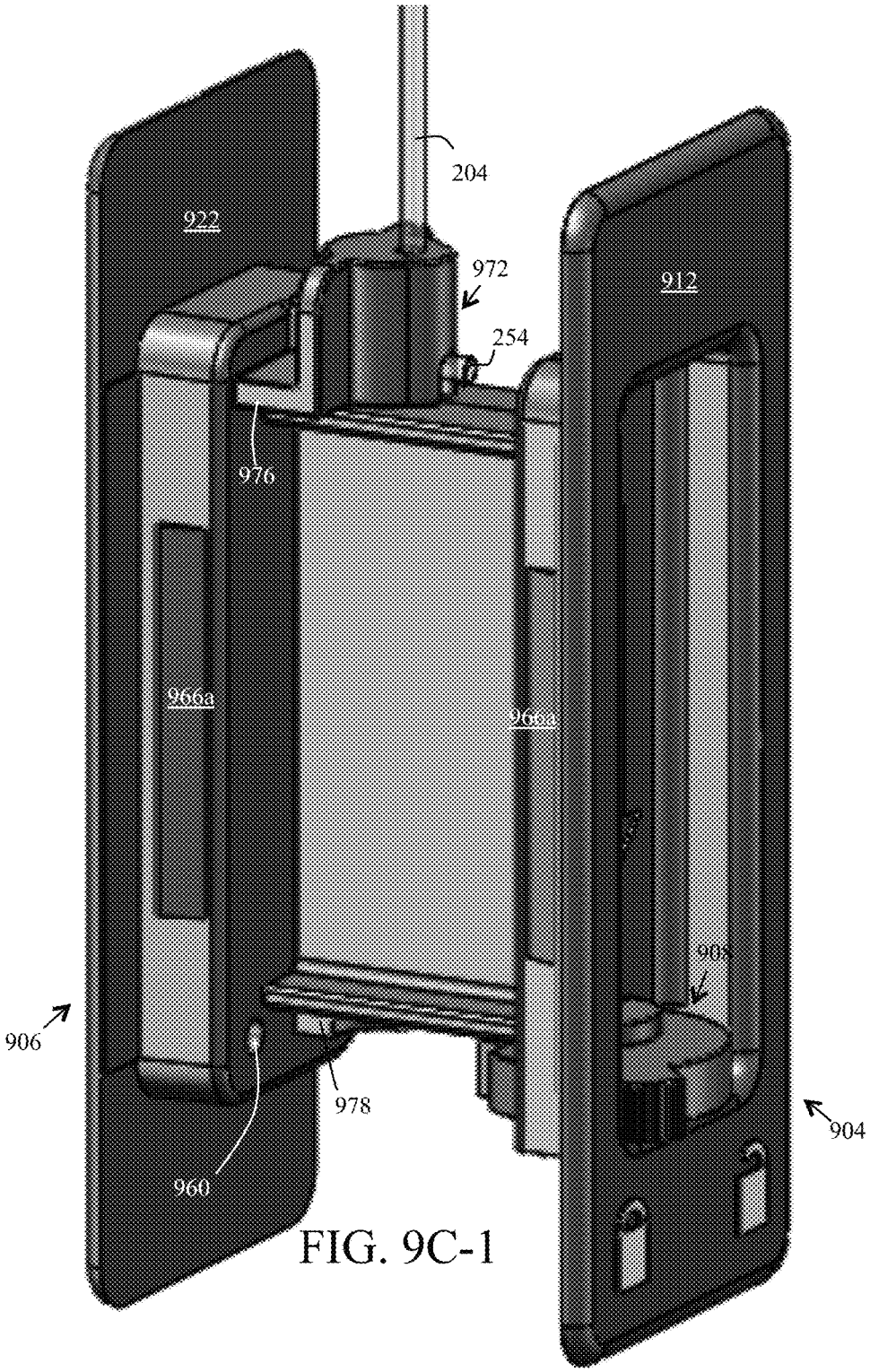
Figures 2, 9C:
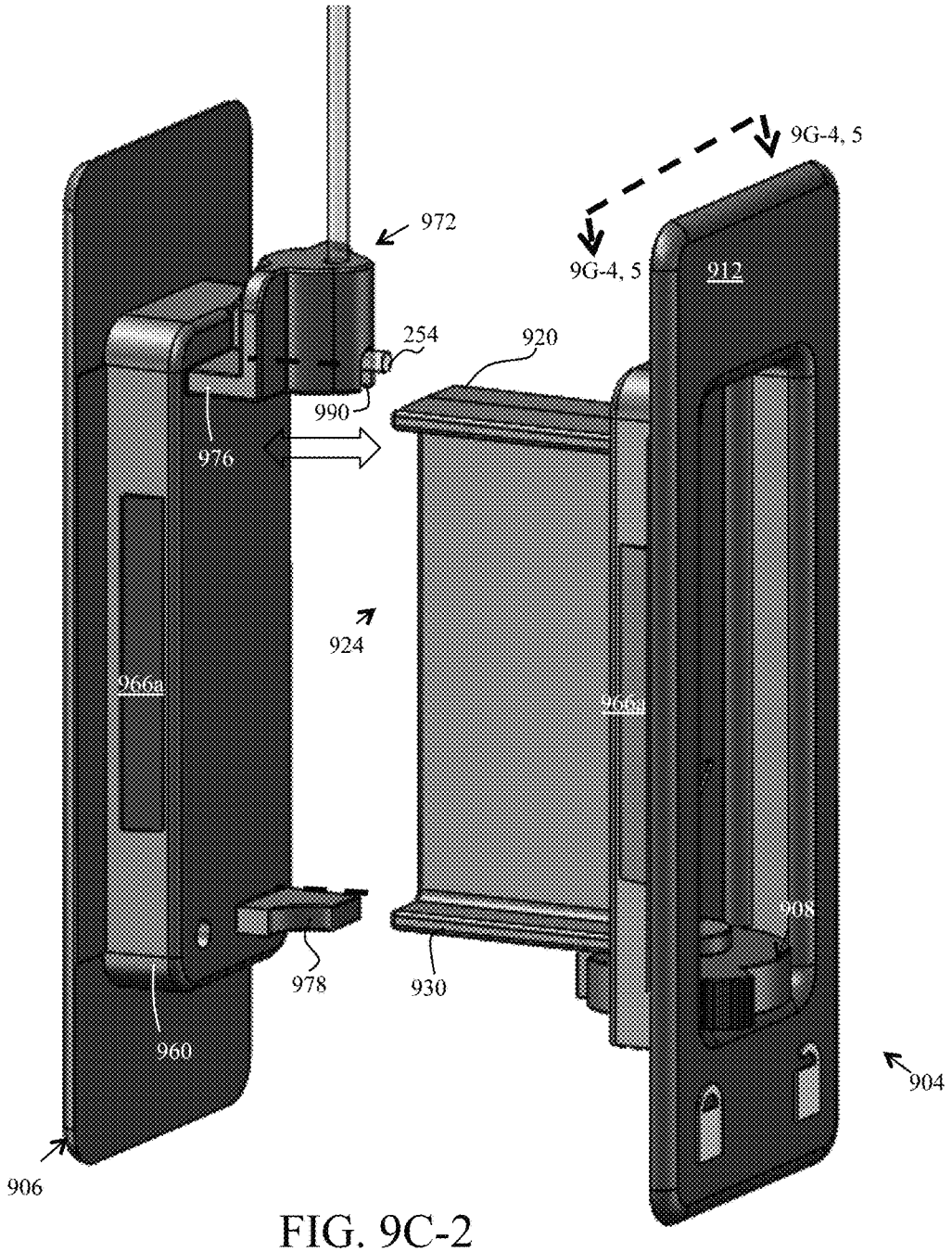
Figure 9D:
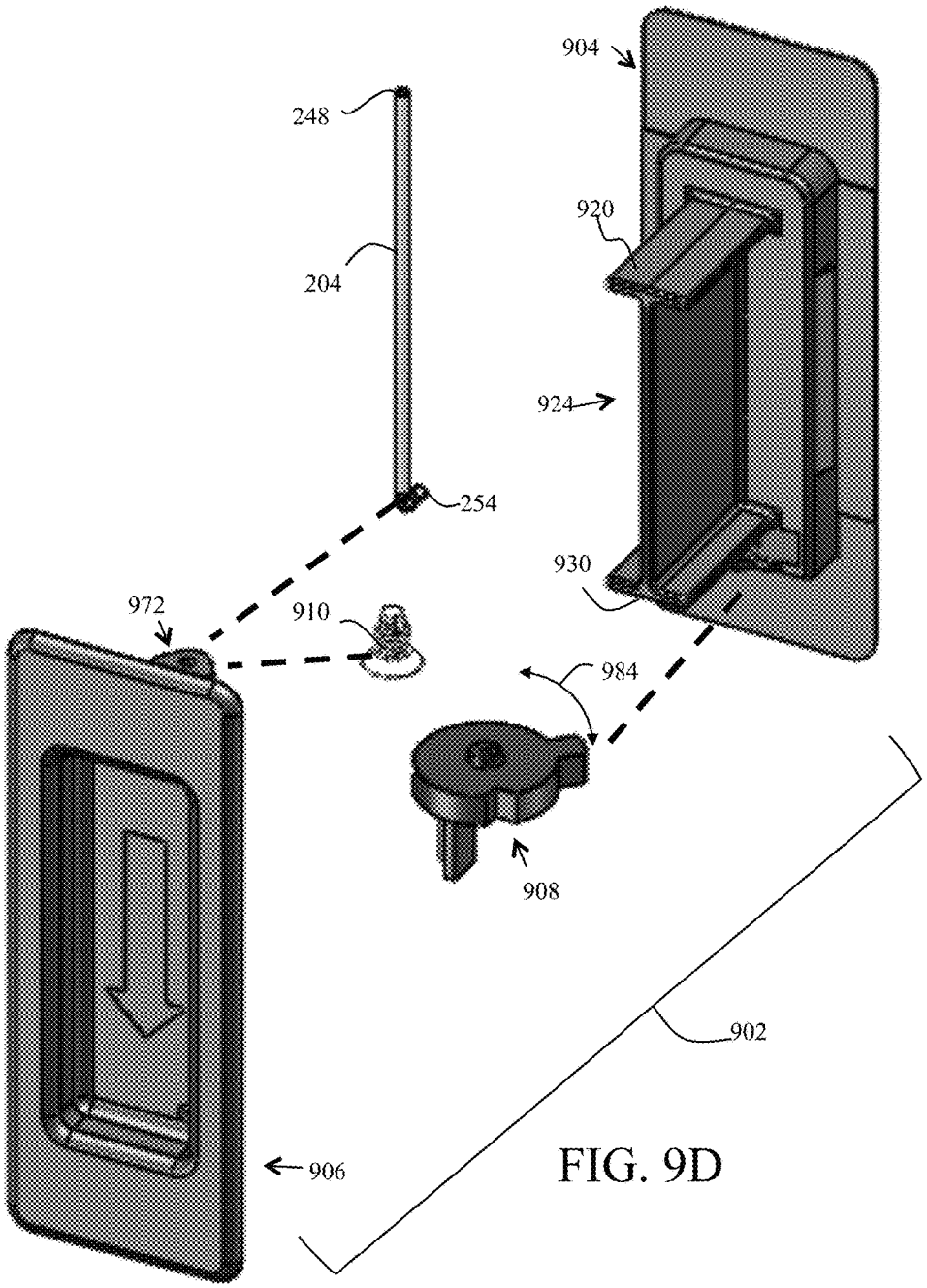
Figures 1, 9D:
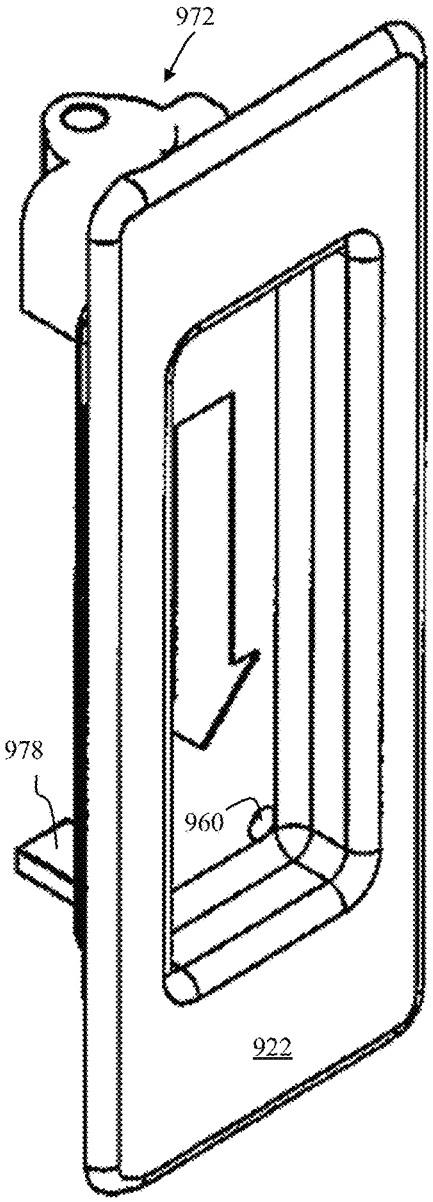
Figures 1, 9E:
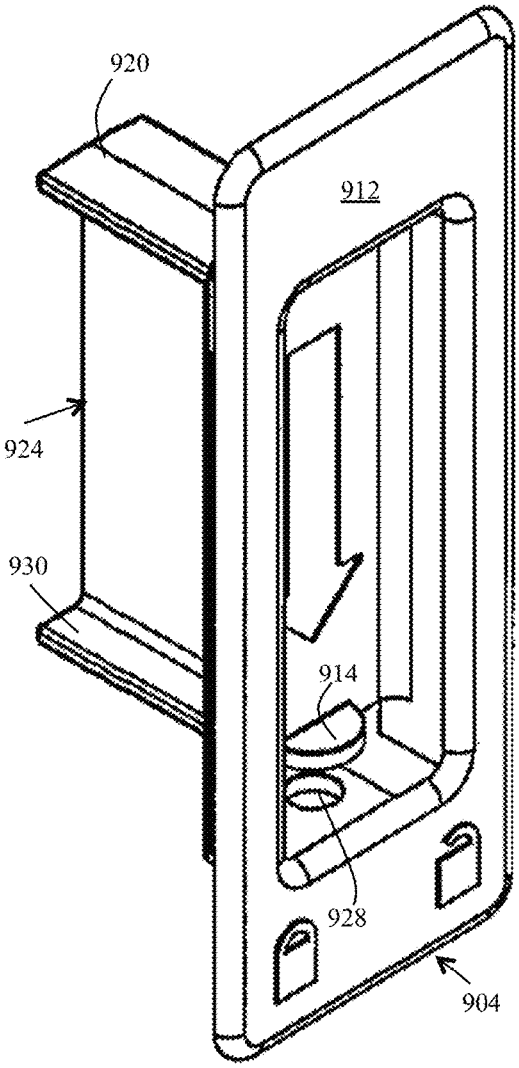
Figures 2, 9D:
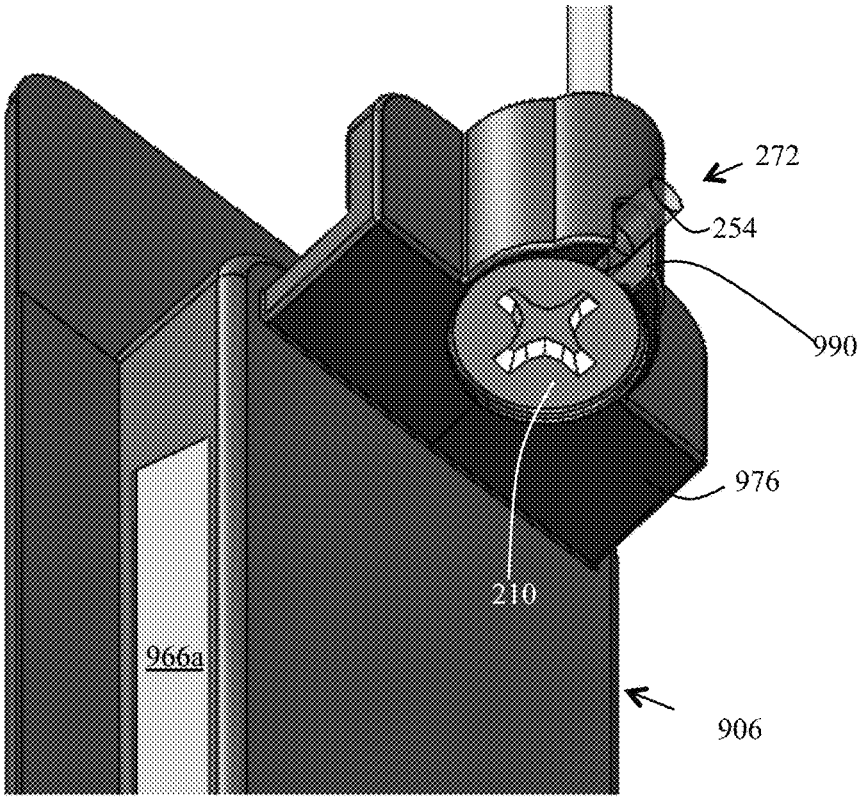
Figures 2, 9E:
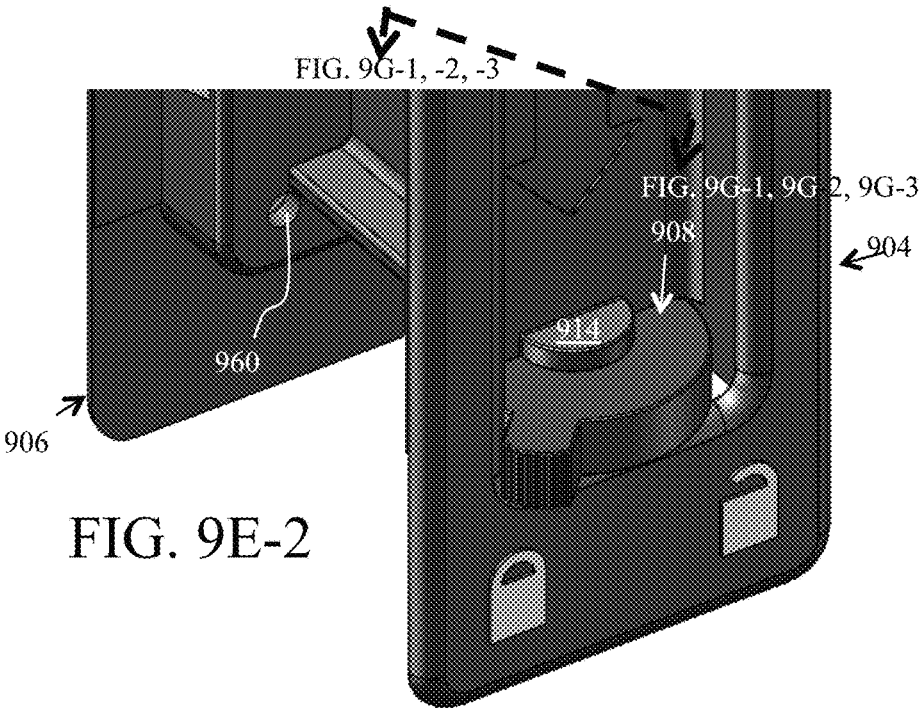
Figures 3, 9E:
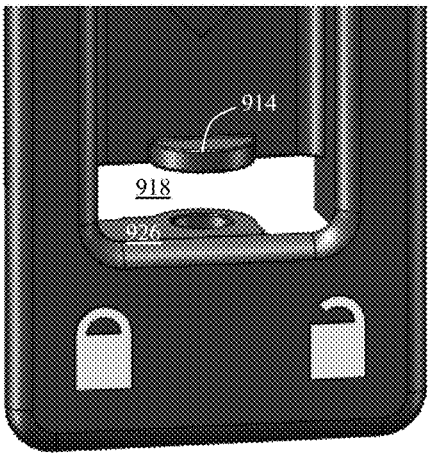
Figures 4, 9E:
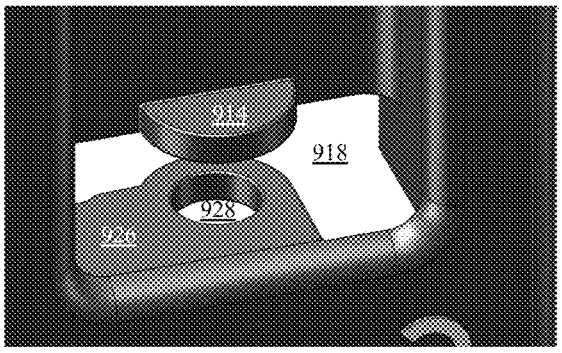
Figures 5, 9E:
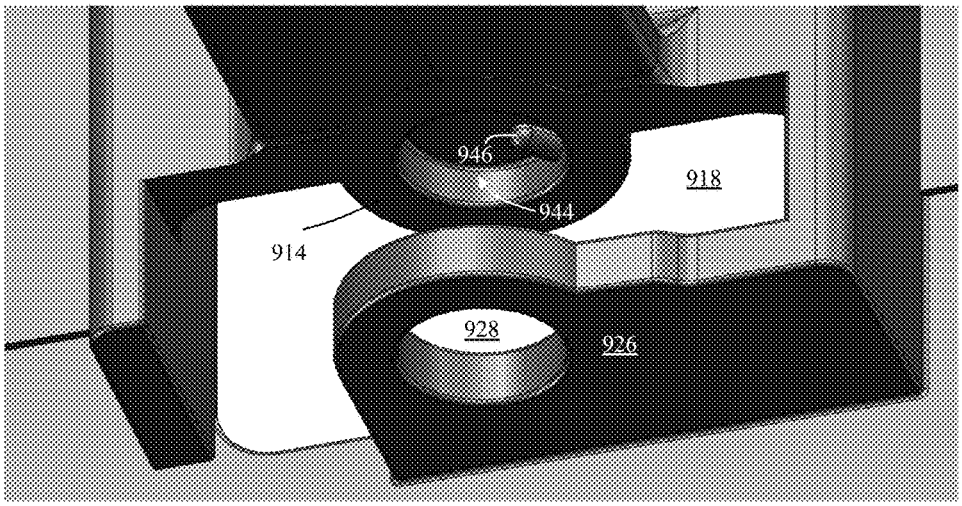
Figures 1, 9F:
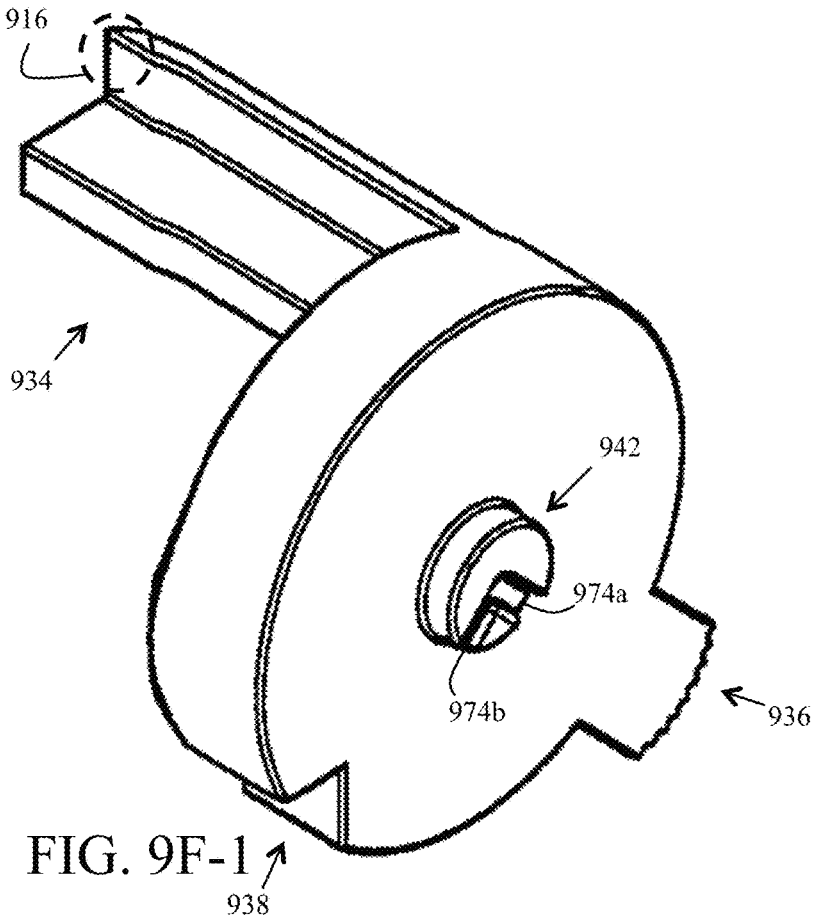
Figures 2, 9F:
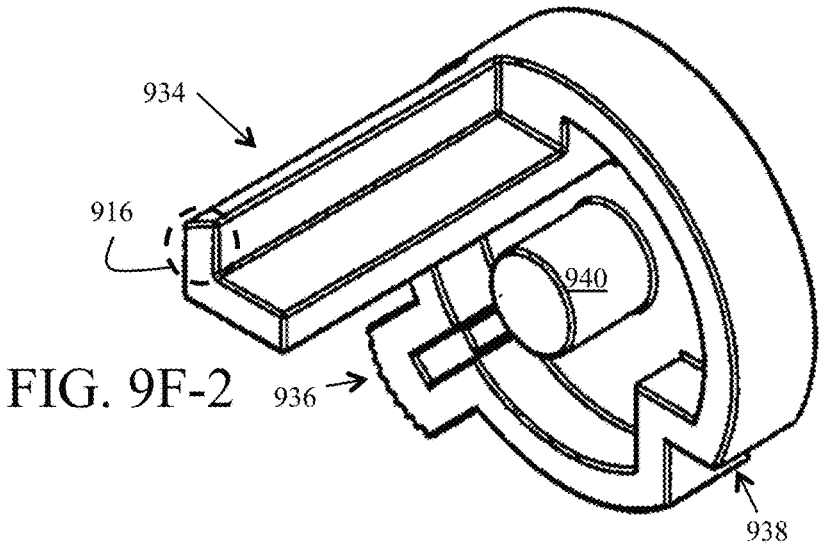
Figures 3, 9F:
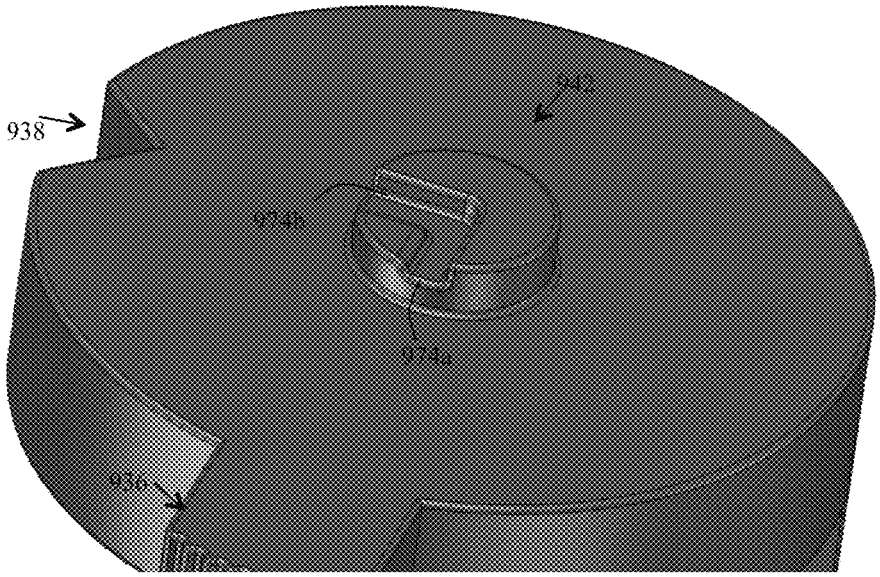
Figures 1, 9G:
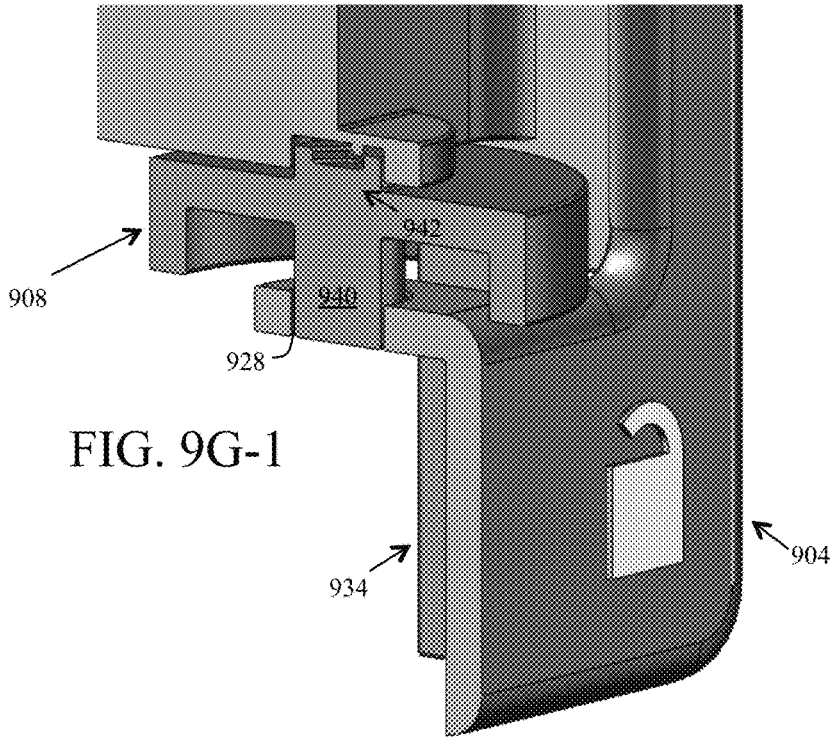
Figures 2, 9G:
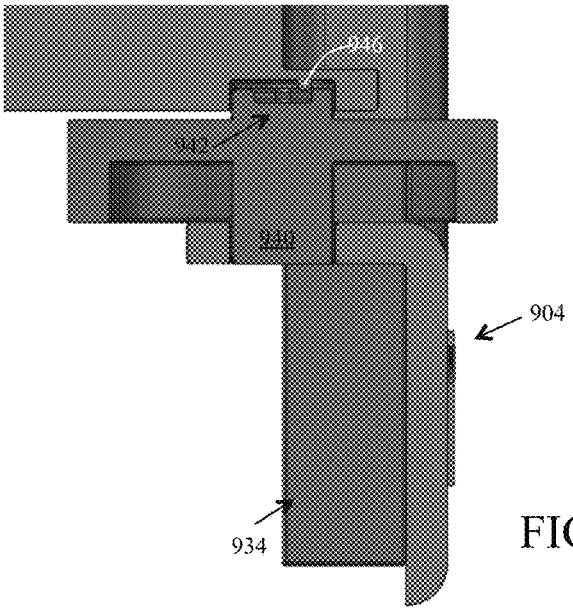
Figures 3, 9G:
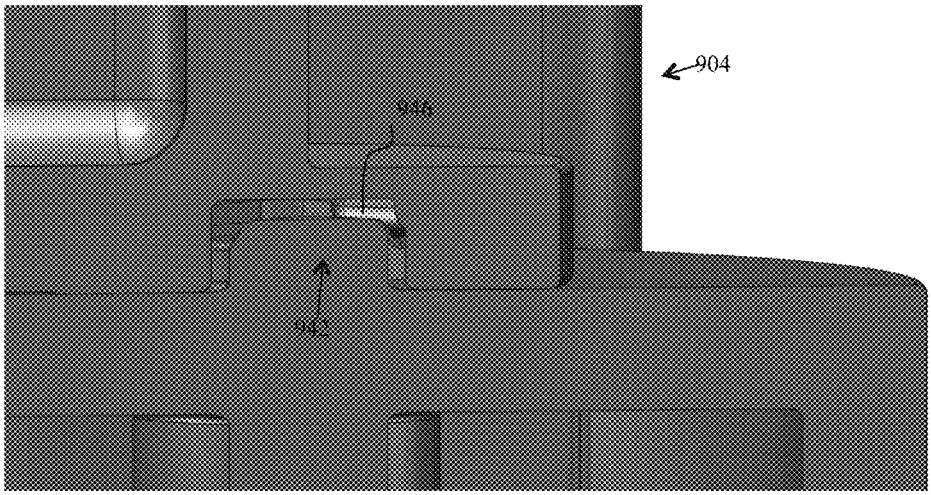

As illustrated in FIG. 9A, enclosure 900 is bottom-rolled, in the stile door (or bottom rolling sliding door) that opens and closes along path 108. In this non-limiting, exemplary embodiment, extrusion 100 is the stile of enclosure 900, non-limiting example of which is illustrated in FIG. 9B-4. As illustrated in FIGS. 9A to 9B-4, extrusion 100 of enclosure 900 includes a remote latch actuator 902 positioned within lateral openings 962 and 964 on respective lateral sides 272 and 274 of extrusion 100 due to mating of back side 220 with glass/frame of enclosure 900, and contacting of front side 270 with wall jamb. It should be noted that in this non-limiting, exemplary embodiment, enclosure 900 exemplarily and optionally incorporates handle assembly 802, positioned on front side 270 of extrusion 100.

Remote latch actuator 902 is comprised of an interior-facing latch actuator handle assembly 904 and an exterior-facing latch actuator handle assembly 906, with the interior-facing latch actuator handle assembly 904 accommodating a privacy latch 908 to prevent access to an area divided or enclosed by enclosure 900. Interior and exterior latch actuator handle assemblies 904 and 906 include respective cover portions 912 and 922 that when installed, cover over openings 962 and 964. In general, cover portions 912 and 922 are substantially larger in size then openings 962 or 964 so that when remote latch actuator 902 is moved along path 124, cover over portions 912 and 922 would continue to cover and not expose openings 962 and 964.

The actual back-end structure of handle assemblies 904 and 906 that are inserted through openings 962/964, are smaller than openings 962 and 964 so that when the handle assemblies 904 and 906 are inserted and secured within openings, they may move the entire length of openings 962 and 964 along path 124. As detailed below, privacy latch 908 has a member 934 that when in locked position fills the void that was left for movement of handle assemblies 904 and 906 so that the handles cannot move and are latched in locked position.

Interior and exterior latch actuator handle assemblies 904 and 906 further include a pair of locking tabs or flanges 966*a/b* that are positioned along lateral sides 968*a/b* of assemblies 904 and 906. When latch actuator handle assemblies 904 and 906 are installed, pair of locking tabs or flanges 966*a/b* engage periphery edges 970*a/b* of openings 962 and 964, and are compressed passed periphery edges 970*a/b* and snapped wide within hallow interior 118 of extrusion 100 (best shown in FIG. 9B-3). In other words, when inserted within opening 962/964 of extrusion 100, the respective pair of locking tabs or flanges 966*a/b* slide over side 970*a/b* and engage respective interior of sides of openings 962 and 964 of sides 970*a/b* to secure interior and exterior latch actuator handle assemblies 904 and 906 within extrusion 100.

Exterior-facing latch actuator handle assembly 906 includes a holding structure 972 to receive and secure a first end 254 of actuator shaft 204, with holding structure 972 including a primary hole for insertion (or feeding) of first end 254 of actuator shaft 204, a secondary, wider hole (forming an opening with "8" shape silhouette) for receiving a fastener 210 that frictionally maintains first end 254 of actuator shaft 204 within "8" configured opening of holding structure 972, similar to holding structure 252. As further illustrated, holding structure 972 includes a slot 990 that receives and secures excess length of actuator shaft 204, enabling installers to trim the excess portion to form first end 254 of actuator shaft 204. Exterior-facing latch actuator handle assembly 906 further includes flanges 976 and 978 that receives an "I" beam inter-engagement member 924 of interior-facing latch actuator handle assembly 904 (best illustrated in FIGS. 9C-1 and 9C-2), to enable synchronized motion of latch actuator handle assemblies 904 and 906 along path 124. That is, "I" beam inter-engagement member 924 slides in between flanges 976 and 978, with top portion 920 and bottom portion 930 of I" beam inter-engagement member 924 sliding in between flanges 976 and 978.

Interior-facing latch actuator handle assembly 904 includes privacy latch opening 918 for receiving privacy latch 908. Privacy latch opening 918 is defined by a lower extended member 926 having an retainer opening 928 for receiving retaining member 940 of privacy latch 908, and an upper member 914 with a cavity 944 for receiving member 942 of privacy latch 908. Cavity 944 of upper member 914 includes a protrusion 946 that rests within grooves (stop guides) 974*a* and 974*b* of member 942 of privacy latch 908 to maintain privacy latch 908 in one of a lock or unlocked positions. Privacy latch 908 includes member 934 that when installed and rotated to a locked position, engages a periphery edge 980*a* or 980*b* of opening 962 or 964, to thereby block moving of 902 along path 124. The end portion indicated by reference 916 of member 934 is cut at a slight angle, providing a chamfered surface to facilitate engagement of member 934 with periphery edge 980*a* or 980*b*.

Figures 1, 9H:
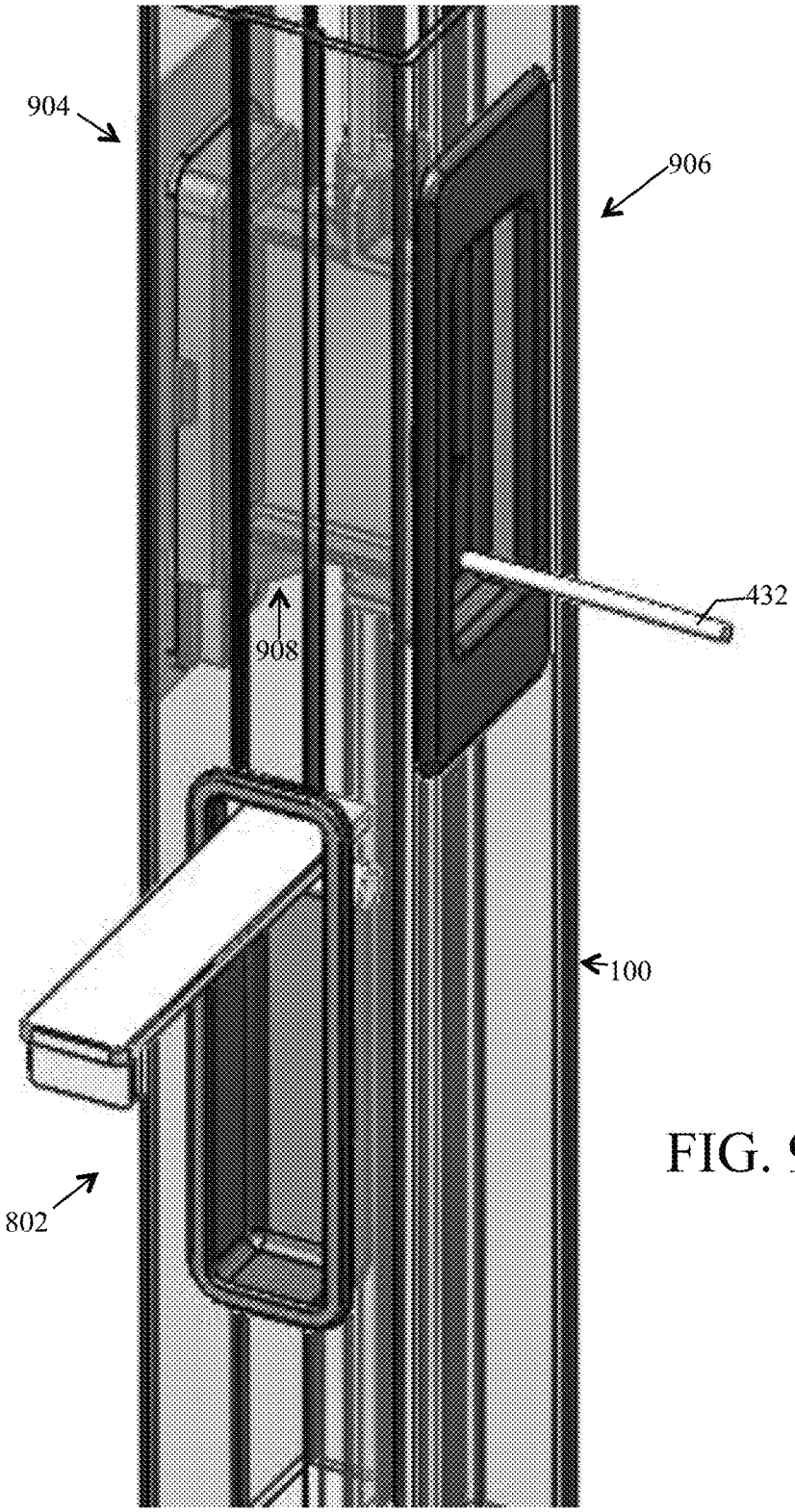
Figures 2, 9H:
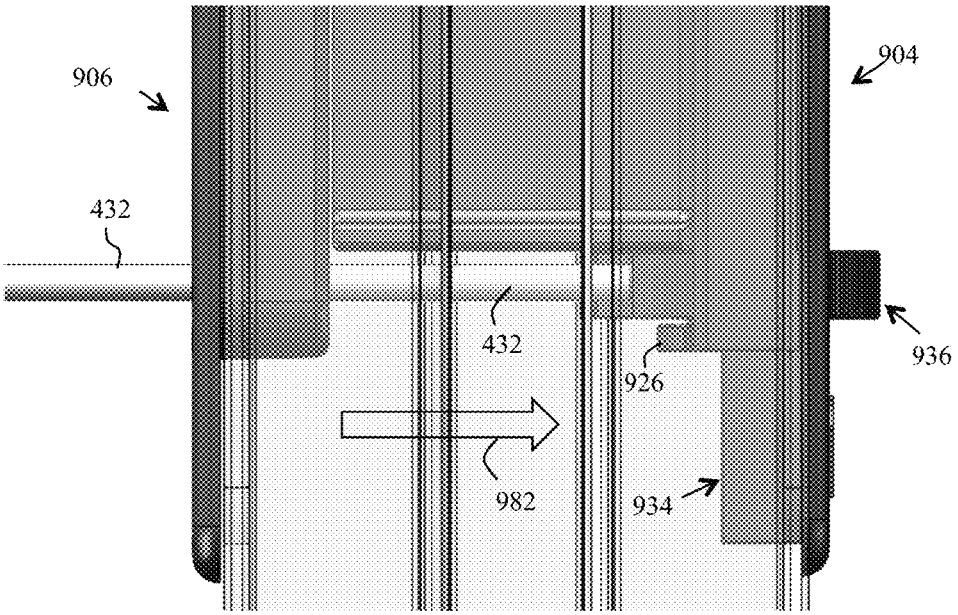
Figures 3, 9H:
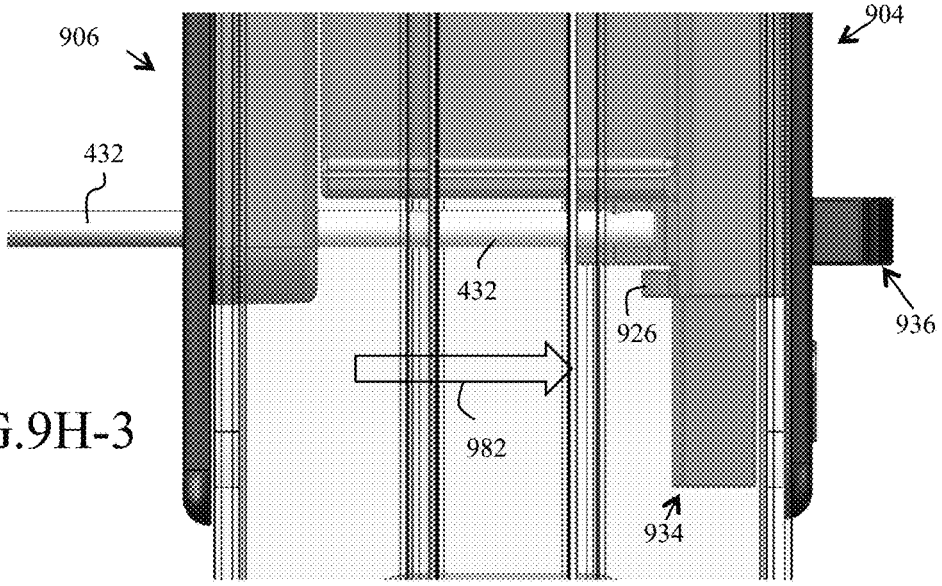

As further illustrated, privacy latch 908 further includes a handle or grip portion 936 that aids moving privacy latch 908 to one of a lock or unlock position. A cutout section 938 is provided to facilitate unlocking a locked privacy latch 908 from outside of an enclosed area. As best illustrated in FIGS. 9H-1 to 9H-3, in one embodiment, extrusion 100 may include a drilled hole 960 opposite cutout section 938, where a pin 432 may be inserted there through drilled hole 960 with the end of pin 432 pushing along arrow 982 shown in FIGS. 9H-1 to 9H-3 against cutout section 938 to move (rotate along reciprocating path 984) privacy latch 908 from closed (FIGS. 9H-1 and 9H-2) to an open (FIG. 9H-3-5) position.

Figure 7A:
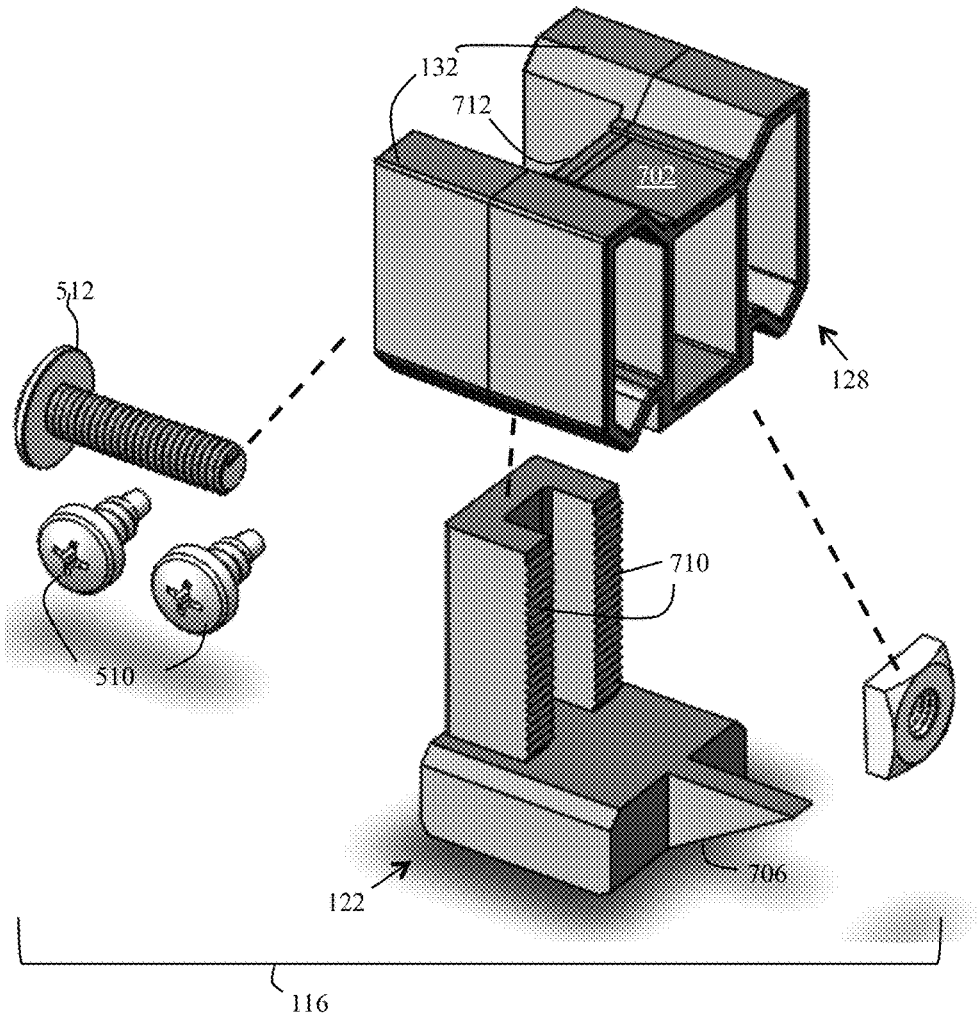
Figures 1, 7B:
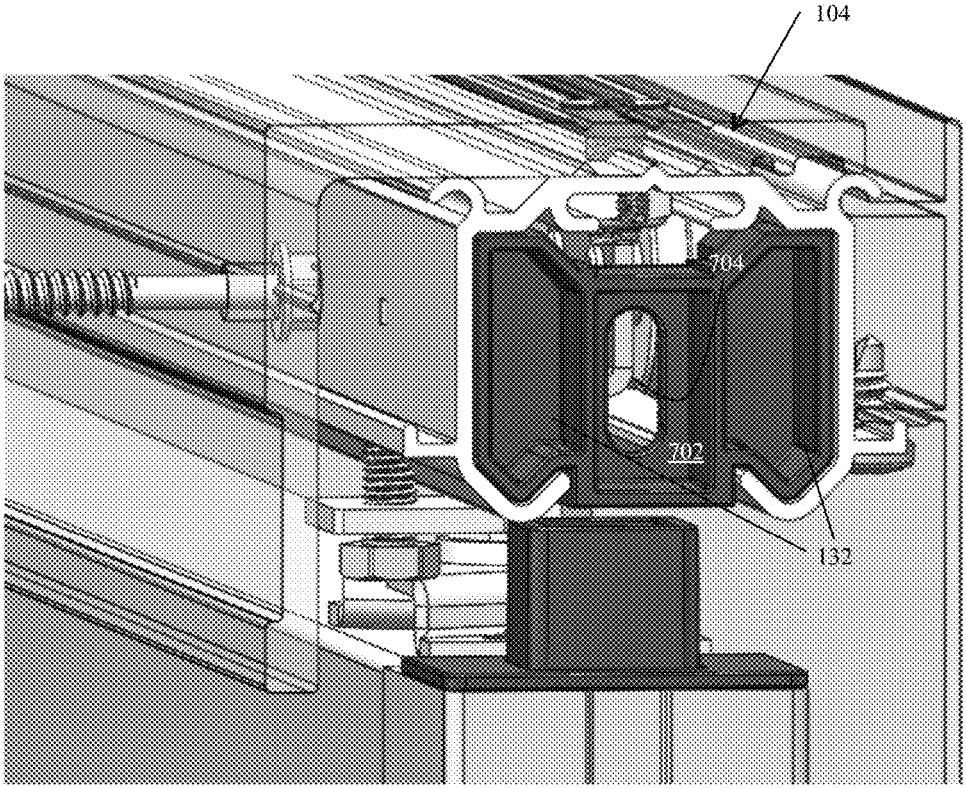
Figures 2, 7B:
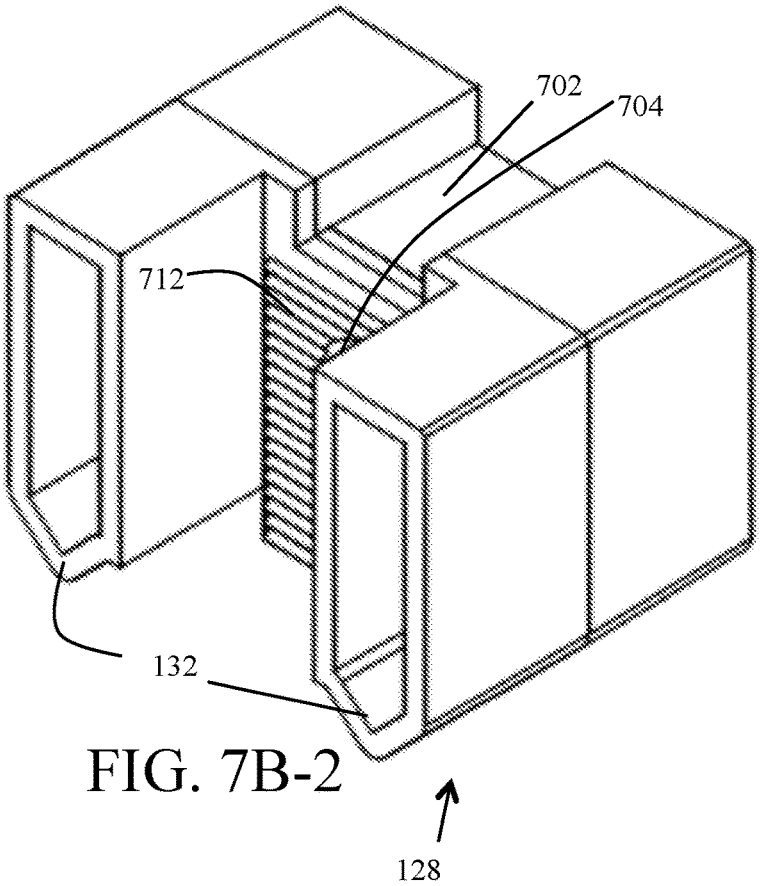
Figures 3, 7B:
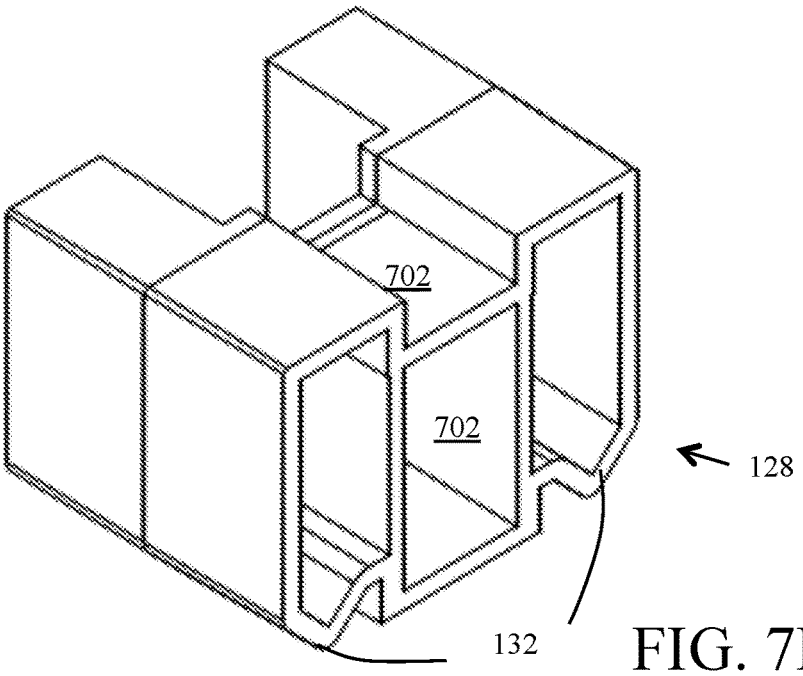
Figures 4, 7B:
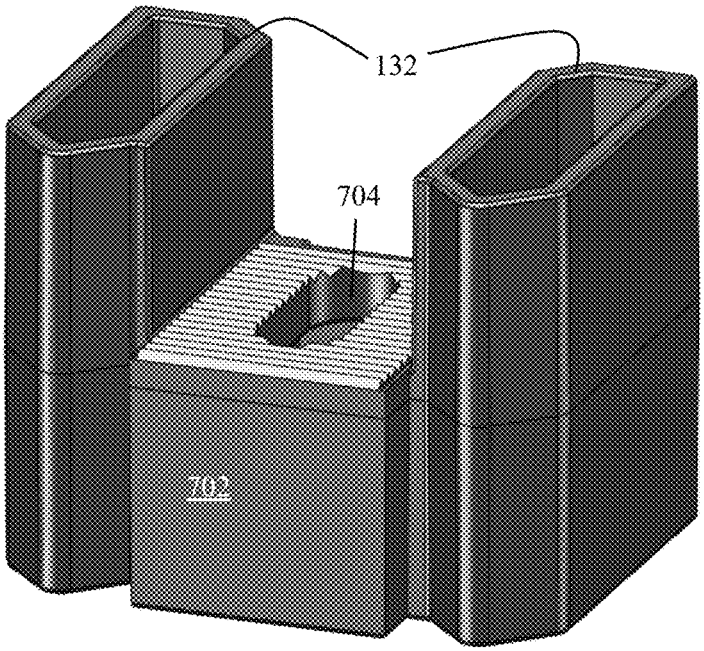
Figures 5, 7B:
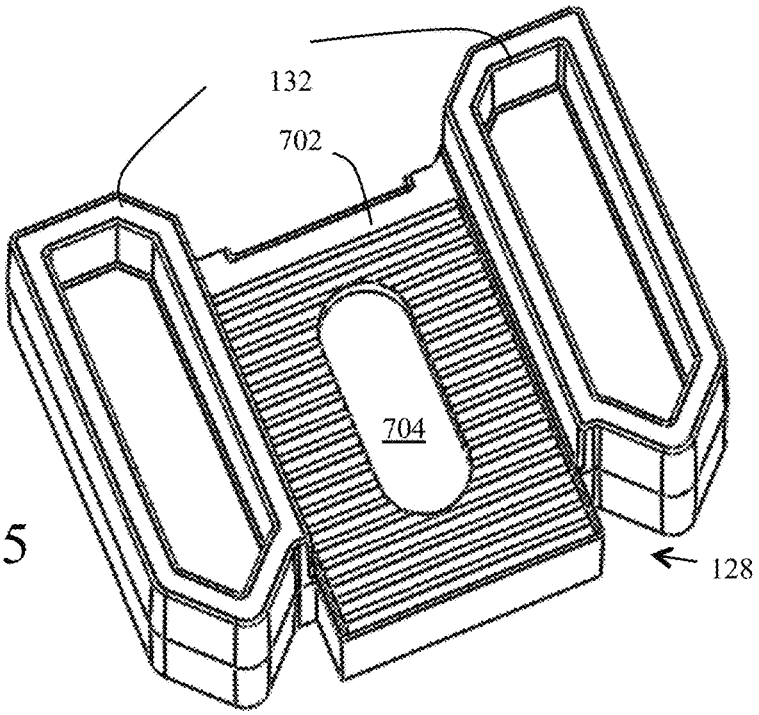
Figure 7C:
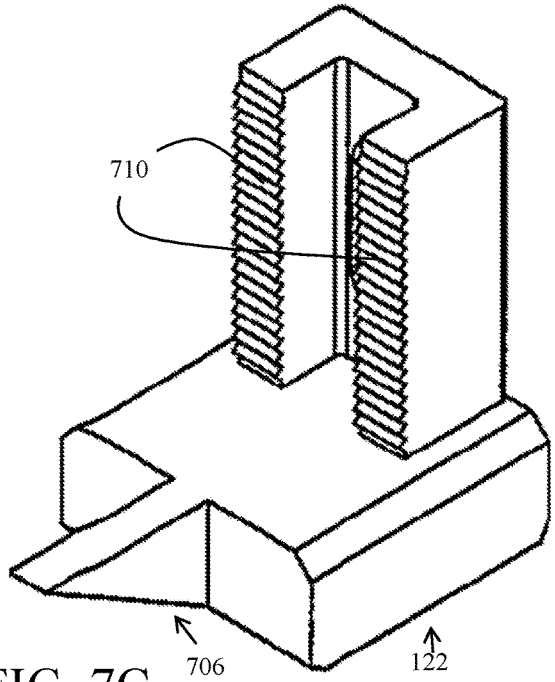
Figure 7D:
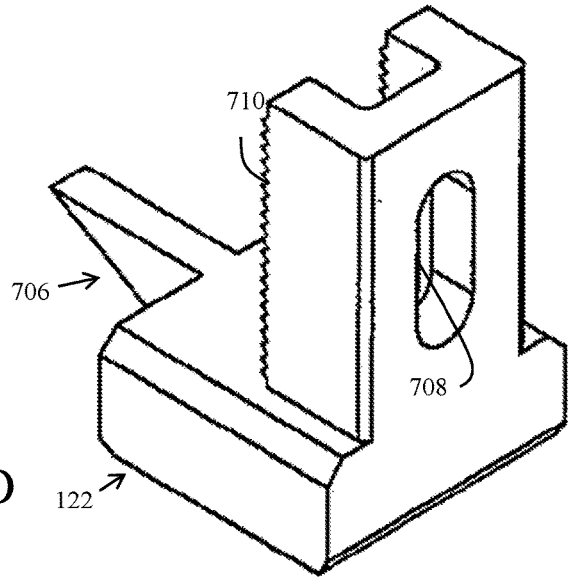
Figures 1, 7E:
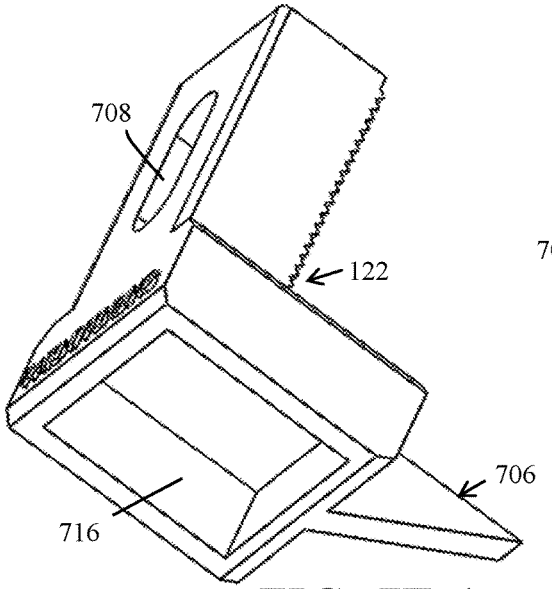
Figures 2, 7E:
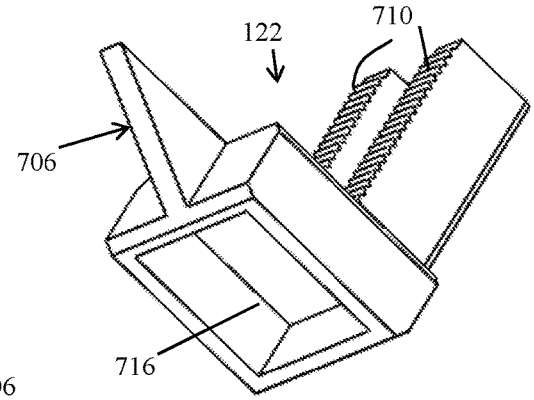
Figure 7F:
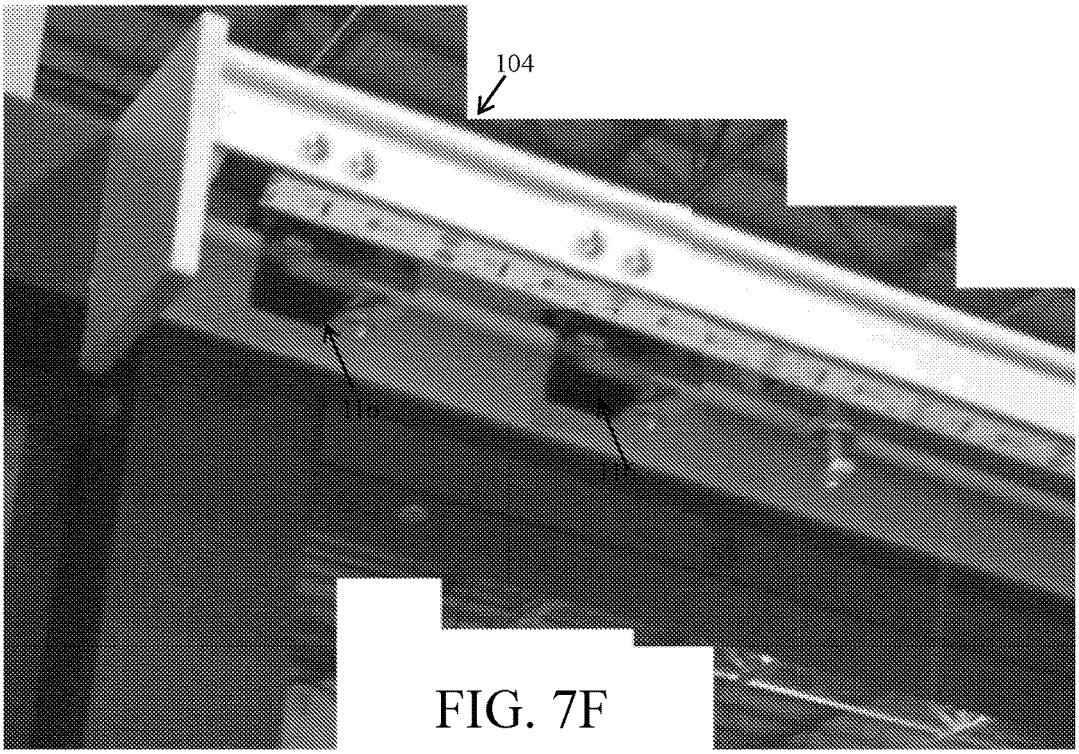
Figure 8A:
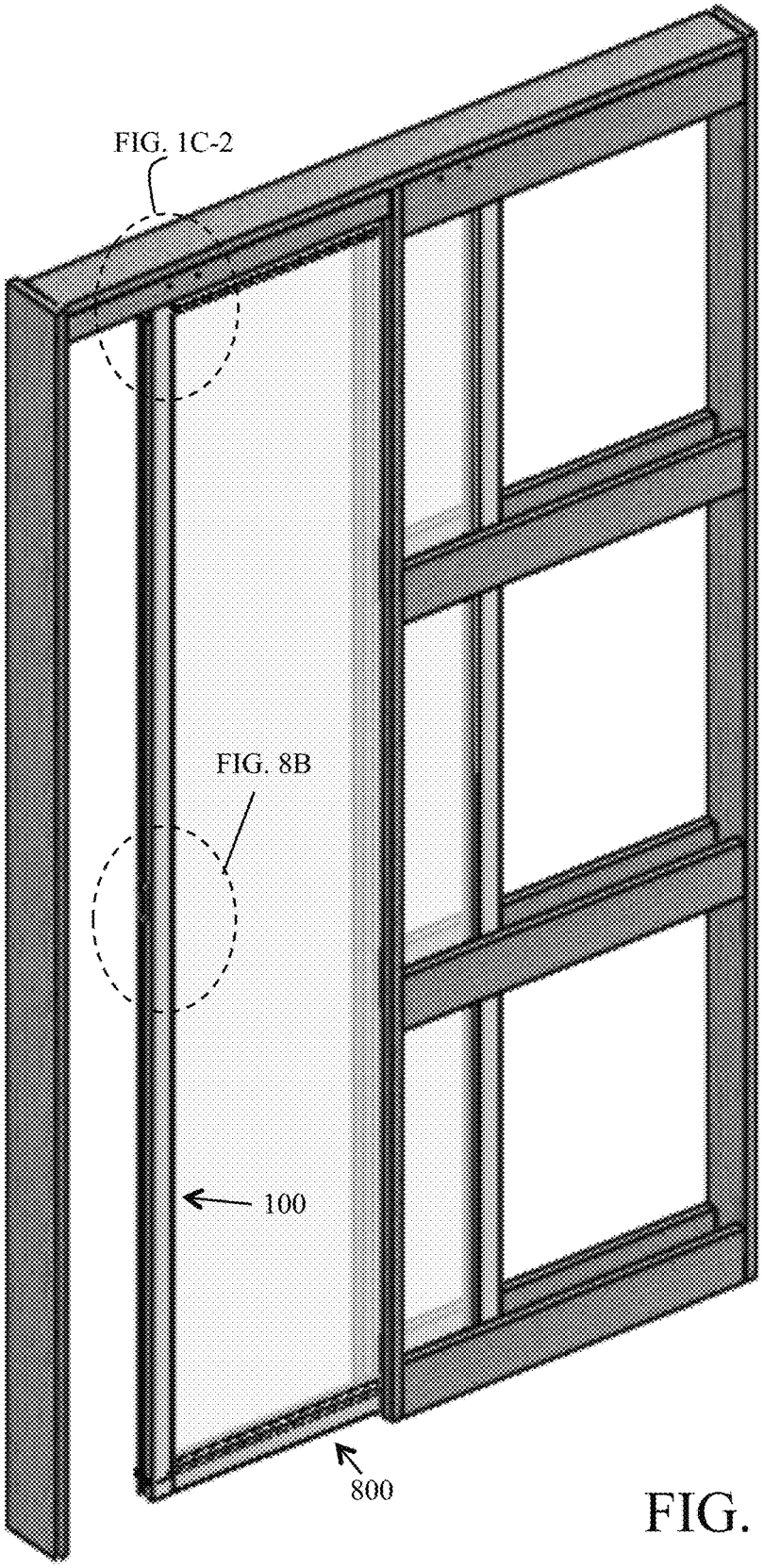
Figure 8B:
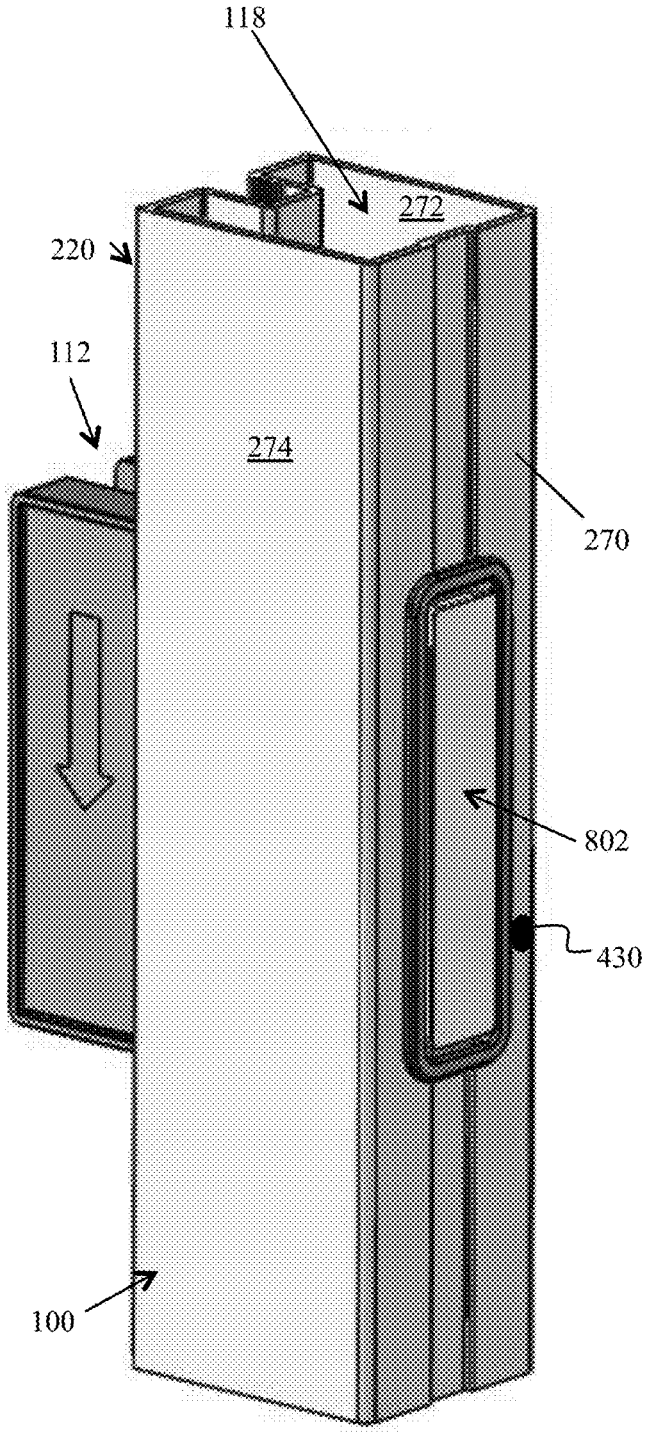
Figure 8C:
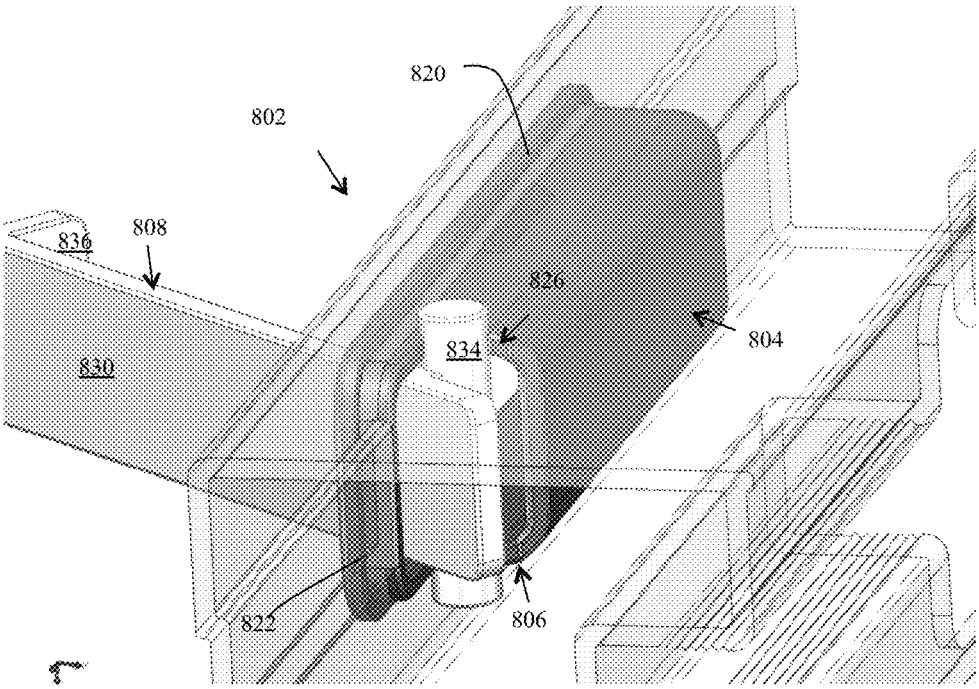
Figure 8D:
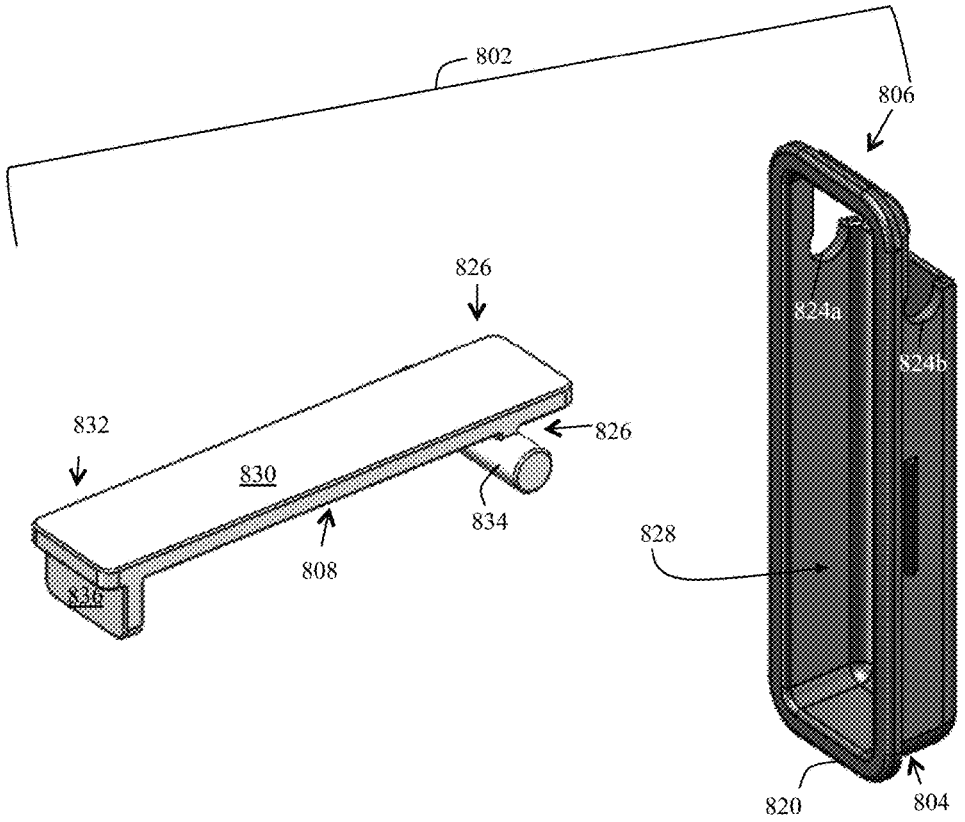
Figures 1, 8E:
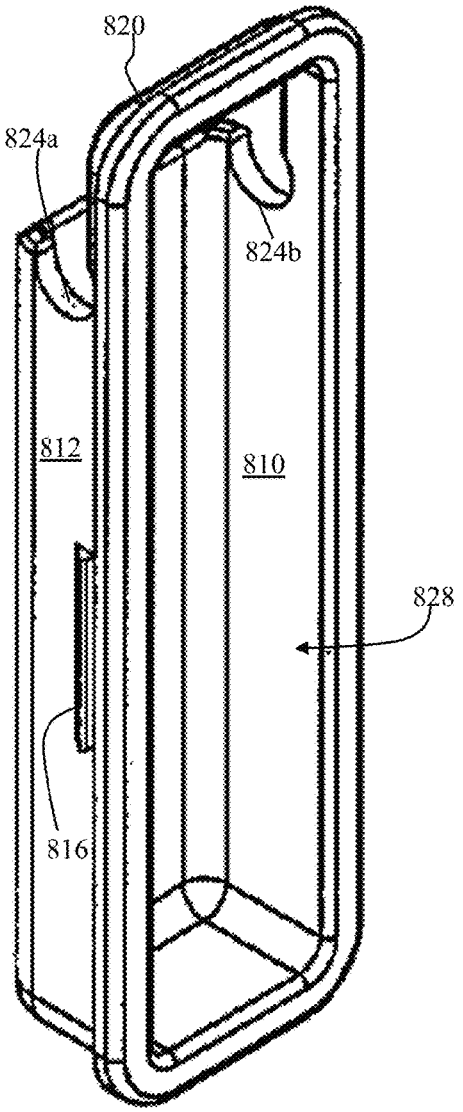
Figures 2, 8E:
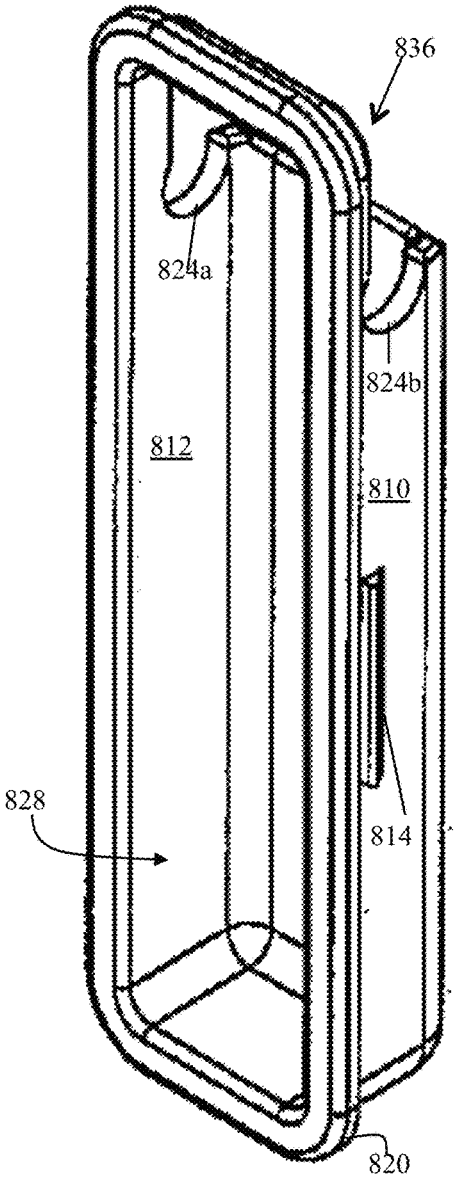
Figures 1, 2, 8F:
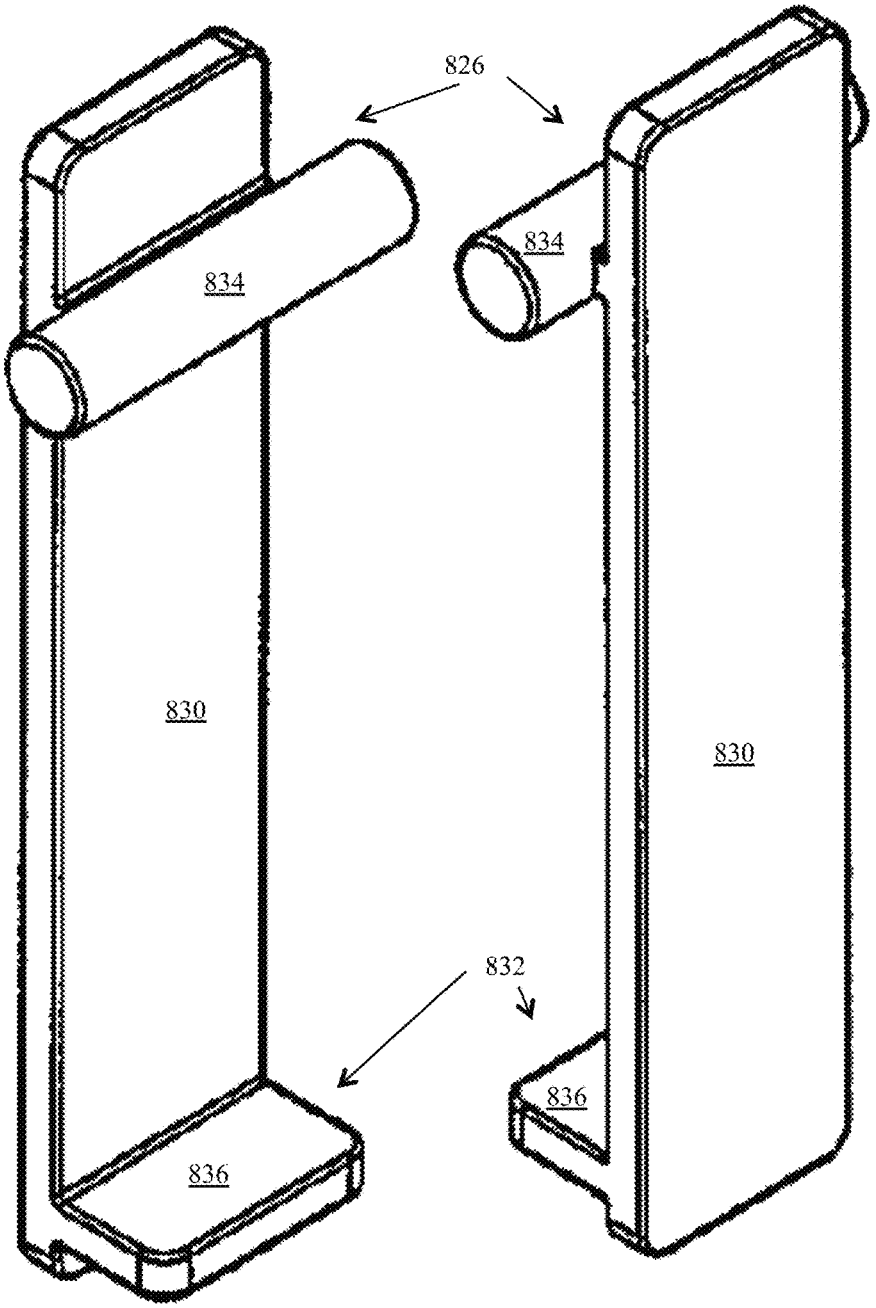
Figures 1, 9I:
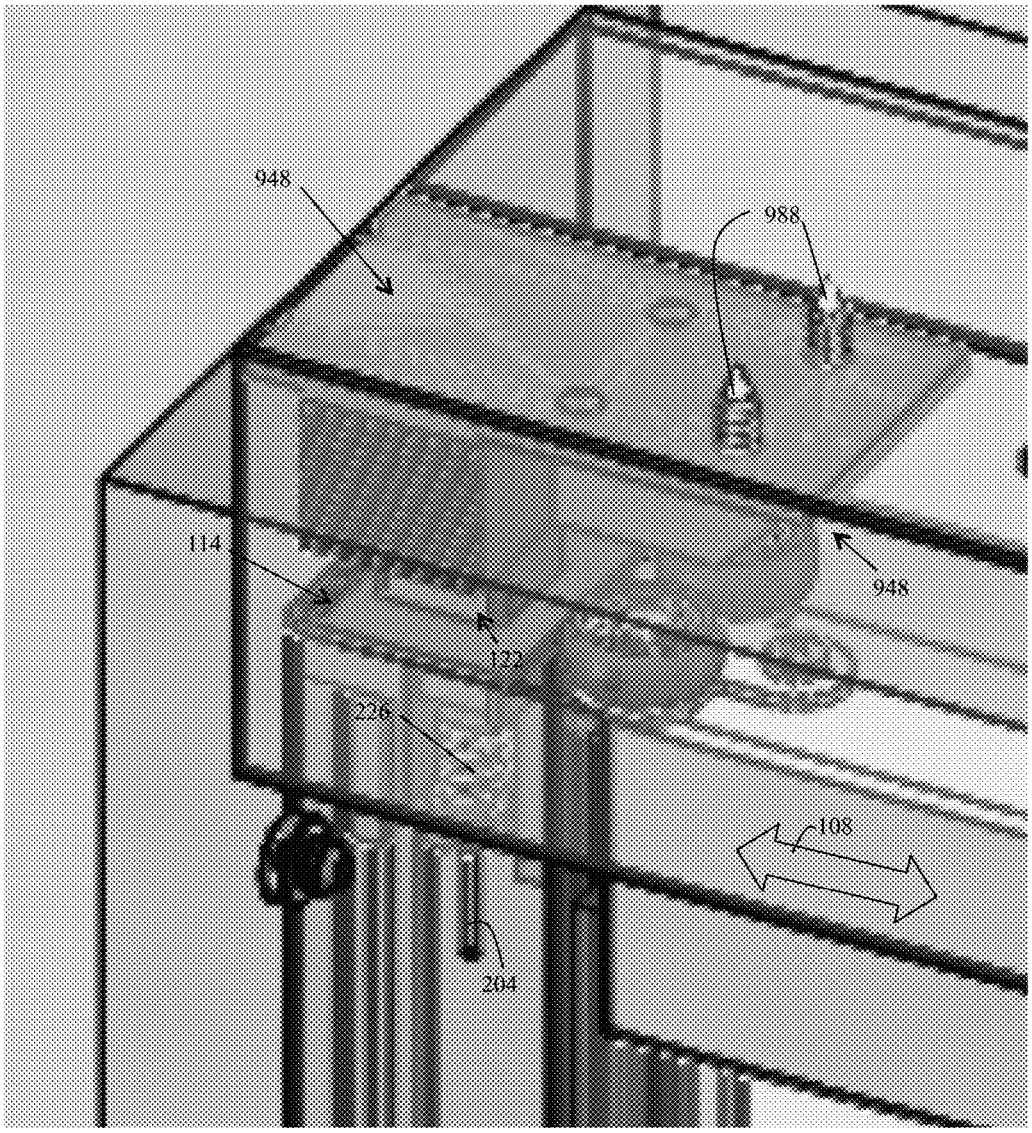
Figures 2, 9I:
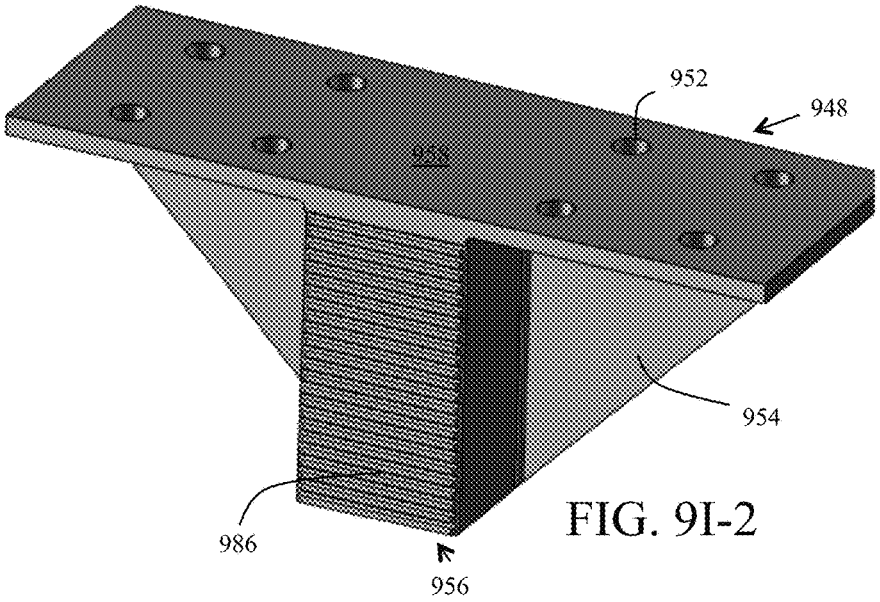
Figures 3, 9I:
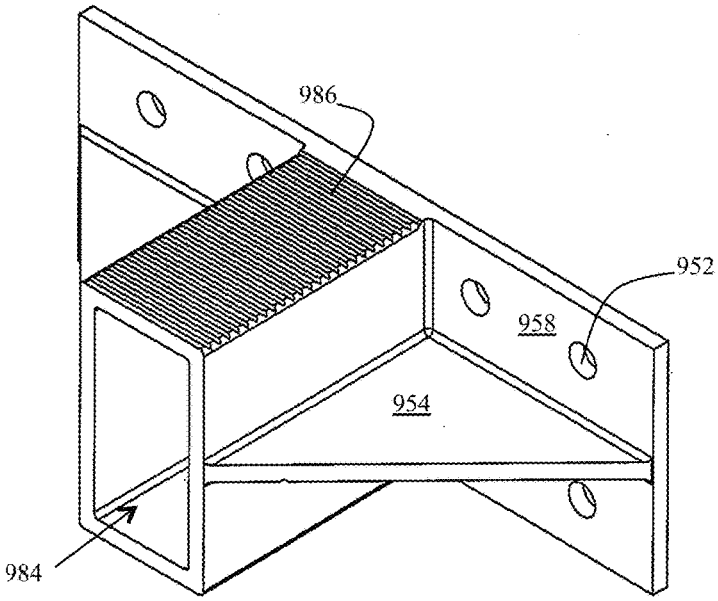
Figures 4, 9I:
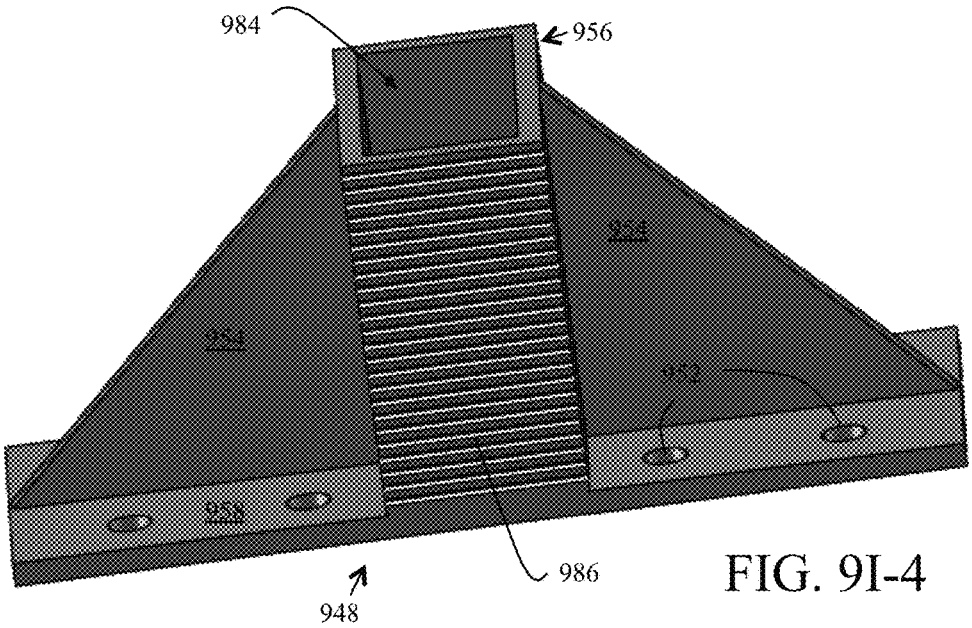
Figures 5, 9I:
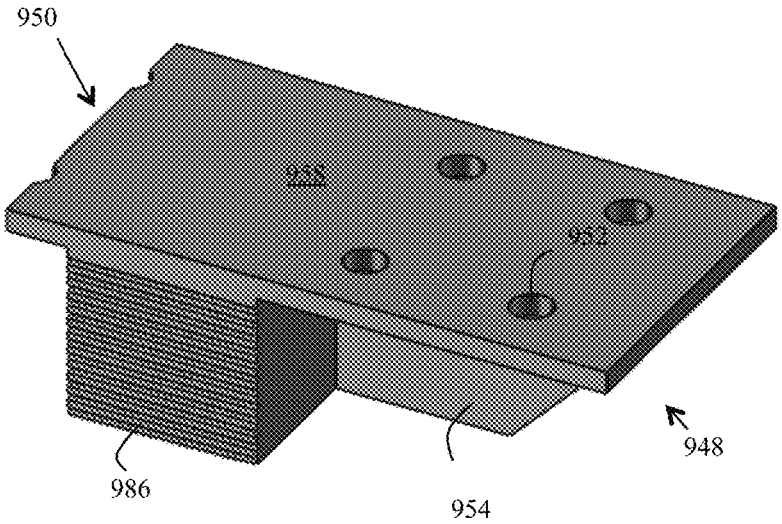

FIGS. 9I-1 to 9I-5 are non-limiting, exemplary illustrations of a keeper in accordance with one or more embodiment of the present invention. As illustrated, in this non-limiting, exemplary instance, keeper 948 is coupled with a rail by a set of fasteners 988. Keeper 948 is comprised of a connection base 958 and a relief 984. The connection base 958 includes a set of apertures 952 for use of fasteners 988 to connect keeper 948 with rail. Relief of keeper 984 is a cavity that receives latch 126. Keeper 948 also includes an angled section 954 that functions as a chamfered edge that guides the latch 126 into relief 984. In general, portion 956 that defines relief or cavity 984 may be adjusted (cut in size along its length) for appropriate fitting. Serrations 986 (at both sides of portion 956) may be used as indicating marks for trimming portion 956 in the field (at job site) because each installation is different due to size and out of square installations (which is illustrated in FIG. 9I-5).

As illustrated in FIGS. 9I-1 to 9I-5, keeper 948 includes a chamfered-guide portion 954 that progressively engages with and moves latch 126 that is biased by default to an extended position by resilient member 226 to a retracted position so that latch 126 clears walls of a cavity 948 of the keeper 122, and once aligned with relief or cavity 948, latch 126 is extended to the extended default position by resilient member 226 and locked into keeper cavity 948.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A lock mechanism, comprising:

a latch mechanism that includes:

a remote latch actuator that is positioned remotely from a remote latch assembly and a keeper assembly, with the latch mechanism housed and accommodated within an enclosure;

the remote latch assembly is comprised of a latch that engages the keeper assembly;

the latch reciprocally moves within an opening of a guide, biased to a default extended position by a resilient member when the resilient member is at default rest position, secured by a support member;

the support member includes:

a base that retains and supports a second end of the resilient member, with the base including a cylindrical projection from a surface of the base to securely maintain the resilient member in appropriate orientation when compressed; and lateral securing arms that extend from the base, and include distal ends that interlock with the cap.

2. The lock mechanism as set forth in claim 1, wherein:

the remote latch assembly is remotely actuated by the remote latch actuator by an actuator shaft.

3. The lock mechanism as set forth in claim 2, wherein:

a latch of the remote latch assembly is associated with the remote latch actuator by an actuator shaft.

4. The lock mechanism as set forth in claim 1, wherein:
the remote latch assembly is comprised of a latch that includes:
an internal holding structure to retain and hold a second end of an actuator shaft;
a cavity that houses a first end of the resilient member, which pushes against the internal holding structure;
a set of protuberances that function as stops to prevent the latch from extending out of the cap and overreaching.

5. The lock mechanism as set forth in claim 1, wherein:
the guide is comprised of:
an opening for allowing the latch to move within and extend out there-from to reach a keeper;
a support-base that enables the cap to rest on an opening of the extrusion;
a first and second guide-posts that extend from a bottom of the support-base of the cap, securing the cap within the extrusion, preventing lateral movement of the cap; and
a set of interlock extensions that are associated with the support member.

6. The lock mechanism as set forth in claim 1, wherein:
the keeper assembly is adjustable in a first orientation to vary distance between a latch member of the remote latch assembly and a keeper, and is adjustable in a second orientation to accommodate latching and secure locking and unlocking of an enclosure in desired fixed position in relation to a fixed structure.

7. The lock mechanism as set forth in claim 1, wherein:
one or more keeper assembly are associated with a structure at desired positions along a reciprocating path of the enclosure in relation to the fixed structure to allow latching and secure locking and unlocking of an enclosure in a desired position in relation to a structure.

8. The lock mechanism as set forth in claim 1, wherein:
one or more keeper assembly are vertically adjustable to allow for tolerances for accommodating variations in structures with which the lock mechanism is associated for continued correct operations.

9. The lock mechanism as set forth in claim 1, wherein:
the keeper assembly includes an adapter member that adjustably associates a keeper with a fixed structure.

10. The lock mechanism as set forth in claim 1, wherein:
the adapter member of the keeper assembly is securely fastened at a desired positions along a reciprocating path of the enclosure in relation to the fixed structure.

11. The lock mechanism as set forth in claim 1, wherein:
the adapter member is comprised of a first portion configured to associate with the fixed structure, and includes a second portion configured to associate with a keeper;
wherein the keeper is adjustably associated with the second portion.

12. The lock mechanism as set forth in claim 1, wherein:
the keeper includes a chamfered-guide portion that progressively engages with and moves a latch that is biased by default to an extended position by a resilient member to a retracted position so that the latch clears walls of a cavity of the keeper, and once aligned with the cavity, the latch is extended to the extended default position by the resilient member and locked into the keeper cavity.

13. The lock mechanism as set forth in claim 1, further comprising:
a privacy latch that prevents enclosure from being unlocked.

14. The lock mechanism as set forth in claim 1, wherein:
the remote latch actuator is inserted through and housed within an opening of an extrusion of the enclosure at a desired height.

15. The lock mechanism as set forth in claim 1, wherein:
the extrusion of the enclosure is hollow.

16. The lock mechanism as set forth in claim 1, wherein:
a chassis of the remote latch actuator is secured within the opening.

17. The lock mechanism as set forth in claim 16, wherein:
the chassis includes a pair of locking shoulders that when inserted within the opening of the extrusion, engage respective interior sides of the opening to secure a first part of the chassis within the extrusion.

18. The lock mechanism as set forth in claim 16, wherein:
the chassis further includes at least one mounting extension portion that extends out of the hollow extrusion and the opening for mounting of a handle assembly.

19. The lock mechanism as set forth in claim 18, wherein:
the mounting extension includes:
a bracket shaped profile with a top and bottom flange configured to received and accommodate a frame of the handle assembly; and
a lateral opening configured to receive and interlock a set of prongs of a cover of the handle assembly, with the cover prongs interlocking with both the mounting extension and the frame.

20. The lock mechanism as set forth in claim 16, wherein:
the chassis includes:
a first chassis side associated with an actuator shaft for transmission of motion of the remote latch actuator to the remote latch assembly;
a second and third sides that includes locking shoulders that are associated with an interior surface of the opening, with at least one of the second and third sides having a mounting extension;
with the first, the second, and the third sides forming a void to receive a linear-guide.

21. The lock mechanism as set forth in claim 1, wherein:
the actuator shaft has a second end that is associated with the remote latch assembly.

22. The lock mechanism as set forth in claim 16, wherein:
a linear-guide that functions as a bearing in relation to the chassis;
the linear-guide has anchors that secure the linear-guide within the opening at a fixed position, and enable the chassis to glide over the linear-guide to and from a first and second positions.

23. The lock mechanism as set forth in claim 22, wherein:
the linear-guide further includes:
three sides that form a cavity that receives a body of the enclosure, with the three sides being linear for smoothly gliding the chassis along a reciprocating path to actuate a remote latch mechanism.

24. The lock mechanism as set forth in claim 1, wherein:
the extrusion includes a first side for receiving a body of the enclosure, with the first side comprised of a first extrusion cavity that accommodate a distal end of the body of the enclosure;
the extrusion further includes a second side, opposite the first side, with the second side comprised of a second extrusion cavity that accommodate the handle assembly.

25. A lock mechanism, comprising:

a latch mechanism that includes:

a remote latch actuator that is positioned remotely from a remote latch assembly and a keeper assembly, with the latch mechanism housed and accommodated within an enclosure;

the remote latch assembly is comprised of a latch that engages the keeper assembly;

the latch reciprocally moves within an opening of a guide, biased to a default extended position by a resilient member when the resilient member is at default rest position, secured by a support member;

the guide is comprised of:

an opening for allowing the latch to move within and extend out there-from to reach a keeper;

a support-base that enables the cap to rest on an opening of the extrusion;

a first and second guide-posts that extend from a bottom of the support-base of the cap, securing the cap within the extrusion, preventing lateral movement of the cap; and a set of interlock extensions that are associated with the support member.

* * * * *